US006367459B1

(12) United States Patent
Yoshioka et al.

(10) Patent No.: US 6,367,459 B1
(45) Date of Patent: Apr. 9, 2002

(54) AIR-FUEL RATIO VARIATION SUPPRESSING APPARATUS FOR INTERNAL COMBUSTION ENGINE

(75) Inventors: Mamoru Yoshioka, Anjyou; Kenichiro Kawase, Toyota; Kiyoshi Asada, Okazaki; Noritake Mitsutani, Toyota, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/507,920

(22) Filed: Feb. 22, 2000

(30) Foreign Application Priority Data

Feb. 24, 1999 (JP) ..... 11-046193
Dec. 7, 1999 (JP) ..... 11-347860

(51) Int. Cl.[7] ..... F02M 33/02
(52) U.S. Cl. ..... 123/520; 123/516
(58) Field of Search ..... 123/516, 518, 123/519, 520, 198 D

(56) References Cited

U.S. PATENT DOCUMENTS 5,090,459 A * 2/1992 Aoki et al. ..... 141/59
5,609,142 A 3/1997 Osanai ..... 123/520
5,623,911 A * 4/1997 Kiyomiya et al. ..... 123/520
5,632,251 A * 5/1997 Ishikawa ..... 123/516
5,653,211 A * 8/1997 Ishikawa ..... 123/520
5,878,728 A * 3/1999 Kidokoro et al. ..... 123/520
6,047,687 A * 4/2000 Ishikawa et al. ..... 123/518

FOREIGN PATENT DOCUMENTS

JP A-8-189426 7/1996

* cited by examiner

*Primary Examiner*—Willis R. Wolfe
*Assistant Examiner*—Mahmoud M Gimie
(74) *Attorney, Agent, or Firm*—Oliff & Berridge, PLC

(57) ABSTRACT

An evaporation fuel processing mechanism supplies fuel vapor in a fuel tank to a canister via a vapor passage and purges fuel in the canister to an air-intake passage of an internal combustion engine via a purge passage when the internal combustion engine is operated. This mechanism supplies fuel vapor in the fuel tank when refueling to the canister via a breather passage. The breather passage has a pressure sensitive valve that opens in response to a variation in pressure in the fuel tank during refueling. An air-fuel ratio variation limiting apparatus determines whether the pressure sensitive valve is open and limits a variation in the air-fuel ratio when the pressure sensitive valve is open.

40 Claims, 39 Drawing Sheets

Map For Purge Rate $PGR_{100}$
With Purge Control Value Fully Open

AIR-FUEL RATIO VARIATION SUPPRESSING APPARATUS FOR INTERNAL COMBUSTION ENGINE

BACKGROUND OF THE INVENTION

The present invention relates to an air-fuel ratio variation suppressing apparatus for an internal combustion engine equipped with an evaporation fuel processing mechanism. This apparatus supplies fuel vapor in a fuel tank to a canister via a vapor passage and purges fuel in the canister to an air-intake passage of the internal combustion engine via a purge passage provided with a purge control valve when the internal combustion engine is operated. This apparatus also supplies the fuel vapor provided in the fuel tank during refueling to the canister via a breather passage and a pressure sensitive valve, which opens in response to the pressure in the fuel tank during refueling.

Evaporation fuel processing apparatuses have conventionally been used to prevent fuel vapor generated in the fuel tank of a vehicle from leaking into the air (see Japanese Unexamined Patent Publication (KOKAI) No. Hei 8-144870 and Japanese Unexamined Patent Publication (KOKAI) No. Hei 8-189426, for example).

Those evaporation fuel processing apparatuses have a vapor passage that connects the interior of the fuel tank to the interior of the canister, and the fuel vapor generated in the fuel tank is led into the canister via the vapor passage. The fuel vapor is discharged into the atmosphere via an atmosphere release passage after most of its fuel component is captured by an adsorbent, like activated carbon, in the canister. The fuel component adsorbed by the adsorbent is separated from the adsorbent by air that is newly supplied into the canister from outside via an atmosphere-intake passage and is then supplied to the air-intake passage of the engine to be burned together with the intake fuel.

In an internal combustion engine equipped with such an evaporation fuel processing apparatus, the fuel that is purged in the air-intake passage affects air-fuel ratio control. Particularly when the concentration of the fuel to be purged is rich, the effect of purging on the air-fuel ratio control is noticeable. In this respect, the scheme disclosed in the aforementioned Japanese Unexamined Patent Publication (KOKAI) No. Hei 8-144870 determines the state of the fuel vapor produced in the fuel tank based on the purge progressing time and the amount of evaporation fuel generated in the fuel tank. The apparatus of this publication restricts the purge control valve provided in the purge passage when the fuel vapor is rich. This prevents rich fuel vapor from being purged so that the vapor does not influence the air-fuel ratio control.

Recently, there has been a demand for preventing leakage of fuel vapor during refueling and while the vehicle is running. This demand is met by a system that recovers fuel vapor in the fuel tank during refueling without any leakage to the atmosphere. This system is known as a so-called ORVR (Onboard Refueling Vapor Recovery) system.

Specifically, this system has a breather passage provided, separate from the vapor passage, between a fuel tank and canister as described in the aforementioned Japanese Unexamined Patent Publication (KOKAI) No. Hei 8-189426. In this breather passage is a diaphragm type differential pressure regulating valve, which opens according to the differential pressure between the pressure in the fuel tank and that in the fuel feeding pipe during refueling, which leads the fuel vapor in the fuel tank to the canister. At other times, the differential pressure regulating valve is closed to inhibit fuel vapor from flowing into the canister via the breather passage.

When a vehicle experiences strong vibration or accelerates or decelerates and the fuel in the fuel tank is greatly disturbed, however, the differential pressure regulating valve may open.

When there is a large amount of residual fuel in the fuel tank, much fuel is present in the fuel feeding pipe. In this case, the fuel may block the opening of a circulation line pipe that connects the upper portion of the fuel tank to the upper portion of the fuel feeding pipe to equalize their pressures. In this situation, the pressure passage that applies the pressure at the upper portion of the fuel feeding pipe to the differential pressure regulating valve is separated from the upper portion of the fuel tank by the liquid fuel.

When the surface of the fuel in the fuel feeding pipe falls according to the fuel surface in the fuel tank, the pressure at the upper portion of the fuel feeding pipe drops and the lower pressure is applied to the differential pressure regulating valve by the pressure passage. Meanwhile, the pressure in the fuel tank has been increased by disturbances in the fuel surface. This produces a differential pressure between the upper portion of the fuel feeding pipe and the inside of the fuel tank so that the differential pressure regulating valve may open, although refueling is not taking place.

During refueling, a lot of rich fuel vapor flows in the breather passage. Accordingly, rich fuel vapor remains in the breather passage after refueling. In some cases, this fuel vapor may condense so that fuel remains in liquid form.

As apparent from the above, it is possible that, although refueling is not occurring, the differential pressure regulating valve in the breather passage may open to discharge rich fuel or, in some cases, liquid fuel remaining in the breather passage to the canister.

As rich fuel is led to the canister, it is immediately drawn into the purge passage by the negative pressure of the intake air of the internal combustion engine. Most of the fuel therefore goes into the air-intake passage of the internal combustion engine from the purge passage without being adsorbed by the canister. This means that very rich fuel is supplied to the air-intake passage, changing the air-fuel ratio and significantly disturbing the air-fuel ratio control of the internal combustion engine. This is likely to adversely affect the stable combustion of the internal combustion engine.

To overcome this problem, the apparatus disclosed in the aforementioned Japanese Unexamined Patent Publication (KOKAI) No. Hei 8-189426 has a second differential pressure regulating valve provided downstream of the first one to prevent the breather passage from being opened at times other than when refueling. This second differential pressure regulating valve opens based on the difference between the pressure in the breather passage and the atmospheric pressure.

However, the provision of two differential pressure regulating valves in the breather passage in the system of Japanese Unexamined Patent Publication (KOKAI) No. Hei 8-189426 makes the evaporation fuel processing apparatus complex and increases the weight of the internal combustion engine.

The system disclosed in the aforementioned Japanese Unexamined Patent Publication (KOKAI) No. Hei 8-144870 fails to respond to the opening of the breather passage and the residual fuel in the breather passage and the consequential effect on the air-fuel ratio control.

SUMMARY OF THE INVENTION

Accordingly, it is an object of the present invention to provide an air-fuel ratio variation suppressing apparatus which can suppress a change in air-fuel ratio in an internal combustion engine that is caused by the supply of rich fuel vapor through a breather passage at other times than the time of refueling, without complicating the breather passage or increasing the weight of the engine.

To achieve the above object, according to one aspect of this invention, an air-fuel ratio variation suppressing apparatus for an internal combustion engine, which is equipped with an evaporation fuel processing apparatus fuel processing mechanism for supplying fuel vapor in a fuel tank to a canister via a vapor passage, purging fuel in the canister to an air-intake passage of the internal combustion engine via a purge passage provided with a purge control valve when the internal combustion engine is operated, and supplying the fuel vapor in the fuel tank at a time of refueling to the canister via a breather passage provided with a pressure sensitive valve that opens in response to a variation in pressure in the fuel tank at a time of refueling, comprises determination means for determining an open state of the pressure sensitive valve; and suppression means for suppressing a variation in air-fuel ratio in accordance with a result of determination on the open state of the pressure sensitive valve made by the determination means.

DETAILED DESCRIPTION OF THE PREFERRED EMBODIMENTS

Figure 1:
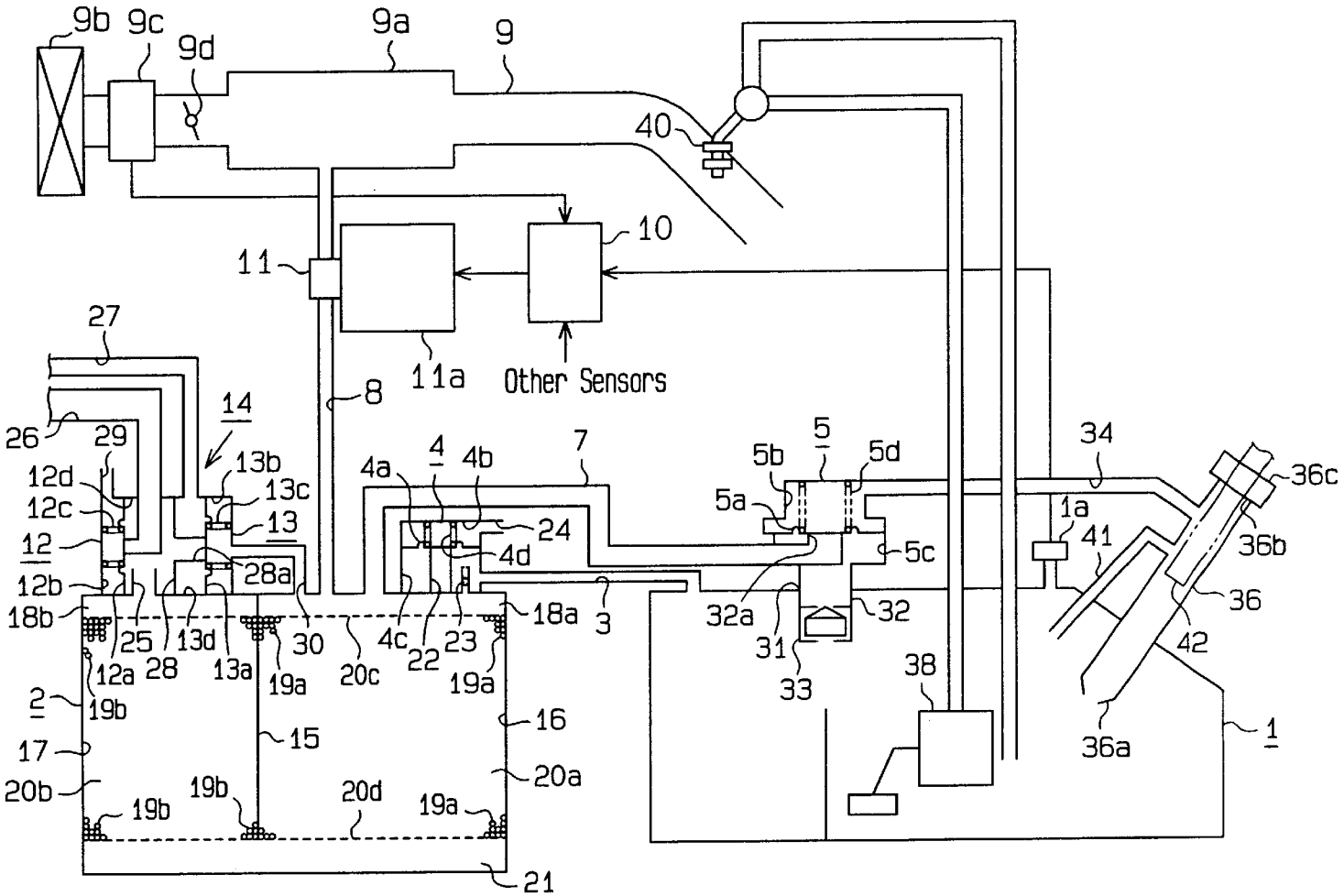
FIG. 1 is a schematic explanatory diagram illustrating the whole system of an air-fuel ratio variation suppressing apparatus according to a first embodiment.

FIG. 1 is a schematic explanatory diagram illustrating an air-fuel ratio variation suppressing apparatus according to a first embodiment. This apparatus is attached to a vehicle engine.

Connected to a fuel tank 1 of an engine, which is a gasoline type internal combustion engine, is one end of a vapor passage 3 for leading fuel vapor generated inside the fuel tank 1 to a canister 2. The other end of this vapor passage 3 is connected to the canister 2 via a first control valve 4 provided at the upper portion of the canister 2. The first control valve 4 is designed to open when the internal pressure in the fuel tank 1 becomes equal to or greater than a specific value.

The fuel tank 1 is provided with a differential pressure regulating valve (equivalent to a pressure sensitive valve) 5 which opens during refueling. This differential pressure regulating valve 5 is connected to the canister 2 by a breather passage 7. When the differential pressure regulating valve 5 opens, therefore, the fuel vapor in the fuel tank 1 is led into the canister 2 through the breather passage 7. In an ORVR (Onboard Refueling Vapor Recovery) process, the amount of fuel vapor that passes through the breather passage 7 is relatively large compared with the amount of fuel vapor that passes through the vapor passage 3. The cross-sectional area of the breather passage 7 is therefore set about 10 times that of the vapor passage 3.

The interior of the canister 2 is connected to a surge tank 9*a*, which is a part of an air-intake passage 9 of the engine, by a purge passage 8 that is provided with a purge control valve 11. The purge control valve 11 is opened or closed by a drive circuit 11*a* based on a control signal from an electronic control unit (ECU) 10. The ECU 10 includes a microcomputer and adjusts the amount of fuel to be supplied to the air-intake passage 9 from the canister 2.

The interior of the canister 2 is separated into two chambers, a main chamber 16 and a sub chamber 17, by a partition 15 extending in the vertical direction. The main chamber 16 is located under the first control valve 4 for controlling the internal pressure of the fuel tank 1, and the sub chamber 17, which has a smaller inner volume than the main chamber 16, is located under a second control valve 14 for controlling the air supply into the tank. Air layers 18*a* and 18*b* are respectively formed above the main chamber 16 and sub chamber 17, and adsorbent layers 20*a* and 20*b* filled with adsorbents 19*a* and 19*b*, each including activated carbon, are respectively formed below the air layers 18*a* and 18*b*.

Respectively provided above and below the adsorbent layers 20*a* and 20*b* are filters 20*c* and 20*d*, between which the adsorbents 19*a* and 19*b* are filled. The space under the filter 20*d* is a diffusion chamber 21, which connects the main chamber 16 to the sub chamber 17.

A vapor inlet port 22 for leading the fuel vapor generated in the fuel tank 1 into the canister 2 is formed in the top of the canister 2 above the main chamber 16. Formed on the right-hand side of the vapor inlet port 22 is a check-ball type vapor relief valve 23 for ventilation when the pressure in the fuel tank 1 becomes negative.

The first control valve 4 is provided on the top surface of the canister 2 to cover the vapor inlet port 22. The first control valve 4 has a diaphragm 4*a*, which can close the distal opening of the vapor inlet port 22. The diaphragm 4*a* separates the inside of the first control valve 4 into a back pressure chamber 4*b* above the diaphragm 4*a* and a positive pressure chamber 4*c* below it. Formed in the side wall of the back pressure chamber 4*b* is an open port 24 for keeping the interior of that chamber at atmospheric pressure. The interior of the positive pressure chamber 4*c* is connected via the vapor passage 3 to the interior of the fuel tank 1.

As the diaphragm 4*a* is pressed toward the distal opening of the vapor inlet port 22 by the force of a spring 4*d* located in the back pressure chamber 4*b*, the first control valve 4 is held closed until the pressure in the fuel tank 1 becomes a specific pressure or higher.

One end of the breather passage 7 is connected to the top of the canister 2 above the main chamber 16. The purge passage 8 is likewise connected to the main chamber 16 adjacent to the opening of the breather passage 7.

A ventilation port 25 is formed in the top of the canister 2 above the sub chamber 17. The second control valve 14 is provided to cover this ventilation port 25. The second control valve 14 is formed by arranging an open control valve 12 and a suction control valve 13 to face each other.

An atmospheric pressure chamber 12*b* is formed on the left-hand side of a diaphragm 12*a* in the diagram, provided in the open control valve 12, and a negative pressure chamber 13*b* is formed on the right-hand side of a diaphragm 13*a* in the diagram, provided in the suction control valve 13. The space that is sandwiched between those two diaphragms 12*a* and 13*a* is defined into two pressure chambers by a partition 28. One of those two pressure chambers is a positive pressure chamber 12*d* of the open control valve 12 while the other one is an atmospheric pressure chamber 13*d* of the suction control valve 13.

Formed in a part of the partition 28 is a pressure port 28*a*, the distal opening of which can be closed by the diaphragm 13*a*. An atmosphere-intake passage 27 is connected to the atmospheric pressure chamber 13*d*. As the diaphragm 13*a* is pressed toward the distal opening of the pressure port 28*a* by the force of a spring 13*c* located in the negative pressure chamber 13*b*, the suction control valve 13 is held closed. Connected to the side portion of the negative pressure chamber 13*b* is a pressure passage 30, which connects the interior of that chamber 13*b* to the interior of the main chamber 16 of the canister 2, so that the pressure generated in the purge passage 8 is applied to the negative pressure chamber 13*b*.

At the time the fuel adsorbed in the canister 2 is purged to the air-intake passage 9 by the negative pressure generated in the surge tank 9*a* when the engine is activated, the suction control valve 13 is opened when the differential pressure between the intake pressure that acts on the negative pressure chamber 13*b* via the pressure passage 30 and the atmospheric pressure on the side of the atmospheric pressure chamber 13*d* reaches a specific value. This permits the outside air to be fed into the canister 2 from the sub chamber 17 via the pressure port 28*a* and the ventilation port 25. The supply of the outside air causes the fuel vapor adsorbed by the adsorbents 19*a* and 19*b* in the main chamber 16 and sub chamber 17 to flow toward the purge passage 8 to be discharged in the intake air that flows in the surge tank 9*a*.

An open port 29 which communicates with the atmospheric pressure chamber 12*b* of the open control valve 12 is formed in the top of the second control valve 14 so that the pressure in the atmospheric pressure chamber 12*b* is always equal to atmospheric pressure. Provided in the second control valve 14 is an atmosphere release passage 26, which conducts gas outside after the fuel component has been recovered in the canister 2. Because a large amount of air (the gas from which the fuel component has been recovered) is discharged outside via the atmosphere release passage 26 in the ORVR process, the atmosphere release passage 26 has substantially the same cross-sectional area as the breather passage 7. The distal opening of the atmosphere release passage 26 is closable by the diaphragm 12*a* of the open control valve 12. As the diaphragm 12*a* is pressed toward the opening of the atmosphere release passage 26 by the force of a spring 12*c* located in the atmospheric pressure chamber 12*b*, the open control valve 12 is held closed until the internal pressure of the canister 2 becomes equal to or higher than a specific pressure.

When pressure is applied to the inside of the canister 2 from the breather passage 7 when refueling, therefore, the pressure in the positive pressure chamber 12*d* of the open control valve 12 rises and the open control valve 12 is opened when the differential pressure between the pressure in the positive pressure chamber 12*d* and the atmospheric pressure to be applied to the atmospheric pressure chamber 12*b* from the open port 29 reaches a specific level. As a result, the gas from which the fuel vapor has been removed by adsorption through the main chamber 16 and the sub chamber 17 is discharged outside via the ventilation port 25 and the atmosphere release passage 26.

An insertion hole 31 is formed in the top of the fuel tank 1 and a cylindrical breather pipe 32, which is a part of the breather passage 7, is securely fitted in this hole 31. A float valve 33 is formed at the lower portion of the breather pipe 32.

The differential pressure regulating valve 5 is provided at the top of the fuel tank 1 in such a way as to cover an opening 32*a* formed in the top of the breather pipe 32. The interior of the differential pressure regulating valve 5 is separated by a diaphragm 5*a* into upper and lower chambers or a first pressure chamber 5*b* located above the diaphragm 5*a* and a second pressure chamber 5*c* located below the diaphragm 5*a*. The diaphragm 5*a* is pressed toward the opening 32*a* by the force of a spring 5*d* located in the first pressure chamber 5*b*. As apparent from the above, the differential pressure regulating valve 5 is designed to close as the opening 32*a* is closed by the diaphragm 5*a*. As the diaphragm 5*a* is separated from the opening 32*a*, therefore, the differential pressure regulating valve 5 is opened.

The first pressure chamber 5*b* of the differential pressure regulating valve 5 is connected through a pressure passage 34 to the upper portion of a fuel feeding pipe 36 provided in the fuel tank 1. A restriction 36*a* is formed at the lower distal end portion of this fuel feeding pipe 36. When fuel passes this restriction 36*a*, the pressure in the vicinity of the restriction 36*a* becomes negative so that the fuel vapor in the fuel feeding pipe 36 flows toward the fuel tank 1 from a refuel port 36*b* along the path of the fuel flow. This prevents the fuel vapor from leaking outside from the refuel port 36*b*. A recirculation line pipe 41, which connects the upper portion of the fuel tank 1 to the upper portion of the fuel feeding pipe 36, is provided to permit circulation of the fuel vapor in the fuel tank 1 between this tank 1 and the fuel feeding pipe 36 at the time of refueling, thereby ensuring smooth refueling.

Provided at the top of the fuel tank 1 is a pressure sensor (equivalent to the third detection means) 1*a* for detecting the pressure in the fuel tank 1. A detection signal obtained by the pressure sensor 1*a* is sent to the ECU 10, which is controlling the purge control valve 11. Signals from various kinds of sensors such as an air flow meter 9*c* (equivalent to the first detection means for detecting the amount of intake air) provided in the air-intake passage 9 are likewise sent to the ECU 10.

The air-fuel ratio variation suppressing apparatus having the above-described structure operates as follows. To begin with, a description will be given of a vapor processing routine in a case where no ORVR process is implemented, i.e., at times other than refueling, with reference to FIG. 1.

When fuel is evaporated in the fuel tank 1 and the internal pressure in the fuel tank 1 rises to or above a specific pressure value, the first control valve 4 opens. Consequently, the flow of fuel vapor toward the canister 2 from the fuel tank 1 is formed in the vapor passage 3. The fuel vapor in the fuel tank 1 is therefore led toward the canister 2 via the first control valve 4. In this case, because the internal pressures of the first pressure chamber 5*b* and second pressure chamber 5*c* of the differential pressure regulating valve 5 are equal to each other, the diaphragm 5*a* is in close contact with the opening 32*a* so that the differential pressure regulating valve 5 is held closed. This closes the breather passage 7.

The fuel vapor that has reached inside the canister 2 via the vapor passage 3 first has its fuel component recovered by the adsorbent 19*a* of the adsorbent layer 20*a* in the main chamber 16. Then, the fuel vapor passes through the adsorbent layer 20*a* and reaches the diffusion chamber 21. Further, the fuel vapor passes through the diffusion chamber 21 and comes into the sub chamber 17 where the fuel components that could not be recovered by the adsorbent layer 20*a* in the main chamber 16 is captured. As the fuel vapor flows along the U-shaped moving path in the canister 2 in this manner, the time during which it contacts the adsorbents 19*a* and 19*b* of the adsorbent layers 20*a* and 20*b* is extended, so that the fuel component is effectively recovered.

The fuel vapor, the fuel component of which, has mostly been recovered by the adsorbents 19*a* and 19*b* of the adsorbent layers 20*a* and 20*b*, is discharged outside through the atmosphere release passage 26 as the open control valve 12 is opened. At this time, the internal pressure of the negative pressure chamber 13*b* of the suction control valve 13 is a positive pressure greater than the internal pressure of the atmospheric pressure chamber 13*d*, so that the suction control valve 13 does not open. The fuel vapor is therefore prevented from leaking outside through the atmosphere-intake passage 27 via the suction control valve 13.

If, due to extended parking or the like, the fuel tank 1 cools, fuel vapor generation in the fuel tank 1 stops, the pressure in the fuel tank 1 falls below that of the canister 2, and the pressure in the positive pressure chamber 4*c* of the first control valve 4 becomes negative. This causes the check ball of the vapor relief valve 23 to move upward, opening the valve 23. Accordingly, the fuel vapor in the canister 2 is returned to the fuel tank 1 via the vapor passage 3.

The fuel component that has been recovered in the canister 2 is supplied to the air-intake passage 9 in the following manner. When the engine is activated, the pressure in the vicinity of the opening of the purge passage 8 on the surge tank (9*a*) side is shifted to negative pressure and the flow of fuel vapor toward the surge tank 9*a* from the canister 2 is formed in the purge passage 8 every time the purge control valve 11 is opened by the associated control signal from the ECU 10. As a result, the internal pressure of the canister 2 becomes negative and the suction control valve 13 opens to let air come into the canister 2 from the sub chamber 17 via the atmosphere-intake passage 27. Then, the fuel component adsorbed by the adsorbents 19a and 19*b* is separated from the adsorbents 19*a*, 19*b* by the air and mixes with the air.

The air thus causes the fuel vapor to be led into the purge passage 8 and discharged into the surge tank 9*a* via the purge control valve 11. In the surge tank 9*a*, the fuel vapor is mixed with the intake air that has passed through an air cleaner 9*b*, the air flow meter 9*c* and a throttle valve 9*d*. The air-fuel mixture is supplied together with the fuel injected from a fuel injection valve 40 via a fuel pump 38 in the fuel tank 1 into each cylinder (not shown) to be burned.

The ORVR process will now be discussed. At the time of refueling, first, a refuel cap 36*c* attached to the refuel port 36*b* of the fuel feeding pipe 36 is removed and a refuel nozzle 42 is inserted into the fuel feeding pipe 36 from the refuel port 36*b*. Because the interior of the first pressure chamber 5*b* of the differential pressure regulating valve 5 is connected by the pressure passage 34 to the vicinity of the refuel port 36*b* of the fuel feeding pipe 36 at this time, the internal pressure of the first pressure chamber 5*b* becomes substantially equal to the atmospheric pressure.

As fuel is fed into the fuel tank 1 from the refuel nozzle 42, the fuel surface in the fuel tank 1 rises and the amount of fuel vapor in the fuel tank 1 increases. As a result, the internal pressure of the fuel tank 1 rises. The fuel vapor under high pressure in the fuel tank 1 lifts the diaphragm 5*a* against the internal pressure (atmospheric pressure) of the first pressure chamber 5*b* of the differential pressure regulating valve 5 and the force of the spring 5*d*, thereby releasing the opening 32*a* and opening the differential pressure regulating valve 5.

Consequently, the fuel vapor in the fuel tank 1 flows into the breather passage 7 via the breather pipe 32 and the differential pressure regulating valve 5. The fuel vapor further flows into the canister 2 via the breather passage 7.

The process in which the fuel component is captured by the adsorbents 19*a* and 19*b* and is discharged outside after the fuel vapor flows into the canister 2 and the process by which the fuel component is captured by the adsorbents 19*a* and 19*b* is supplied to the air-intake passage 9 are the same as those in the above-described case where the ORVR process is not carried out. Their descriptions will not therefore be repeated.

A description will now be given of a purge restricting routine among those routines executed by the ECU 10, which is implemented when the differential pressure regulating valve 5 is opened at times other than refueling.

It is to be noted that in addition to this purge restricting routine, the ECU 10 executes routines such as a routine of computing a purge rate PGR in accordance with the running condition of the engine and performing duty control of the angle of the purge control valve 11 as will be discussed in a later section of a second embodiment. The routine of computing the purge rate PGR according to the running condition of the engine is carried out periodically and immediately before the purge restricting routine in FIG. 2 to be discussed below. The purge rate PGR is computed, for example, based on a variation in the value of an air-fuel ratio feedback compensation coefficient FAF which is calculated in the air-fuel ratio control as done in the second embodiment to be discussed later.

Figure 2:
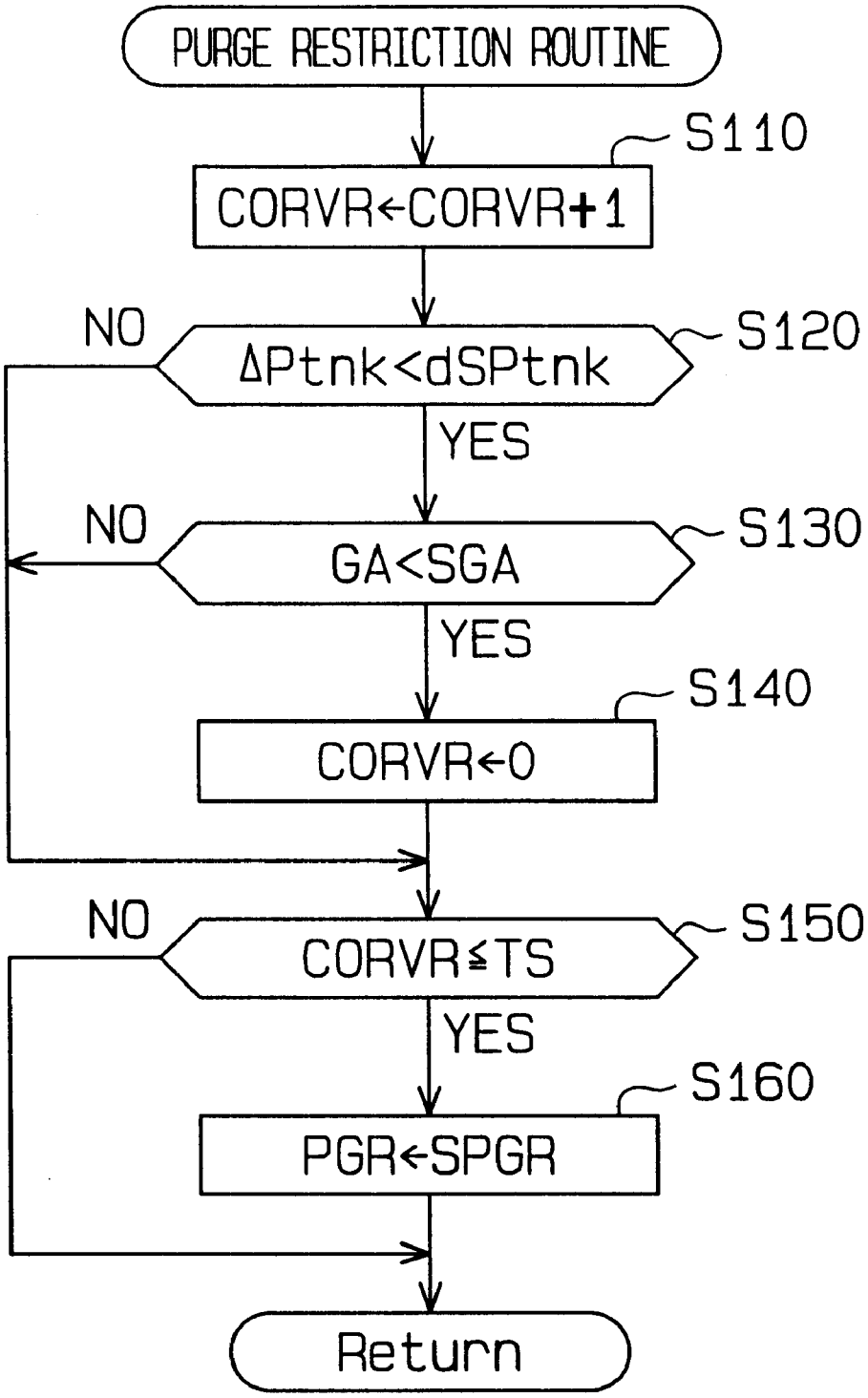
FIG. 2 is a flowchart of a purge restricting routine to be executed by an ECU in the first embodiment.

FIG. 2 illustrates the flowchart of a purge restricting routine. This purge restricting routine is executed by an interruption of every given period after the apparatus is powered on and initialization of the memory in the ECU 10 and initialization of a target unit to be driven are implemented.

In the individual flowcharts that will be discussed hereunder, the individual steps are denoted by "S*" where * indicates the associated step number. The same shall apply to the other embodiments.

When the purge restricting routine is initiated, first, a counter CORVR is incremented (S110). The counter CORVR counts the delay time during which the purge restricting conditions are not met. The counter COPVR is initialized to a value larger than a decision value TS (positive integer) for determining the passage of the delay time. Though not illustrated, the counter CORVR is guarded to prevent it from holding a value higher than the capacity of a memory.

It is determined whether a decision value ΔPtnk for determining a pressure drop in the fuel tank 1 is smaller than a reference value dsPtnk for determining an abrupt fall (S120). This reference value ΔPtnk is calculated in every given cycle in a routine for computing a pressure-drop decision value illustrated in the flowchart of FIG. 3.

The routine for computing a pressure-drop decision value in FIG. 3 will now be described. First, the pressure in the fuel tank 1 obtained from the output value of the pressure sensor 1*a* is stored as a fuel-tank internal pressure value Ptnk in the memory of the ECU 10 (S210). Then, based on this fuel-tank internal pressure value Ptnk and a grading value MPtnk of the pressure in the fuel tank 1, which has been calculated in the previous cycle, a new grading value MPtnk is acquired from computation of the following equation 1 (S220).

$$MPtnk \leftarrow \{(N-1)\cdot MPtnk+Ptnk\}/N \quad (1)$$

Figure 4:
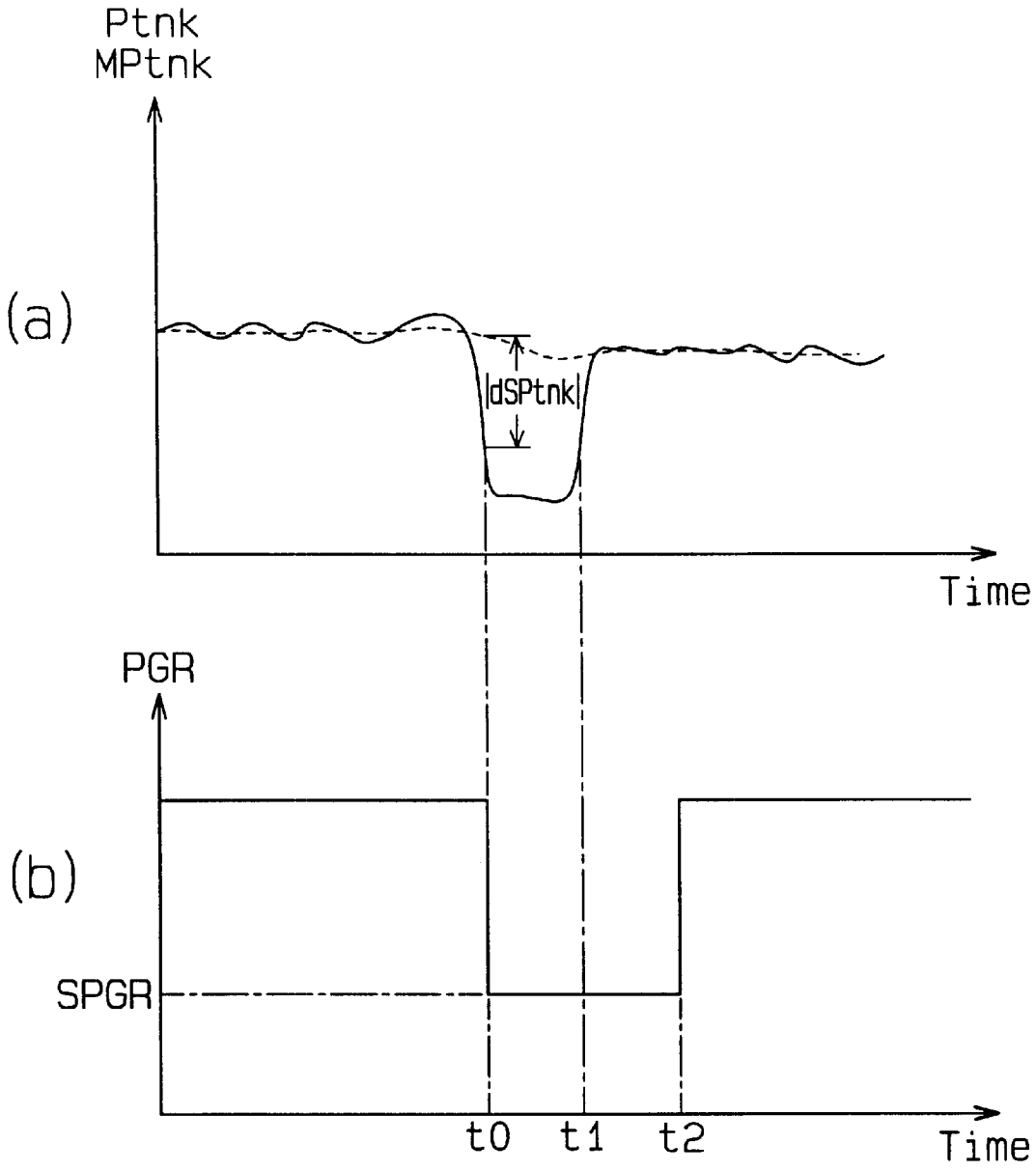
FIG. 4 is a timing chart exemplifying purge rate control according to the first embodiment.

This equation 1 shows calculation of a so-called weighted average, and the grading value MPtnk is acquired as a weighted average value. As the initial grading value MPtnk, for example, the fuel-tank internal pressure value Ptnk itself is set. FIG. 4A exemplifies a timing chart of the fuel-tank internal pressure value Ptnk (solid line) and the grading value MPtnk (broken line).

Next, the difference between the fuel-tank internal pressure value Ptnk and the grading value MPtnk is calculated and is set to the pressure-drop decision value ΔPtnk as shown in the following equation 2 (S230).

$$\Delta Ptnk \leftarrow Ptnk - MPtnk \quad (2)$$

The routine for computing the pressure-drop decision value is temporarily terminated and a sequence of processes starting with S210 will be repeated in the next cycle. In this manner, the pressure-drop decision value ΔPtnk is renewed at given periods.

Returning to FIG. 2, when the pressure-drop decision value ΔPtnk, which is updated in the above-described manner, is equal to or greater than the reference value dSPtnk (negative value) for the abrupt-fall determination (NO in S120), it is then determined if the value of the counter CORVR is equal to or smaller than the decision value TS (S150). If CORVR>TS (NO in S150), this routine is temporarily terminated here and a sequence of processes starting with S110 will be repeated in the next cycle. This situation is a state, for example, before time t0 or after time t2 in FIG. 4A and purging is not yet restricted.

Let us now consider a case where it is determined in step S120 that ΔPtnk<dSPtnk (YES in S120). This case is shown by the state of time t0 in the example of FIG. 4A. At times other than refueling, this situation happens, as mentioned earlier, when the differential pressure regulating valve 5 is opened as a large differential pressure between the pressure in the pressure passage 34 and the pressure in the fuel tank 1 is produced by a large or sharp disturbance in the fuel surface caused by various factors such as vibration of the fuel tank 1 and acceleration or deceleration.

Then, it is determined if the intake-air amount GA (the amount of intake air per second), which is detected by the air flow meter 9*c* and cyclically stored and updated in the memory, is smaller than a reference intake-air amount SGA (positive value) (S130).

If GA≧SGA because the intake-air amount SGA is sufficient (NO in S130), the air-fuel ratio control is not influenced even by purging of rich fuel vapor, and the flow jumps to step S150. Therefore, the same process that is performed when the decision in step S120 is NO is carried out.

If GA<SGA (YES in S130), on the other hand, the counter CORVR is cleared to zero (S140). Since the counter CORVR is cleared to zero, CORVR≦TS (YES in S150), and a purge-rate restriction value SPGR is set to the purge rate PGR (S160). That is, the purge rate PGR that has already been acquired in accordance with the running condition of the engine is set to the purge-rate restriction value SPGR.

The purge rate PGR represents the ratio of the purged gas in the intake air. The purge-rate restriction value SPGR is set so that the air-fuel ratio control is unaffected when the intake-air amount is equal to or smaller than the reference intake-air amount SGA, even when the concentration of fuel vapor in the gas to be purged is high. For example, a value of around 0.5% is set for the purge-rate restriction value SPGR. The routine is then temporarily terminated.

Figure 5:
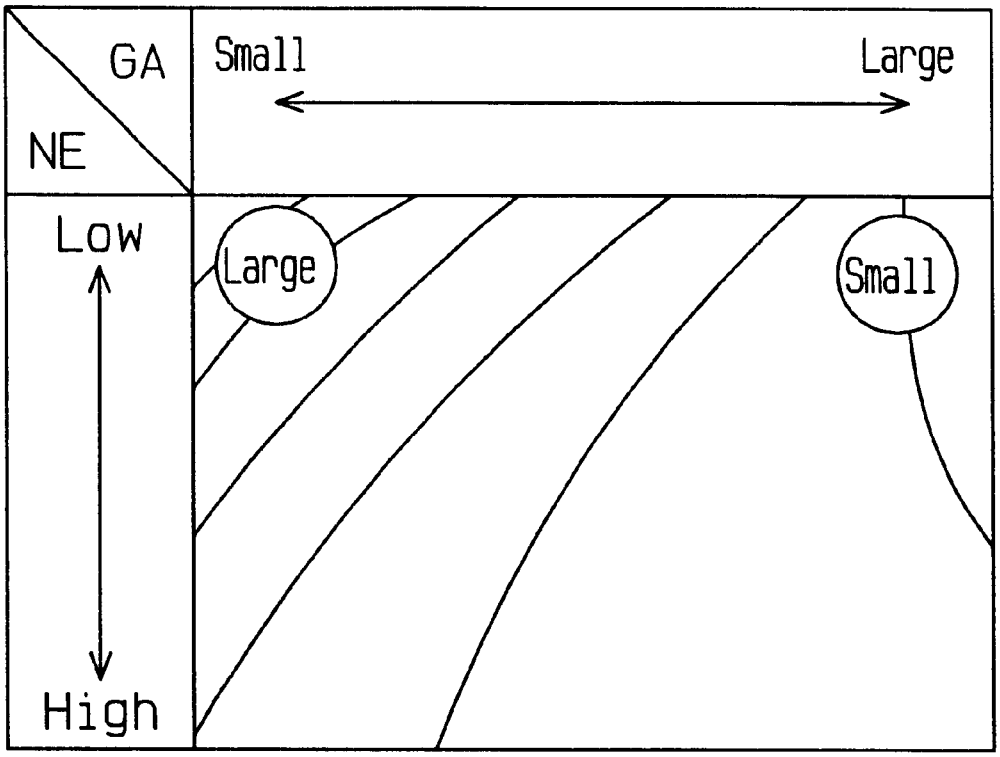
FIG. 5 is an explanatory diagram of a map structure for acquiring a purge rate PGR100 at the time a purge control valve is fully open according to the first embodiment.

Thereafter, a routine for actuating the purge control valve 11 is performed to set the angle of the purge control valve 11. In the routine of actuating the purge control valve 11, a duty coefficient (Duty) for the purge control valve 11 is computed based on the purge rate PGR as given by the following equation 3. The duty coefficient is sent as a control signal to the drive circuit 11*a* for the purge control valve 11. This allows the purge control valve 11 to be opened to an angle corresponding to the duty coefficient (Duty), so that purging with the purge rate PGR is implemented.

$$\text{Duty} \leftarrow k1 \cdot \text{PGR}/\text{PGR}100 + k2 \quad (3)$$

where PGR100 is the purge rate when the purge control valve 11 is fully open and has previously been set as a result of the actual measurement as a map of the engine speed NE and the engine load (the intake-air amount GA in this example), which represent the running condition of the engine. One example in which a change in the fully-open purge rate PGR100 by contour lines is shown in FIG. 5. In this example, the smaller the intake-air amount GA is, the greater the fully-open purge rate PGR100 becomes. Further, the lower the engine speed NE is, the greater the fully-open purge rate PGR100 becomes. However, for a significantly large intake-air amount GA, the fully-open purge rate PGR100 tends to decrease as the engine speed NE decreases. In equation 3, k1 and k2 are compensation coefficients that are determined in accordance with the battery voltage or the atmospheric pressure for actuating the purge control valve 11.

After execution of step S160 (after timing t0), the purge rate PGR falls to the purge-rate restriction value SPGR as shown in the timing chart in FIG. 4B.

In the next control cycle of the purge restricting routine, the counter CORVR starts incrementing its value from zero (S110). As long as steps S120 and S130 are both satisfied, the counter CORVR is repeatedly cleared to zero (S140) so that the decision in step S150 is YES. Accordingly, the process (S160) for restricting the purge rate PGR to the purge-rate restriction value SPGR continues (time t0–t1).

Let us now consider a case where, after the temporary opening of the differential pressure regulating valve 5 is completed, and the valve 5 is closed, the fuel-tank internal pressure value Ptnk returns to a value around the grading value MPtnk so that ΔPtnk≧dSPtnk (NO in S120) or the intake-air amount GA increases so that GA≧SGA (NO in S130). For example, FIG. 4A shows ΔPtnk has become equal to or greater than dsPtnk at time t1.

In this case, even if the value of the counter CORVR is incremented in step S110, the counter CORVR is not cleared to zero and it is determined whether CORVR≦TS (S150). In the initial stage where the decision in step S120 or step S130 has been NO, the value of the counter CORVR is small and CORVR≦TS (YES in S150) is satisfied so that restriction of the purge rate PGR (S160) is maintained.

When ΔPtnk≧dSPtnk (NO in S120) or GA≧SGA (NO in S130) and the value of the counter CORVR increases to CORVR>TS (NO in S150), step S160 will no longer be executed. That is, after purge restriction time (time t1–t2), which is the time from the point when the value of the counter CORVR is zero to the point when it exceeds TS, the purge restricting routine is terminated at time t2.

After this point (after time t2), therefore, the purge rate PGR that is acquired in accordance with the running condition of the engine is directly used in the aforementioned equation 3 and purge restriction is discontinued.

When the decision in step S120 or step S130 is YES again while CORVR≦TS, the counter CORVR is set back to zero (S160) so that restriction of the purge rate PGR (S160) continues until the counter CORVR increments its value from zero to exceed the decision value TS.

In the above-described structure of the first embodiment, steps S120, S210, S220 and S230 are equivalent to the determination means for determining the open state of the breather passage, and steps S110, S130, S140, S150 and S160 are equivalent to the suppression means for suppressing a variation in air-fuel ratio.

The above-described first embodiment has the following advantages.

Figure 3:
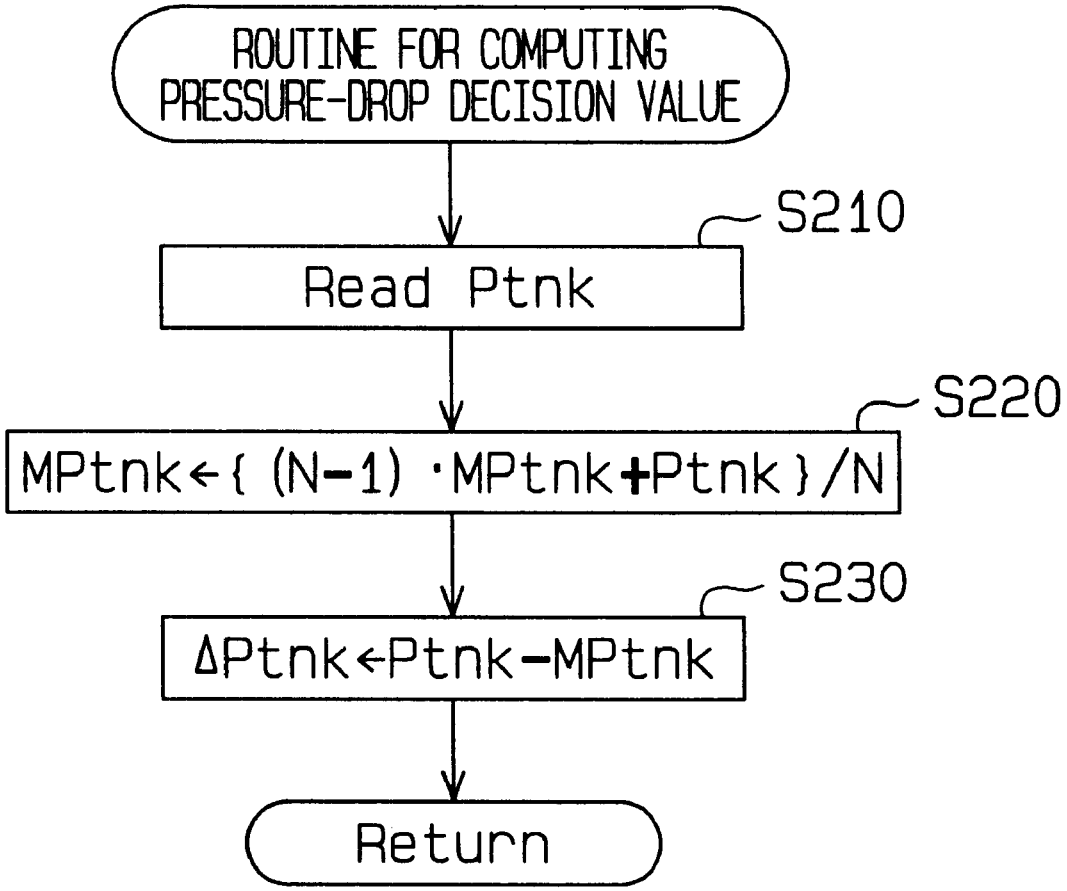
FIG. 3 is a flowchart of a routine for computing a pressure-drop decision value which is executed by the ECU in the first embodiment.

(1) When it is determined that the differential pressure regulating valve has been opened through the routine for computing the pressure-drop decision value in FIG. 3 and the decision process in step S120 in FIG. 2, the angle of the purge control valve 11 is adjusted to restrict the purging of fuel to the air-intake passage 9. Even if rich fuel vapor flows to the canister 2 from the breather passage 7, therefore, this rich fuel vapor is restricted from being directly purged to the air-intake passage 9.

While such purge restriction is taking place, the adsorbents 19*a* and 19*b* of the canister 2 adsorb the rich fuel vapor fed from the breather passage 7. The purge restriction therefore need only be temporary and can be discontinued when the differential pressure regulating valve 5 is closed thereafter. This prevents fuel saturation in the canister 2.

As apparent from the above, unlike the prior art, this embodiment does not require the second pressure sensitive valve and does not permit rich fuel vapor to be supplied to the air-intake passage 9 at any time other than refueling. Therefore, the breather passage 7 is not complex, the weight of the engine is limited, and variation in the air-fuel ratio is reduced.

(2) Besides the condition in step S120, the condition that the amount of intake air, GA, to the engine is less than the reference intake-air amount SGA is also added as one purge restricting condition. When both conditions are met, the purge control valve 11 is restricted to temporarily restrict fuel purging to the air-intake passage 9.

When the intake-air amount GA is large, rich fuel vapor, even if purged, influences the air-fuel ratio less than that in the case of a small intake-air amount. According to this embodiment, therefore, it is determined whether the intake-air amount GA to the engine is small by its comparison with the reference intake-air amount SGA, and no purge restriction is performed when there is a large amount of intake air. In a situation where fuel vapor to be purged is rich but does not adversely affect the air-fuel ratio control, therefore, purge restriction is not implemented to increase the chances of carrying out purging. This further contributes to the inhibition of fuel saturation in the canister 2.

(3) In the first embodiment, the open state of the differential pressure regulating valve 5 is determined based on the pressure in the fuel tank 1. This is because the differential pressure regulating valve 5 and the pressure in the fuel tank 1 has a certain correlation such that the valve 5 is activated due to a change in pressure in the fuel tank 1 or the pressure in the fuel tank 1 changes as the valve 5 is opened.

Accordingly, the open state of the differential pressure regulating valve 5 can be determined based on the pressure in the fuel tank 1. This eliminates the need for providing a special sensor in the differential pressure regulating valve 5 and makes it sufficient to provide only the pressure sensor 1*a* in the fuel tank 1 for the purpose of determining the open state of this valve 5.

More specifically, it is determined that the differential pressure regulating valve 5 has opened when a greater drop than the reference value dSPtnk for the abrupt-fall determination occurs in the pressure in the fuel tank 1. When, at times other than refueling, the differential pressure regulating valve 5 opens so that rich fuel vapor in the breather passage 7 is discharged toward the canister 2 by the pressure in the fuel tank 1 or the negative pressure in the air-intake passage 9, the pressure in the fuel tank 1 drops rapidly. When the pressure in the fuel tank drops more abruptly than the rate specified by the reference value dSPtnk for abrupt-fall determination, therefore, it is possible to determine that the differential pressure regulating valve 5 has opened at times other than refueling. In this manner, the open state of the differential pressure regulating valve 5 at times other than refueling can easily be determined based on the pressure in the fuel tank 1.

There may be a case where a diagnosis system for the seal effectiveness of the fuel tank 1, failure in the evaporation fuel purging system, or the like is provided so that there already is a pressure sensor (1*a*) to be used in such a system. In this case, a special sensor or the like need not be newly provided and the open state of the differential pressure regulating valve 5 can be determined based on the detection value from this pressure sensor.

(4) When the purge restricting conditions (S120, S130) are not satisfied, it does not necessarily mean that the differential pressure regulating valve 5 is immediately closed depending on the situation. If original purge rate control is resumed immediately after the purge restricting conditions fail to be met, rich fuel vapor may be purged, resulting in a change in the air-fuel ratio. In this respect, purge restriction is maintained (S150, S160) for the delay time (t1–t2) even after the purge restricting conditions fail to be met. This allows a time deviation between the purge restricting conditions and the actual open state of the differential pressure regulating valve 5 to be corrected, thereby preventing rich fuel vapor from being purged. Rich fuel vapor is not supplied to the air-intake passage 9 at times other than the time of refueling without providing the second pressure sensitive valve. Therefore, the breather passage 7 does not have a complex structure, which would increase the weight of the engine, and variation in the air-fuel ratio of the engine is limited.

When the purge restricting conditions (S120, S130) are met, hunting may occur in the purge restricting control. Because the delay time is provided to continue purge restriction for a while after restriction-free purge rate control resumes, as discussed above, hunting in the control is prevented to protect the drive mechanism for the purge control valve 11.

This delay time provides the canister 2 with more time to adsorb fuel and thus further reduces the influence on the air-fuel ratio control.

(5) In the purge restricting routine, the purge rate PGR is set to the purge-rate restriction value SPGR without fully closing the purge control valve 11. Since purging is not stopped completely, fuel is slightly purged even during purge restriction. If purge restriction is extended, therefore, fuel saturation in the canister 2 can be prevented.

It is also possible to suppress a significant change in fuel concentration or the ratio of fuel to air that occurs depending on whether or not there is purge restriction when the purge restricting routine is executed and when the purge restricting routine is stopped. This allows the air-fuel ratio feedback control to adequately cope with a change in air-fuel ratio even when purge restriction is initiated and when purge restriction is stopped, thereby further reducing air-fuel ratio variation.

Second Embodiment

Figure 6:
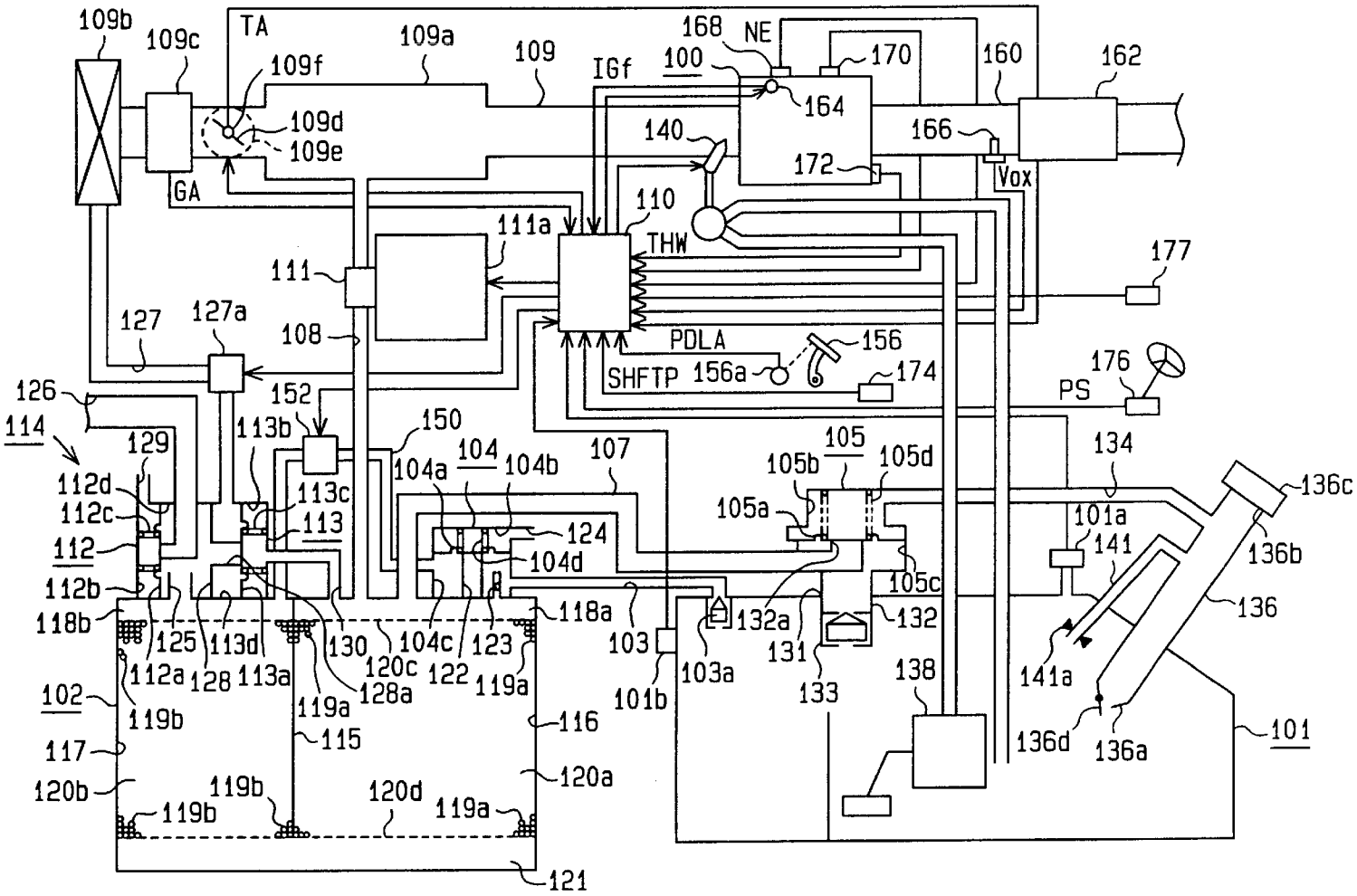
FIG. 6 is a schematic explanatory diagram illustrating the entire system of an air-fuel ratio variation suppressing apparatus according to a second embodiment.

FIG. 6 is a schematic explanatory diagram illustrating the entire system of an air-fuel ratio variation suppressing apparatus according to a second embodiment. Unlike the first embodiment, the second embodiment allows the air-fuel ratio feedback control to adequately cope with a change in air-fuel ratio that is caused by opening a differential pressure regulating valve 105 at times other than refueling. This diagram therefore gives a detailed illustration of the structure that is associated with the air-fuel ratio feedback control. The other structure is basically the same as that of the first embodiment. Components in the second embodiment that have the same functions as those of the first embodiment are given reference symbols obtained by adding one hundred to the corresponding numerals of the first embodiment, unless otherwise specifically mentioned.

A float 103*a* is provided at the junction of a fuel tank 101 and a vapor passage 103 for leading evaporation fuel to a canister 102 from the fuel tank 101. Further, a bypass passage 150 is formed extending from a positive pressure chamber 104*c* in a first control valve 104 to a sub chamber 117 of the canister 102. The bypass passage 150 therefore communicates with the fuel tank 101 and the canister 102 via the positive pressure chamber 104*c* in the first control valve 104 and the vapor passage 103. A bypass valve 152 is located in this bypass passage 150. The bypass valve 152, which is normally closed, is controlled by ECU 110 at the time of failure diagnosis or the like to adjust the opening/closing state of the bypass passage 150. For example, a VSV or the like is used as the bypass valve 152. An atmosphere-intake passage 127, which leads the air to the canister 102 via an air cleaner 109*b*, has a pressure blocking valve 127*a*. The opening/closing state of this pressure blocking valve 127*a*, which is normally closed, is adjusted under the control of the ECU 110 at the time of failure diagnosis or the like. A VSV or the like, for example, is used as the pressure blocking valve 127*a*. The fuel tank 101 is provided with a fuel meter 101*b* for detecting the amount of residual fuel. An orifice 141*a* is formed at the distal end of a circulation line pipe 141 and a check valve 136d for preventing counter flow of the fuel from the fuel tank 101 is provided at the distal end of a fuel feeding pipe 136.

An engine 100 will now be discussed. The engine 100 is a gasoline type internal combustion engine having multiple cylinders, for example, 4 cylinders. Outside air is fed to each cylinder through an air-intake passage 109 via the air cleaner 109*b*, a surge tank 109*a* and the like.

Fuel injection valves 140 corresponding in number to the individual cylinders (not shown) are provided at the intake manifold portion in the air-intake passage 109. Each fuel injection valve 140 is an electromagnetic valve which is opened or closed under energization control by the ECU 110 to eject fuel. The fuel in the fuel tank 101 is supplied under pressure to each fuel injection valve 140 from a fuel pump 138. The fuel injected from the fuel injection valve 140 is blended with the intake air in the air-intake passage 109 to yield an air-fuel mixture. This air-fuel mixture is supplied to the combustion chamber in each cylinder from an intake port (not shown), which is opened by a corresponding intake valve (not shown) provided for each cylinder. In air-fuel ratio feedback control, the length of the time for fuel injection by the fuel injection valve 140 is adjusted based on an air-fuel ratio feedback compensation coefficient FAF as will be discussed later.

A throttle valve 109*d* located in the air-intake passage 109 is opened or closed by a throttle motor 109*e* provided in the air-intake passage 109, so that its angle, or a throttle angle TA, is adjusted. The throttle valve 109*d* is provided with a throttle sensor 109*f*, which detects the throttle angle TA and outputs a signal corresponding to the throttle angle TA.

An acceleration pedal 156 is provided in a driving compartment of a vehicle and the thrust amount of the acceleration pedal 156 or an acceleration angle PDLA is detected by an acceleration sensor 156*a*. Based on this acceleration angle PDLA and other data, the ECU 110 controls the throttle motor 109*e* to adjust the throttle angle TA to a level accordingly.

An exhaust passage 160 is connected via an exhaust manifold portion to each cylinder. This exhaust passage 160 is provided with a catalyst converter 162 and a muffler (not shown) located downstream of the catalyst converter 162. The exhaust gas that flows through the exhaust passage 160 is discharged outside through the catalyst converter 162 and a muffler.

An air flow meter 109*c*, provided in the air-intake passage 109 between the air cleaner 109*b* and the throttle valve 109*d*, detects the amount of intake air, GA, fed into the combustion chamber of each cylinder and outputs a signal corresponding to this intake-air amount GA.

The cylinder heads of the engine 100 are respectively provided with ignition plugs (not shown) associated with the individual cylinders. Provided with an igniter 164, each ignition plug is constructed as a direct ignition system, which does not use a distributor. Each igniter 164 applies a high voltage, which is generated, as the primary-side current supplied from an ignition drive circuit in the ECU 110 at the ignition timing is shut off, directly to the associated ignition plug.

An air-fuel ratio sensor 166 is located in the exhaust passage 160 upstream of the catalyst converter 162. This air-fuel ratio sensor 166 detects the air-fuel ratio of the air-fuel mixture in the exhaust component and outputs a signal Vox corresponding to this air-fuel ratio. The air-fuel ratio feedback control is carried out based on this signal Vox as will be discussed later. In the air-fuel ratio feedback control, the amount of fuel injection from each fuel injection valve 140 is controlled to adjust the air-fuel ratio to a target air-fuel ratio (theoretical air-fuel ratio in this example).

The engine 100 is further provided with an engine speed sensor 168 and a timing sensor 170. The engine speed sensor 168 outputs a pulse signal, the number of pulses of which corresponds to the engine speed NE of the engine 100 based on the rotation of the crankshaft (not shown). The timing sensor 170 outputs a pulse signal, which serves as a reference signal for each crank angle to determine the timing for each cylinder. The ECU 110 computes the engine speed NE and the crank angle and determines the timing for each cylinder based on the output signals of the engine speed sensor 168 and timing sensor 170.

The cylinder block of the engine 100 is provided with a coolant temperature sensor 172, which detects a coolant temperature THW and sends out a signal corresponding to the coolant temperature THW. An unillustrated transmission system is provided with a shift position sensor 174, which outputs a signal corresponding to a shift position SHFTP.

A power steering system (not shown) is installed in the vehicle. The power steering system is provided with a power steering switch 176, which detects whether there is an auxiliary steering force generated by the power steering system, and outputs a power steering signal PS according to the presence or absence of the auxiliary steering force.

Further provided is a vehicle speed sensor 177 which detects the running speed, Vt, of the vehicle from the rotation of the axle shaft of the vehicle and outputs a signal corresponding to the vehicle speed Vt.

Figure 7:
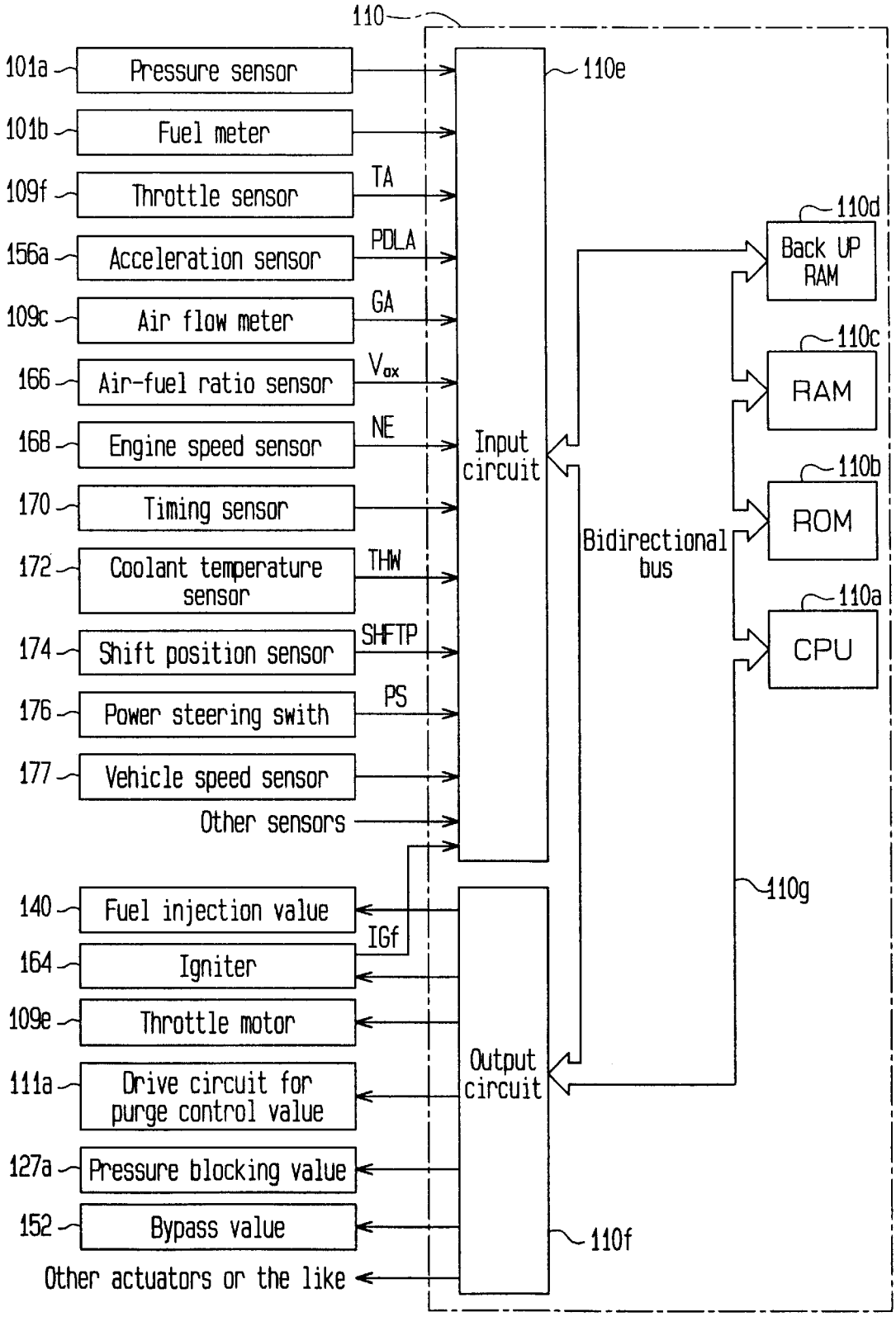
FIG. 7 is a block diagram of a control system in the second embodiment.

FIG. 7 presents a block diagram showing the control system that serves as the air-fuel ratio control apparatus and air-fuel ratio variation suppressing apparatus in the second embodiment.

The ECU 110 is constructed as an arithmetic and logic unit that includes a central processing unit (CPU) 110*a*, a read only memory (ROM) 110*b*, a random access memory (RAM) 110*c* and a backup RAM 110*d*, which are connected to an input circuit 110*e* and an output circuit 110*f* by a bidirectional bus 110*g*. Various control programs and various kinds of data for various control routines, such as the air-fuel ratio feedback control routine, have previously been stored in the ROM 110*b*. The RAM 110*c* temporarily stores the operation results acquired in various control routines by the CPU 110*a*.

The input circuit 110*e* is constructed as an input interface which includes a buffer, a wave shaping circuit, an A/D converter, etc., and is connected to a pressure sensor 101*a* and the fuel meter 101*b* of the fuel tank 101, the throttle sensor 109*f*, the acceleration sensor 156*a*, the air flow meter 109*c*, the air-fuel ratio sensor 166, the engine speed sensor 168, the timing sensor 170, the coolant temperature sensor 172, the shift position sensor 174, the power steering switch 176, the vehicle speed sensor 177 and a line for an ignition check signal IGf from each igniter 164. The output signals of those sensors 101*a*, 101*b*, 109*f*, 156*a*, 109*c*, 166, 168, 170, 172, 174, 176 and 177 are converted to digital signals which are in turn fetched by the CPU 110*a* via the bidirectional bus 110*g*.

The output circuit 110f has various drive circuits to which the fuel injection valves 140, the igniters 164, the throttle motor 109*e*, a drive circuit 11*a* for a purge control valve 111, the pressure blocking valve 127*a* and the bypass valve 152 are respectively connected. Based on the output signals of the various sensors 101*a*, 101*b*, 109*f*, 156*a*, 109*c*, 166, 168, 170, 172, 174, 176 and 177, the ECU 110 performs arithmetic operations and controls the fuel injection valves 140, the igniters 164, the throttle motor 109*e*, the drive circuit 11*a* for the purge control valve 111, the pressure blocking valve 127*a* and the bypass valve 152.

For example, the ECU 110 computes the running state of the engine 100 based on the intake-air amount GA detected by the air flow meter 109*c*, the engine speed NE detected by the engine speed sensor 168 and the like, and controls the amount of fuel injection and the fuel injection timing of each fuel injection valve 140 or the ignition timing by each igniter 164. As will be discussed later, the ECU 110 compensates for the amount of fuel injection from each fuel injection valve 140 to precisely control the air-fuel ratio of the air-fuel mixture based on the air-fuel ratio that is detected by the air-fuel ratio sensor 166.

The control on the purge control valve 111 is executed to control the purge rate. The control on the purge control valve 111, the pressure blocking valve 127*a* and the bypass valve 152 is carried out to perform failure diagnosis or the like for the purge system.

Figure 8:
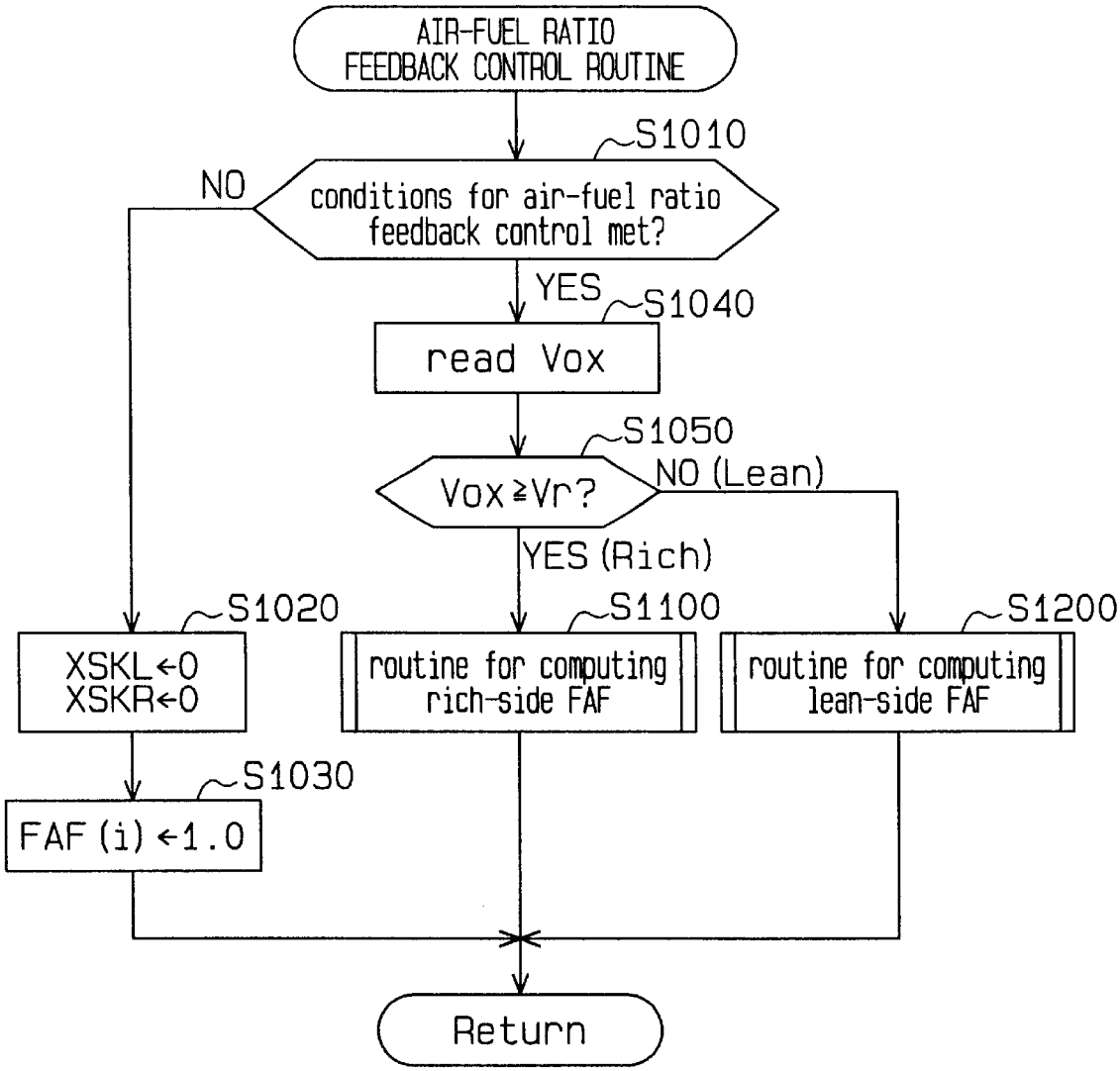
FIG. 8 is a flowchart of an air-fuel ratio feedback control routine in the second embodiment.

Referring to the flowchart in FIG. 8, the following describes the air-fuel ratio feedback control that is executed by the ECU 110 in the second embodiment. This air-fuel ratio feedback control serves also an air-fuel ratio variation suppressing routine and is implemented upon interruption made every given time interval or given crank angle.

When this routine is initiated, the ECU 110 first determines in step 100 if the following conditions for performing the air-fuel ratio feedback control have been met (S1010). The following are those conditions.

(1) Not the start-up time.

(2) Fuel is not being cut.

(3) Warm-up has been completed (e.g., the coolant temperature THW≧40° C.).

(4) The air-fuel ratio sensor 32 is activated.

When every one of the above conditions (1) to (4) is satisfied (YES in S1010), the air-fuel ratio feedback control is enabled, whereas when any one of the conditions is not met (NO in S1010), the air-fuel ratio feedback control is not selected.

When any one of the conditions is not met (NO in S1010), a lean skip flag XSKL for determining if a lean skip to be discussed later should be executed and a rich skip flag XSKR for determining if a rich skip to be discussed later should be executed are both set to zero (S1020). Then, 1.0 is set to the current air-fuel ratio feedback compensation coefficient FAF(i) (S1030), after which the air-fuel ratio feedback control routine is temporarily terminated.

When all the feedback control conditions are satisfied (YES in S1010), the ECU 110 reads the output voltage Vox of the air-fuel ratio sensor 166 (S1040) and determines whether the output voltage Vox is equal to or greater than a predetermined reference voltage Vr (e.g., 0.45 V) (S1050).

When Vox≧Vr (YES in S1050), the air-fuel ratio of the exhaust component is rich so that a rich routine for computing the air-fuel ratio feedback compensation coefficient FAF is carried out (S1100). When Vox<Vr (NO in S1050), the air-fuel ratio of the exhaust component is lean so that a lean routine for computing the air-fuel ratio feedback compensation coefficient FAF is executed (S1200).

Figure 9:
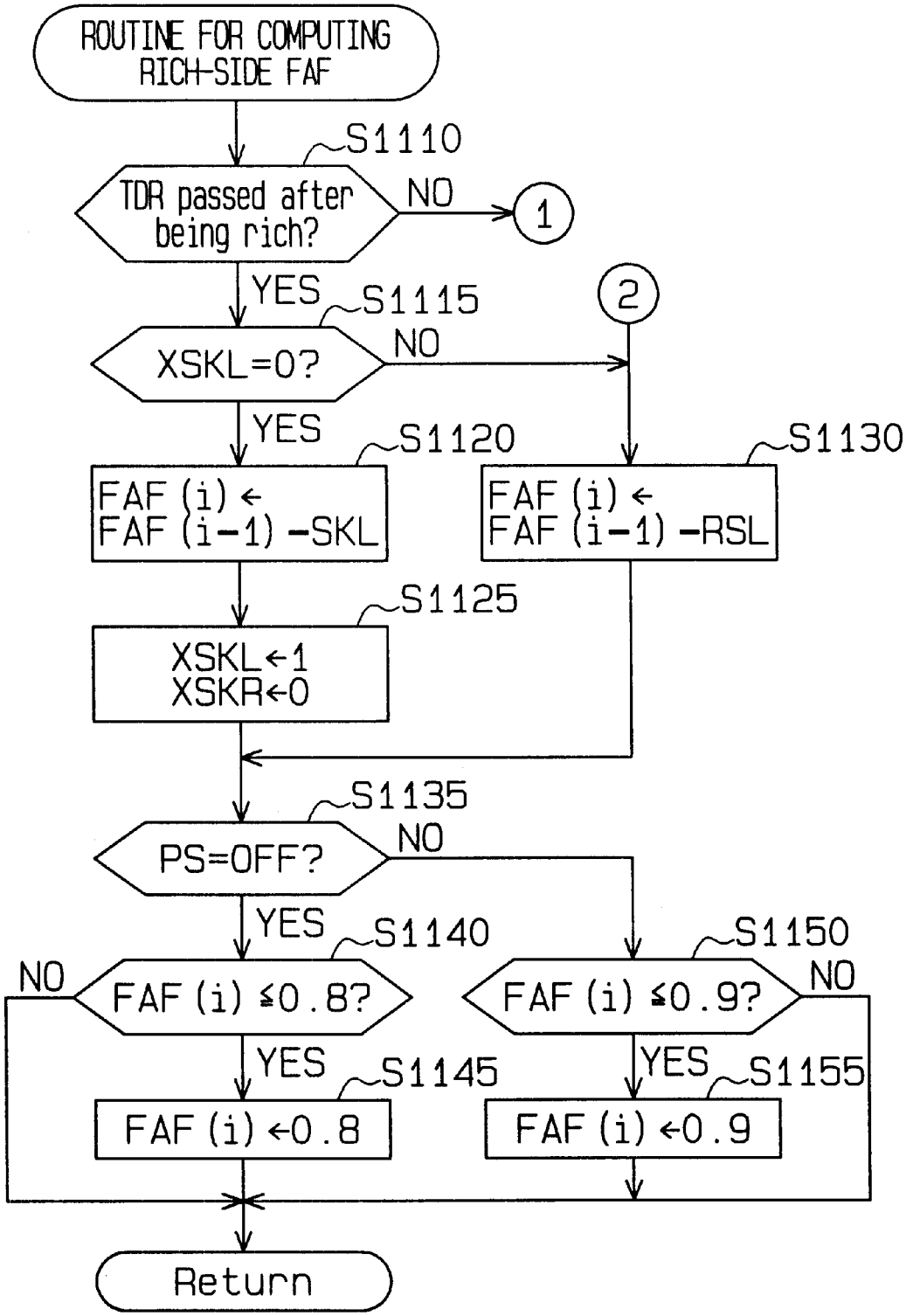
FIG. 9 is a flowchart of a routine for computing a rich-side air-fuel ratio feedback compensation coefficient FAF in the second embodiment.

When the computation of the air-fuel ratio feedback compensation coefficient FAF in step S1100 or step S1200 is completed, the air-fuel ratio feedback control routine is temporarily terminated. The flowchart in FIG. 9 illustrates the routine for computing the rich air-fuel ratio feedback compensation coefficient FAF in the second embodiment (S1100). First, it is determined if a rich-determining delay time TDR has elapsed since the transition of the air-fuel ratio, which is detected by the air-fuel ratio sensor 166, to richness from leanness (S1110). When the rich-determining delay time TDR has not passed (NO in S1110), it is insufficient to compute the rich air-fuel ratio feedback compensation coefficient FAF so that the flow goes to the routine for computing the lean air-fuel ratio feedback compensation coefficient FAF to be discussed later (step S1230).

When the rich-determining delay time TDR has passed (YES in S1110), it is sufficient to compute the rich air-fuel ratio feedback compensation coefficient FAF and it is then determined if the lean skip flag XSKL is zero (S1115).

When XSKL=0 (YES in S1115), the current air-fuel ratio feedback compensation coefficient FAF(i) is acquired by subtracting a lean skip amount SKL from the previous air-fuel ratio feedback compensation coefficient FAF(i−1) as given by the following equation 4 (S1120). That is, lean skip for lowering the fuel concentration step by step is executed.

$$FAF(i) \leftarrow FAF(i-1) - SKL \quad (4)$$

Then, the lean skip flag XSKL is set to one and the rich skip flag XSKR is set to zero (S1125).

When XSKL=1 (NO in S1115), on the other hand, the current air-fuel ratio feedback compensation coefficient FAF (i) is acquired by subtracting a lean integration value RSL from the previous air-fuel ratio feedback compensation coefficient FAF(i−1) as given by the following equation 5 (S1130). That is, integration computing for gradually lowering the fuel concentration is performed.

$$FAF(i) \leftarrow FAF(i-1) - RSL \quad (5)$$

After the process in step S1125 or step S1130, it is determined if the signal PS from the power steering switch 176 is OFF (S1135). When PS=OFF or when there is no auxiliary steering force generated by the power steering system (YES in S1135), it is determined if the currently computed air-fuel ratio feedback compensation coefficient FAF(i) is equal to or smaller than 0.8 (S1140). That is, 0.8 indicates the lower limit which is normally used for the air-fuel ratio feedback compensation coefficient FAF(i). When FAF(i)≦0.8 (YES in S1140), 0.8 is set to FAF(i) (S1145) after which the ECU 110 leaves this routine. When FAF(i)>0.8 (NO in S1140), the ECU 110 leaves this routine with FAF(i) unchanged.

When PS=ON or when there is the auxiliary steering force generated by the power steering system (NO in S1135), it is determined if the currently computed air-fuel ratio feedback compensation coefficient FAF(i) is equal to or smaller than 0.9 (S1150). That is, 0.9 indicates the lower limit which is normally used for the air-fuel ratio feedback compensation coefficient FAF(i) at the time the auxiliary steering force is generated. As this value is greater than the lower limit 0.8 for the case where no auxiliary steering force is generated, a decrease in the air-fuel ratio feedback compensation coefficient FAF(i) is restricted when the auxiliary steering force is generated as compared with the case where this force is not generated.

When FAF(i)≦0.9 (YES in S1150), therefore, 0.9 is set to FAF(i) (S1155) after which the ECU 110 leaves this routine. When FAF(i)>0.9 (NO in S1150), the ECU 110 leaves this routine with FAF(i) unchanged.

Figure 10:
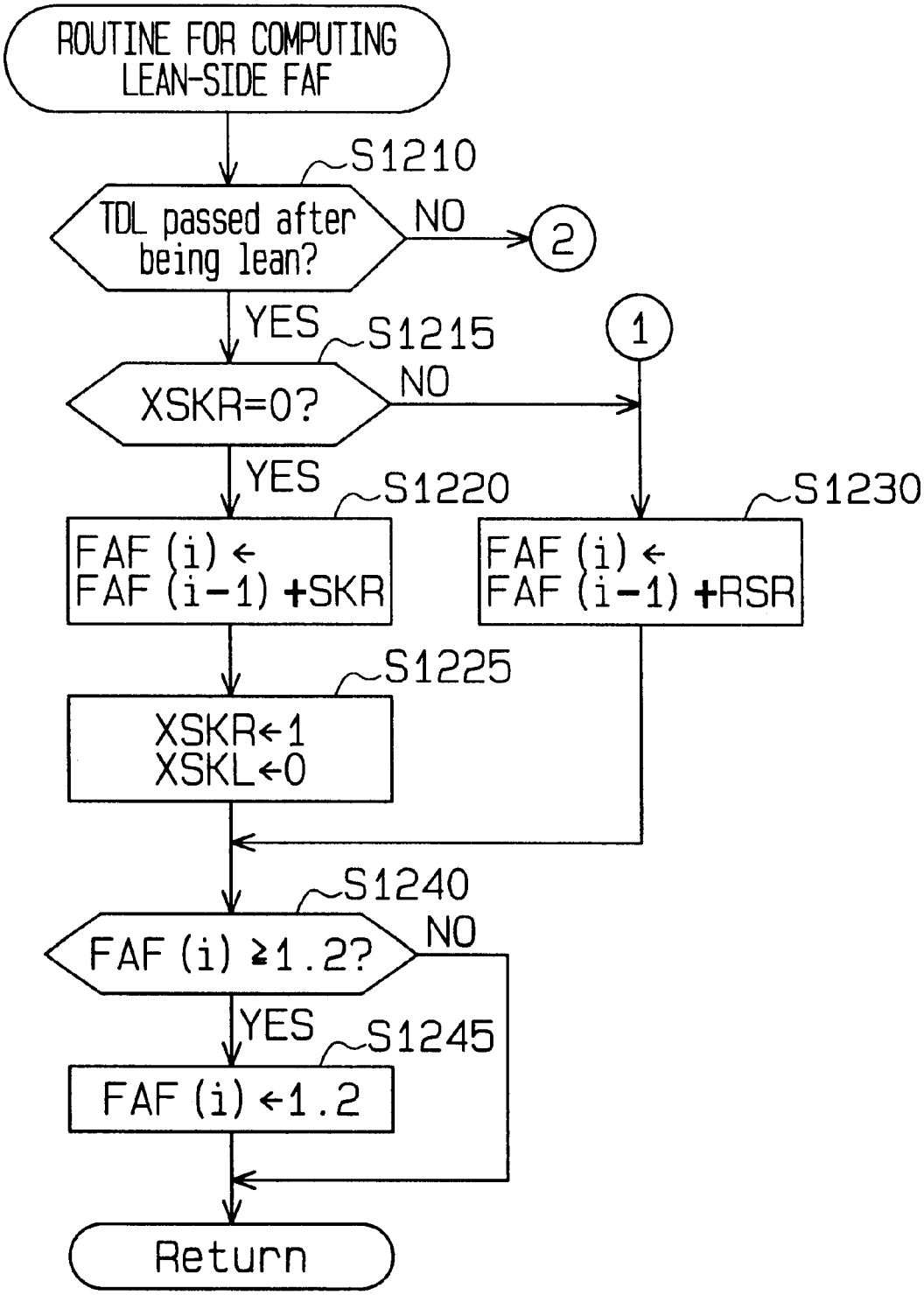
FIG. 10 is a flowchart of a routine for computing a lean-side air-fuel ratio feedback compensation coefficient FAF in the second embodiment.

The flowchart in FIG. 10 illustrates the routine for computing the lean-side air-fuel ratio feedback compensation coefficient FAF in the second embodiment (S1200). First, it is determined if a lean-determining delay time TDL has elapsed since the transition of the air-fuel ratio, which is detected by the air-fuel ratio sensor 166, to leanness from the richness (S1210). When the lean-determining delay time TDL has not passed (NO in S1210), it is insufficient to compute the lean-side air-fuel ratio feedback compensation coefficient FAF so that the flow returns to the above-described routine for computing the rich air-fuel ratio feedback compensation coefficient FAF discussed above (step S1130).

When the lean-determining delay time TDL has passed (YES in S1210), it is sufficient to compute the lean air-fuel ratio feedback compensation coefficient FAF and it is then determined if the rich skip flag XSKR is zero (S1215).

When XSKR=zero (YES in S1215), the current air-fuel ratio feedback compensation coefficient FAF(i) is acquired by adding a rich skip amount SKR to the previous air-fuel ratio feedback compensation coefficient FAF(i−1) as given by the following equation 6 (S1220). That is, lean skip for increasing the fuel concentration step by step is executed.

$$FAF(i) \leftarrow FAF(i-1)+SKR \tag{6}$$

Then, the rich skip flag XSKR is set to one and the lean skip flag XSKL is set to zero (S1225).

When XSKR=1 (NO in S1215), on the other hand, the current air-fuel ratio feedback compensation coefficient FAF (i) is acquired by adding a rich integration value RSR to the previous air-fuel ratio feedback compensation coefficient FAF(i−1) as given by the following equation 7 (S1230). That is, integration computing for gradually increasing the fuel concentration is performed.

$$FAF(i) \leftarrow FAF(i-1)+RSR \tag{7}$$

After the process in step S1225 or step S1230, it is determined if the currently computed air-fuel ratio feedback compensation coefficient FAF(i) is equal to or greater than 1.2 (S1240). That is, 1.2 indicates the upper limit which is normally used for the air-fuel ratio feedback compensation coefficient FAF(i). When FAF(i)≧1.2 (YES in S1240), 1.2 is set to FAF(i) (S1245) after which the ECU 110 leaves this routine. When FAF(i)<1.2 (NO in S1240), the ECU 110 leaves this routine with FAF(i) unchanged.

As apparent from the above, the upper limit is not changed on the lean side depending on the content of the signal PS from the power steering switch 176.

Figure 11:
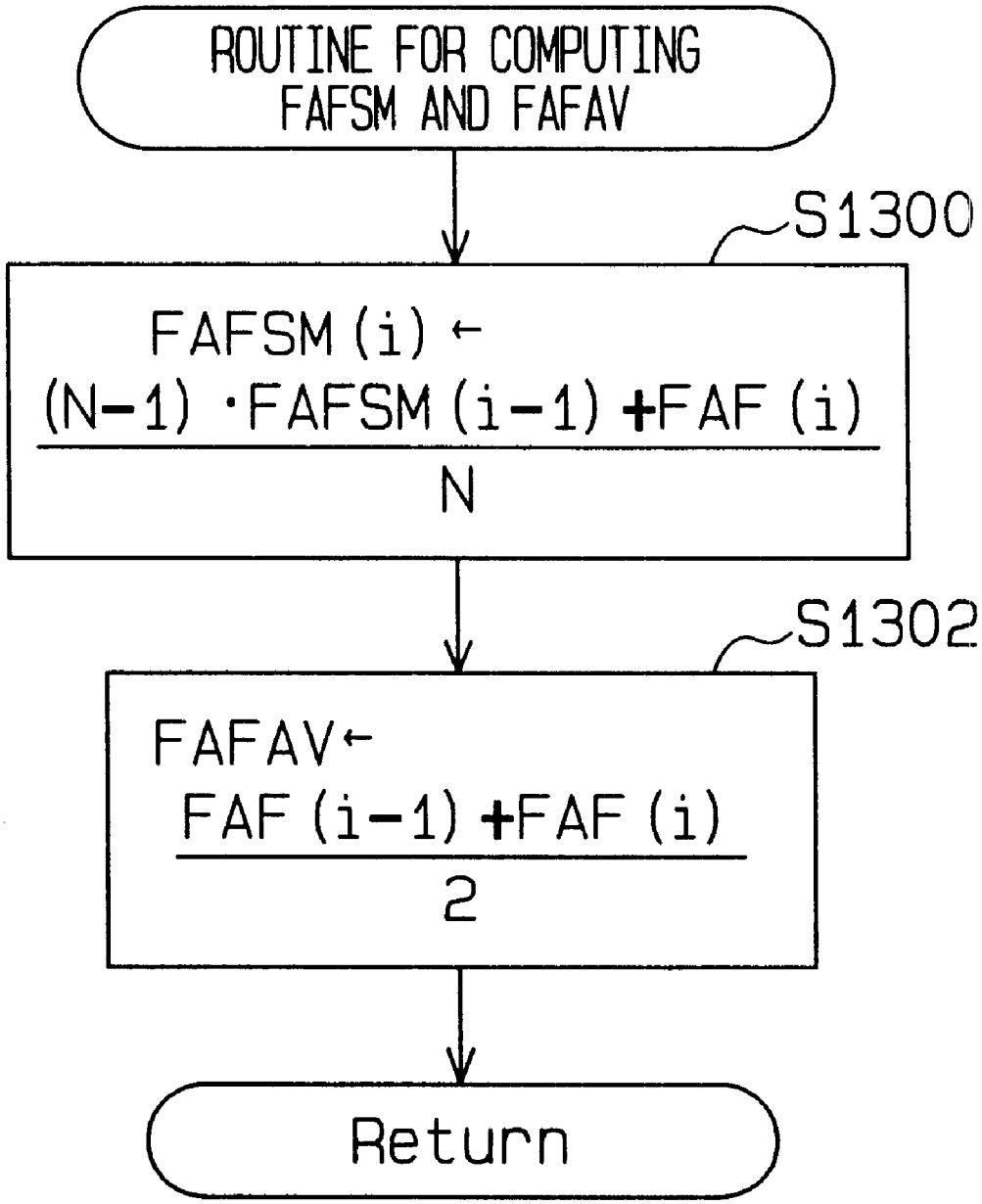
FIG. 11 is a flowchart of a routine for computing a grading value FAFSM and an average value FAFAV in the second embodiment.

FIG. 11 is a flowchart illustrating a routine for computing a grading value FAFSM or weighted average value of the air-fuel ratio feedback coefficient FAF and an average value FAFAV of the air-fuel ratio feedback coefficient FAF. This routine is carried out following the air-fuel-ratio feedback control routine in FIG. 8.

In this routine, first, the current grading value FAFSM(i) is computed from the previous grading value FAFSM(i−1) and the current air-fuel ratio feedback compensation coefficient FAF(i) using an equation 8 given below (S1300).

$$FAFSM(i) \leftarrow \{(N-1)\cdot FAFSM(i-1)+FAF(i)\}/N \tag{8}$$

In other words, the weighted average value acquired from the previous grading value FAFSM(i−1) given a weight of N−1 and the currently computed air-fuel ratio feedback compensation coefficient FAF(i) given a weight of one is set to the current grading value FAFSM(i). In this computation, N is set to a relatively large integer like one hundred to make the degree of grading larger, thereby yielding a long-period average value.

Next, the average value FAFAV of the previous air-fuel ratio feedback compensation coefficient FAF(i−1) and the current air-fuel ratio feedback compensation coefficient FAF (i) is calculated by the following equation 9.

$$FAFAV \leftarrow \{FAF(i-1)+FAF(i)\}/2 \tag{9}$$

Then, the ECU 110 temporarily terminates the routine for computing the grading value FAFSM and the average value FAFAV.

Figure 12:
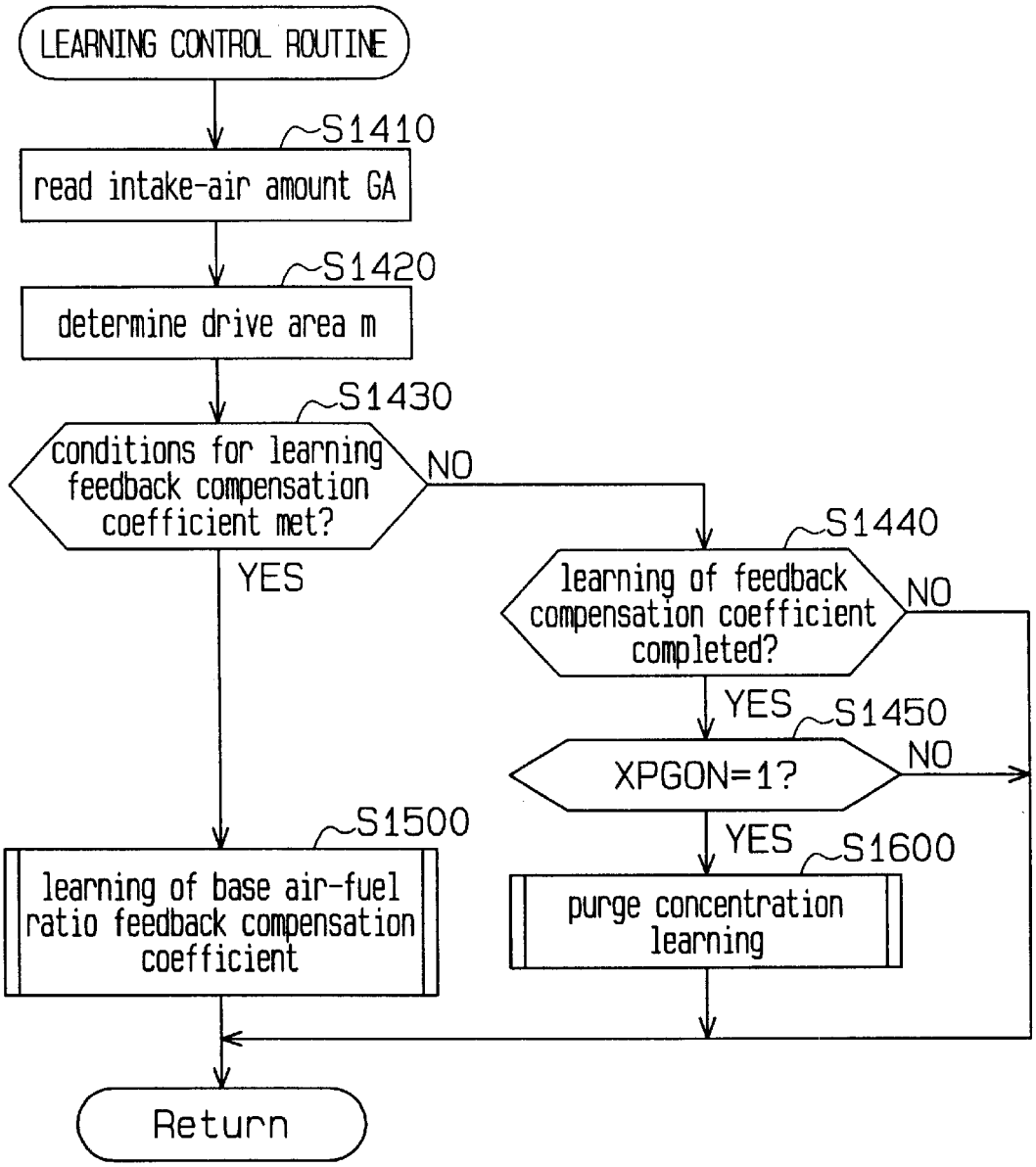
FIG. 12 is a flowchart of a learning control routine in the second embodiment.

FIG. 12 is a flowchart illustrating a learning control routine for controlling switching between purge-concentration learning and base-air-fuel-ratio-feedback-compensation-coefficient learning. This routine is executed upon interruption made every given time interval or every given crank angle.

When this routine is initiated, first, the ECU 110 reads the intake-air amount GA detected by the air flow meter 109*c* (S1410) and determines an index m which indicates the drive area of the engine 100 based on the value of this intake-air amount GA (S1420). Specifically, the index m is determined by dividing the amount of intake air into M parts within a range from the maximum intake-air amount of 0% to 100% to set the drive area of the engine 100, and then determining to which drive area the current intake-air amount GA corresponds. A base air-fuel ratio feedback compensation coefficient KG is acquired through learning for each drive area of the engine 100, and the index m is for determining to which drive area the base air-fuel ratio feedback compensation coefficient KG belongs.

Next, it is determined if the conditions for learning the base air-fuel ratio feedback compensation coefficient are satisfied (S1430). The conditions may include those described with reference to step S1010, but may additionally include a condition for stable air-fuel ratio feedback control which is determined depending on whether or not a sufficient time has passed since the last change of the drive area of the engine 100.

If the conditions for learning the base air-fuel ratio feedback compensation coefficient are met (YES in S1430), computation of the base air-fuel ratio feedback compensation coefficient KG through learning, which will be discussed later, is performed for the current drive area m of the engine 100 (S1500). If the learning conditions are not satisfied (NO in S1430), it is determined if learning of the base air-fuel ratio feedback compensation coefficient KG(m) for the current drive area m has been completed (S1440). If learning of KG(m) has not been finished yet (NO in S1440), the learning control routine is temporarily terminated here.

If learning of KG(m) has been completed (YES in S1440), it is determined if a purge execution flag XPGON whose setting will be discussed later is set to one (S1450). When XPGON=0 (NO in S1450), the learning control routine is temporarily terminated here. When XPGON=1 (YES in S1450), learning of the purge concentration to be discussed later is performed (S1600).

Figure 13:
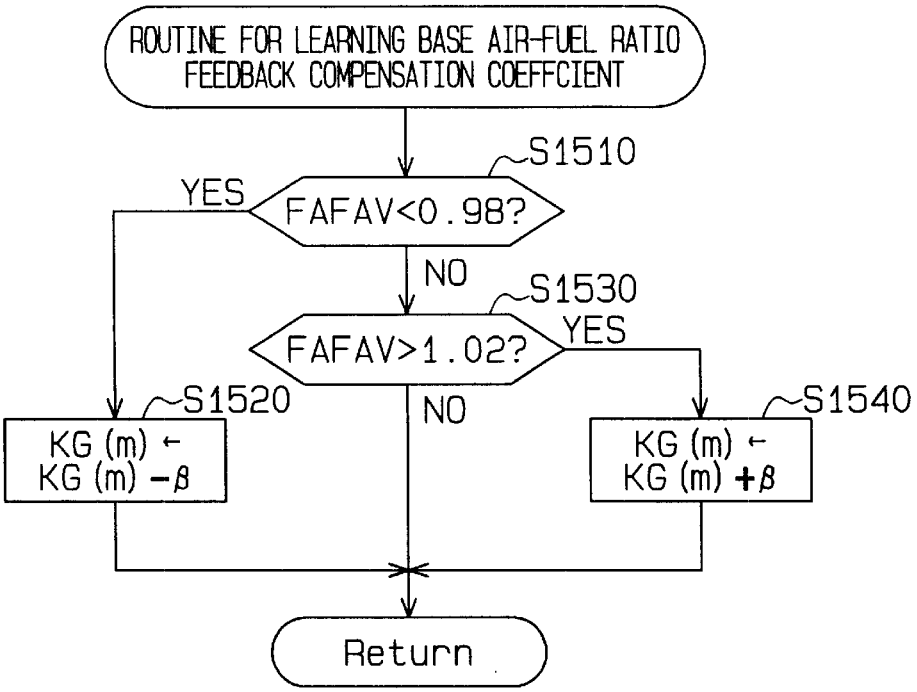
FIG. 13 is a flowchart of a routine for learning a base air-fuel ratio feedback compensation coefficient in the second embodiment.

FIG. 13 presents a flowchart of a routine for learning the base air-fuel ratio feedback compensation coefficient (S1500). In this routine, first, it is determined if the aforementioned average value FAFAV of the air-fuel ratio feedback compensation coefficient FAF is smaller than 0.98 (S1510). When FAFAV<0.98 (YES in S1510), the base air-fuel ratio feedback compensation coefficient KG(m) of the drive area m is decremented by an amount of change β (S1520) after which this routine is temporarily terminated.

When FAFAV≧0.98 (NO in S1510), it is determined if the average value FAFAV is greater than 1.02 (S1530). When FAFAV>1.02 (YES in S1530), the base air-fuel ratio feedback compensation coefficient KG(m) is incremented by the amount of change β (S1520) after which this routine is temporarily terminated.

When 0.98≦FAFAV≦1.02 (NO in S1510 and NO in S1530), this routine is temporarily terminated without changing the base air-fuel ratio feedback compensation coefficient KG(m) of the drive area m.

Note that zero is set as the initial value of the base air-fuel ratio feedback compensation coefficient KG(m) that is to be initialized when the ECU 110 is powered on.

Figure 14:
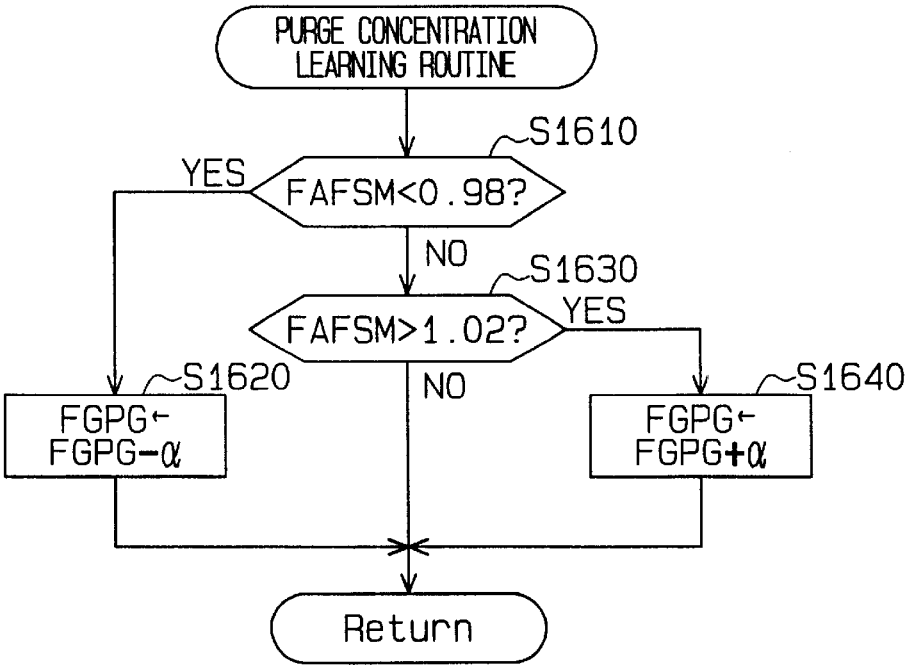
FIG. 14 is a flowchart of a purge concentration learning routine in the second embodiment.

FIG. 14 presents a flowchart of a purge concentration learning routine (S1600). In this routine, first, it is determined if the aforementioned grading value FAFSM of the air-fuel ratio feedback compensation coefficient FAF or the weighted average value of the air-fuel ratio feedback compensation coefficients over a long period of time is smaller than 0.98 (S1610). When FAFSM<0.98 (YES in S1610), i.e., when the grading value FAFSM indicates the lean state, the ECU 110 determines that the current purge-concentration learned value FGPG is too large (that the amount of fuel vapor in the purged gas has been overestimated and learned accordingly). Therefore, the ECU 110 decrements the purge-concentration learned value FGPG by an amount of change a and then temporarily terminates this routine.

When FAFSM≧0.98 (NO in S1610), it is determined if the grading value FAFSM is greater than 1.02 (S1630). When FAFSM>1.02 (YES in S1630), i.e., when the grading value FAFSM indicates the rich state, the ECU 110 determines that the current purge-concentration learned value FGPG is too small (that the amount of fuel vapor in the purged gas has been underestimated and learned accordingly). Therefore, the ECU 110 increments the current purge-concentration learned value FGPG by the amount of change α and then temporarily terminates this routine.

When 0.98≦FAFSM≦1.02 (NO in S1610 and NO in S1630), this routine is temporarily terminated without changing the purge-concentration learned value FGPG.

Unlike the base air-fuel ratio feedback compensation coefficient KG(m), the purge-concentration learned value FGPG is not obtained for every drive area of the engine 100 but is common to all the drive areas of the engine 100.

Figure 15:
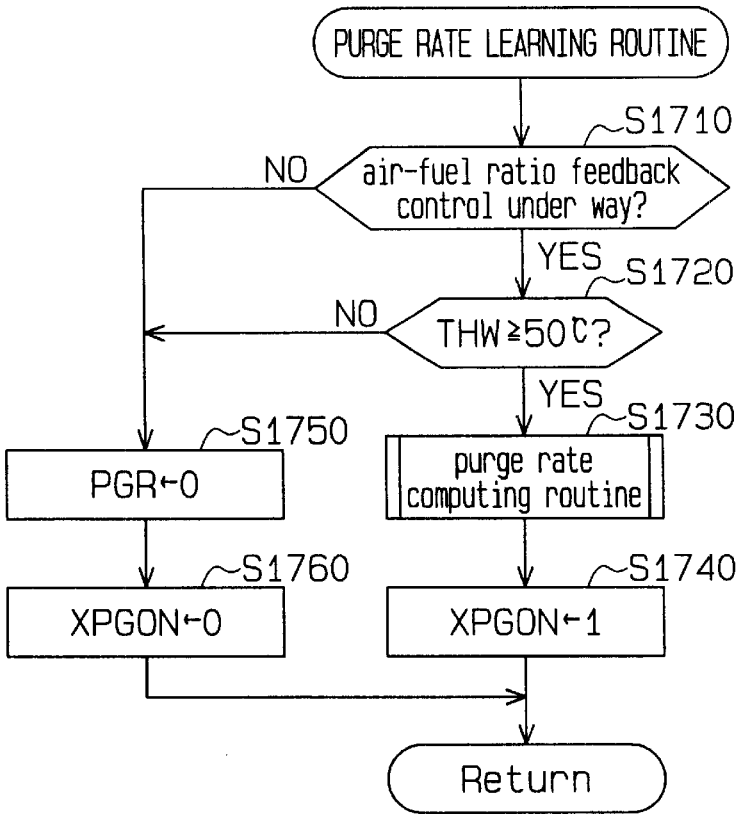
FIG. 15 is a flowchart of a purge rate control routine in the second embodiment.

FIG. 15 presents a flowchart of a purge rate control routine. This routine is likewise executed upon interruption made every given time interval or every given crank angle.

When this routine is started, it is determined if the air-fuel ratio feedback control is under way (S1710). When the air-fuel ratio feedback control is in progress (YES in S1710), it is determined if it the coolant temperature THW is equal to or higher than 50° C. (S1720). When THW≧50° C. (YES in S1720), the computation of the purge rate PGR which will be discussed later is performed (S1730) and the purge execution flag XPGON is set to one (S1740) after which this routine is temporarily terminated.

When the air-fuel ratio feedback control is not under way (NO in S1710) or when THW<50° C. (NO in S1720), however, the purge rate PGR is set to zero (S1750) and the purge execution flag XPGON is set to zero (S1760) after which this routine is temporarily terminated.

Figure 16:
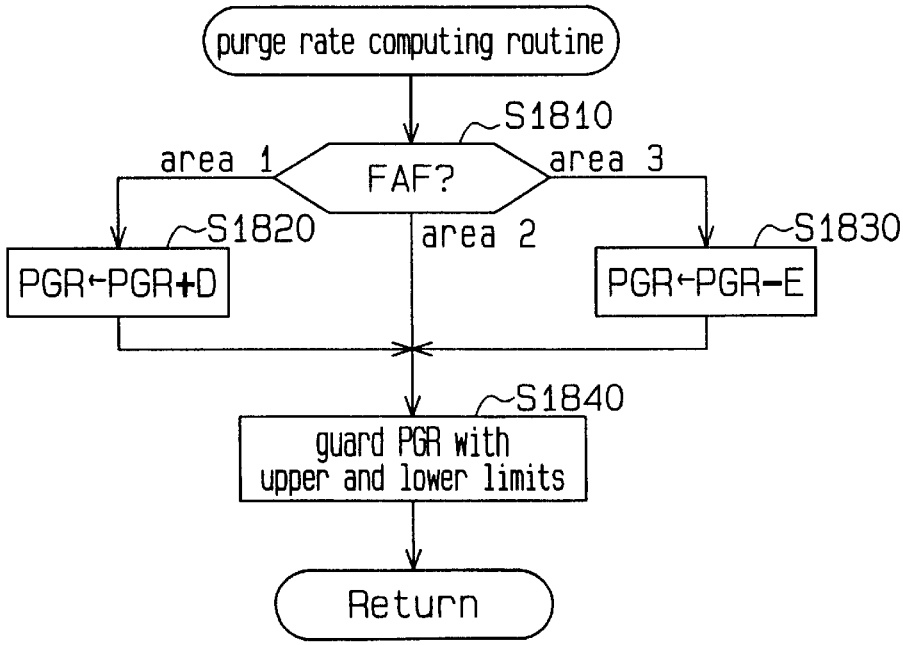
FIG. 16 is a flowchart of a purge rate computing routine in the second embodiment.

FIG. 16 presents a flowchart of a purge rate (PGR) computing routine (S1730).

Figure 17:
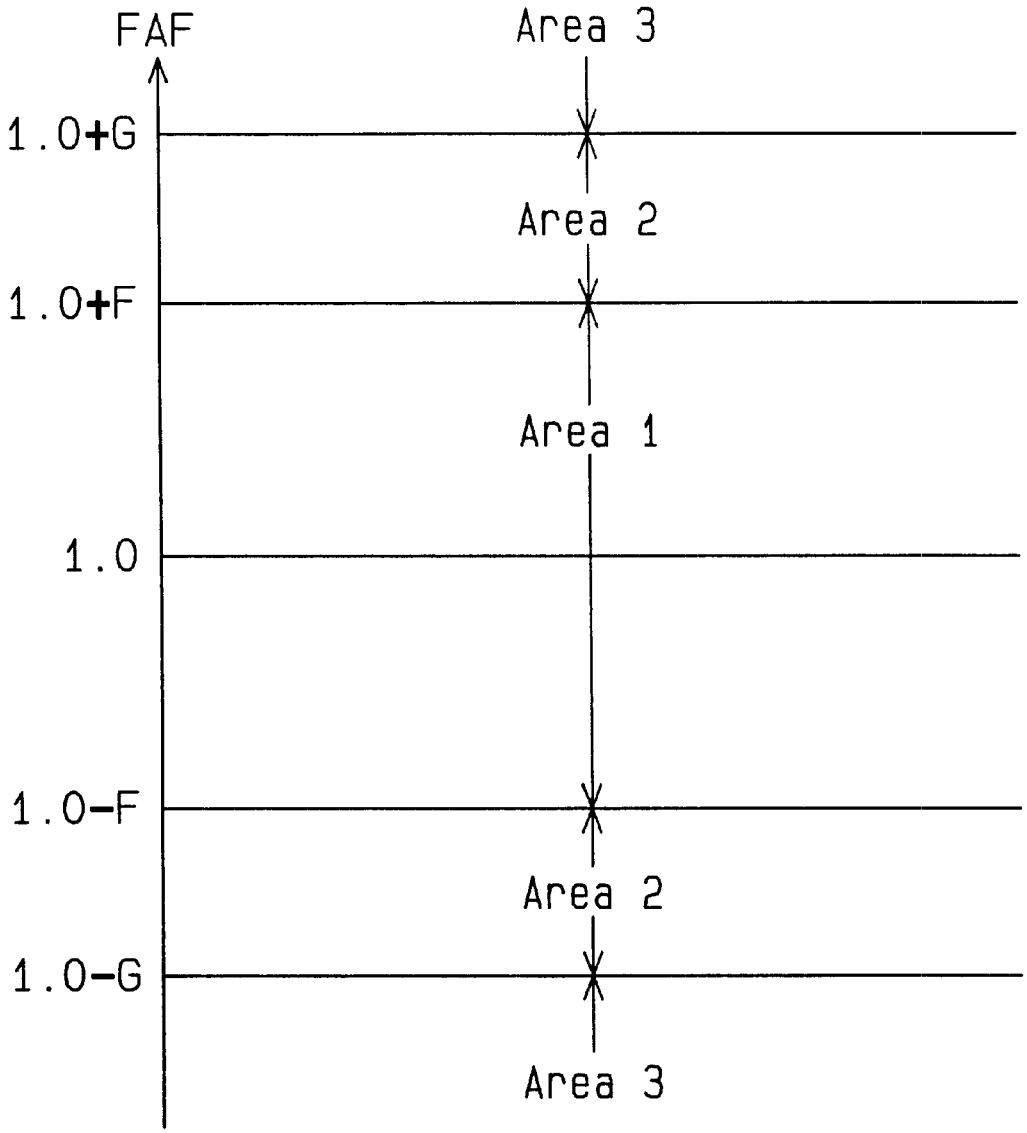
FIG. 17 is an explanatory diagram of area determination which is performed in the purge rate computing routine in the second embodiment.

In this routine, first, it is determined to what area the air-fuel ratio feedback compensation coefficient FAF belongs (S1810). One example of the drive areas for the air-fuel ratio feedback compensation coefficient FAF is illustrated in FIG. 17. It is determined that FAF belongs to the area 1 when the air-fuel ratio feedback compensation coefficient FAF lies within 1.0±F, FAF belongs to the area 2 when the air-fuel ratio feedback compensation coefficient FAF lies between 1.0±F and 1.0±G, FAF belongs to the area 3 when the air-fuel ratio feedback compensation coefficient FAF is greater than 1.0+G or smaller than 1.0−G. F and G has a relationship of 0<F<G.

When it is determined in step S1810 that FAF belongs to the area 1, the purge rate PGR is increased by a purge rate increment D (S1820). When it is determined in step S1810 that FAF belongs to the area 2, the purge rate PGR is kept unchanged. When it is determined in step S1810 that FAF belongs to the area 3, the purge rate PGR is decreased by a purge rate decrement E (S1830).

After step S1820 or step S1830 or when it was determined in step S1810 that FAF belonged to the area 2, a guard process for the upper and lower limits of the purge rate PGR is executed (S1840) to make the purge rate PGR lie between the upper limit and the lower limit. Then, this routine is temporarily terminated.

Figure 18:
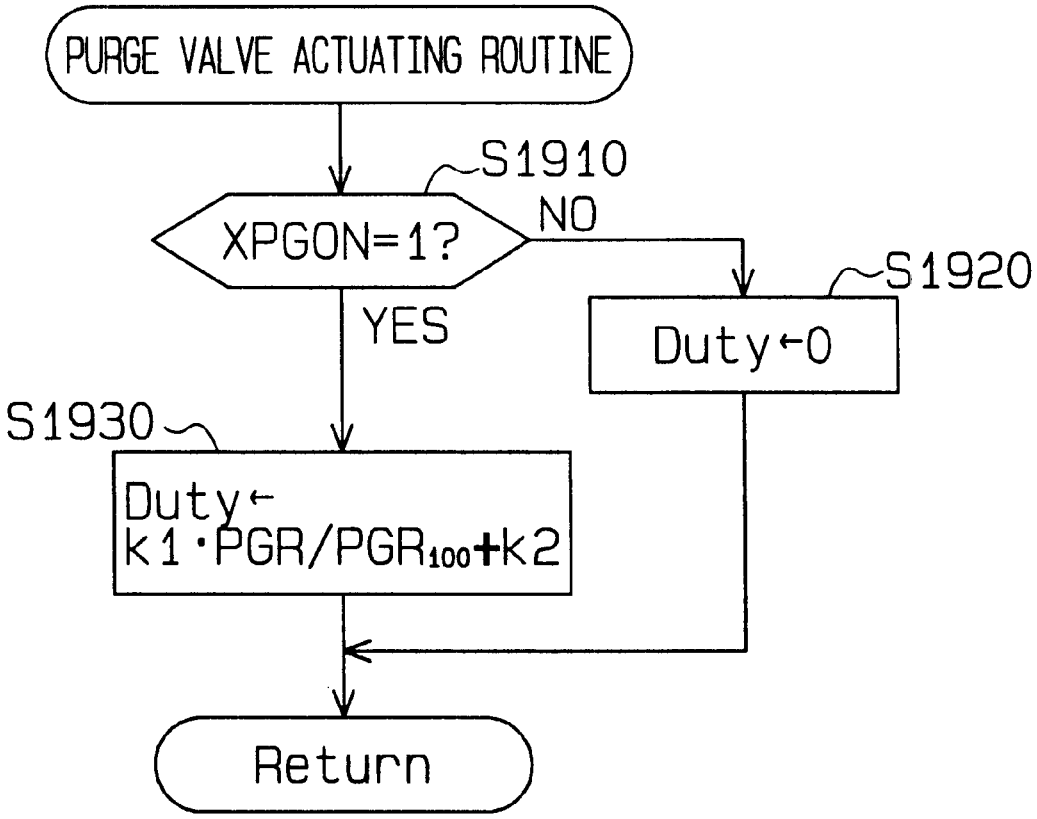
FIG. 18 is a flowchart of a purge-valve actuating routine in the second embodiment.

A purge-valve actuating routine shown in a flowchart in FIG. 18 is carried out based on the purge rate PGR and the purge execution flag XPGON both acquired in the purge rate control routine in FIG. 15. This routine is executed upon interruption made every given time interval or every given crank angle.

When this routine starts, it is determined first whether or not the purge execution flag XPGON is one (S1910). When XPGON=0 (NO in S1910), the duty coefficient (Duty) is set to zero (S1920) after which this routine is temporarily terminated.

When XPGON=1 (YES in S1910), the duty Duty is computed from the equation 3 given in the foregoing section of the first embodiment (S1930) and then this routine is temporarily terminated.

Figure 19:
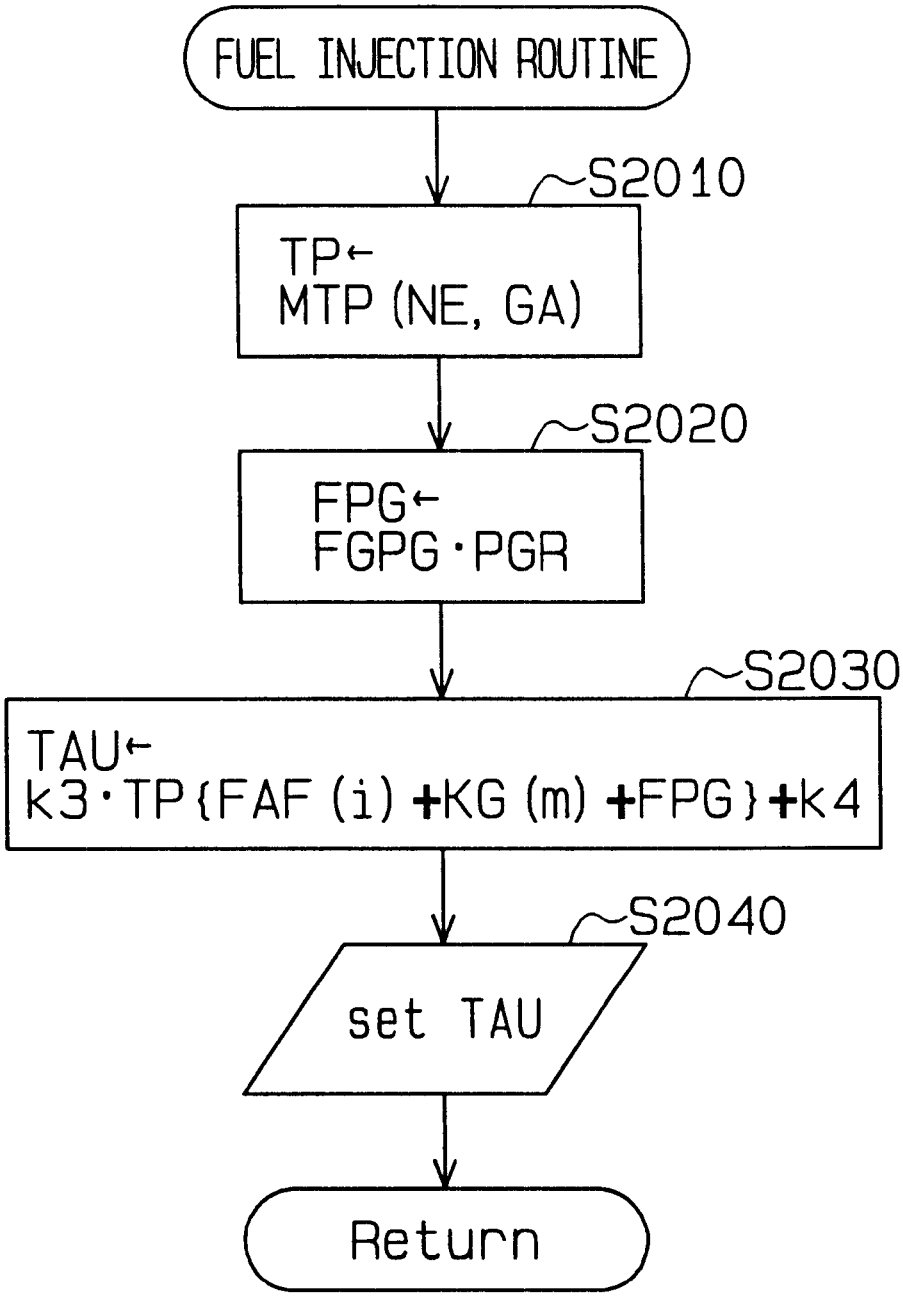
FIG. 19 is a flowchart of a fuel injection routine in the second embodiment.

Based on the base air-fuel ratio feedback compensation coefficient KG(m), the purge-concentration learned value FGPG, the purge rate PGR and the like that have been acquired in the above-described manner, a fuel injection routine shown in a flowchart in FIG. 19 is carried out. This routine is executed upon interruption made every given time interval or every given crank angle.

Figure 20:
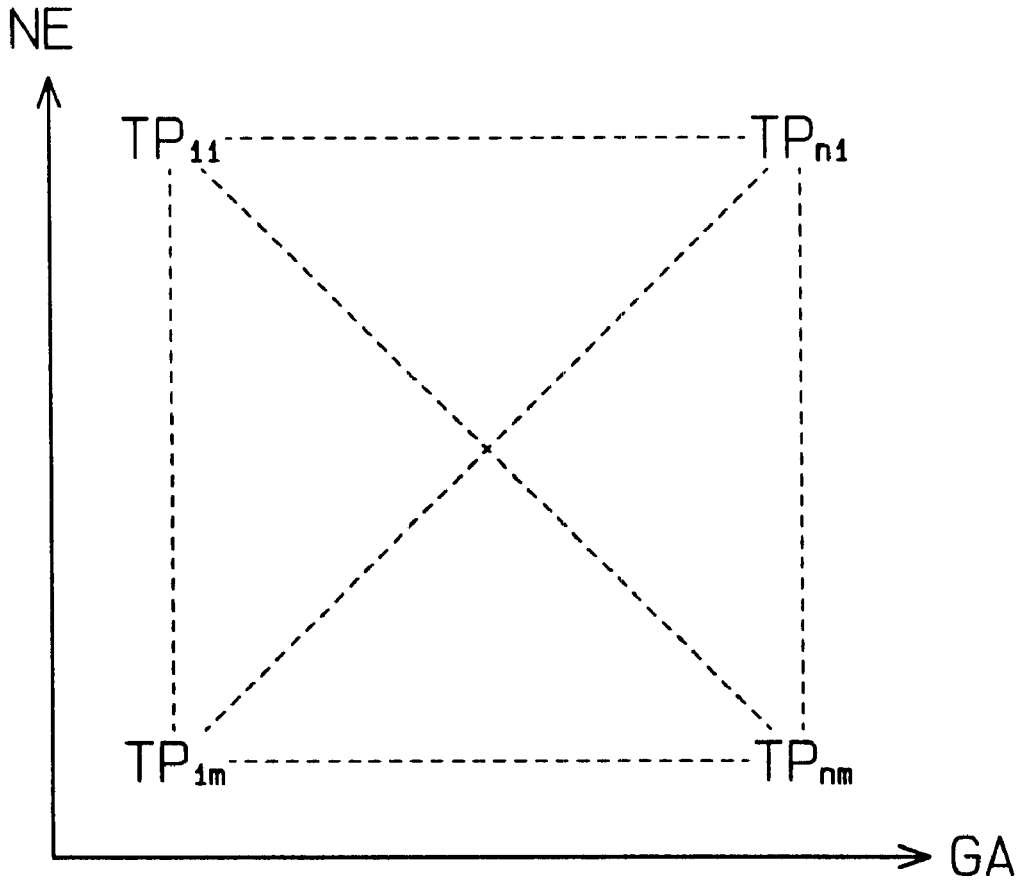
FIG. 20 is an explanatory diagram of the structure of a map MTP which is used in the fuel injection routine in the second embodiment.

When this routine is commenced, the ECU 110 acquires a basic fuel-injection-valve open time TP from a map MTP shown in FIG. 20 based on the engine speed NE of the engine 100 and the intake-air amount GA (S2010).

Next, a purge compensation coefficient FPG is computed from the following equation 10 based on the purge-concentration learned value FGPG learned in the purge-concentration learning routine illustrated in FIG. 14 and the purge rate PGR determined in the purge rate computing routine illustrated in FIG. 16 (S2020).

$$FPG \leftarrow FGPG \cdot PGR \tag{10}$$

Then, a fuel-injection-valve open time TAU is computed using the following equation 11 based on the air-fuel ratio feedback compensation coefficient FAF(i) computed in the air-fuel-ratio feedback control routine illustrated in FIGS. 8 to 10, the base air-fuel ratio feedback compensation coefficient KG(m) computed in the base air-fuel-ratio-feedback-compensation-coefficient learning routine illustrated in FIG. 13 and the purge compensation coefficient FPG acquired in step S2020 (S2030).

$$TAU \leftarrow k3 \cdot TP \cdot \{FAF(i)+KG(m)+FPG\}+k4 \quad (11)$$

where k3 and k4 are compensation coefficients including a warm-up increment and a start-up increment. Then, the ECU 110 outputs the fuel-injection-valve open time TAU (S2040) and temporarily terminates this routine.

Figure 21:
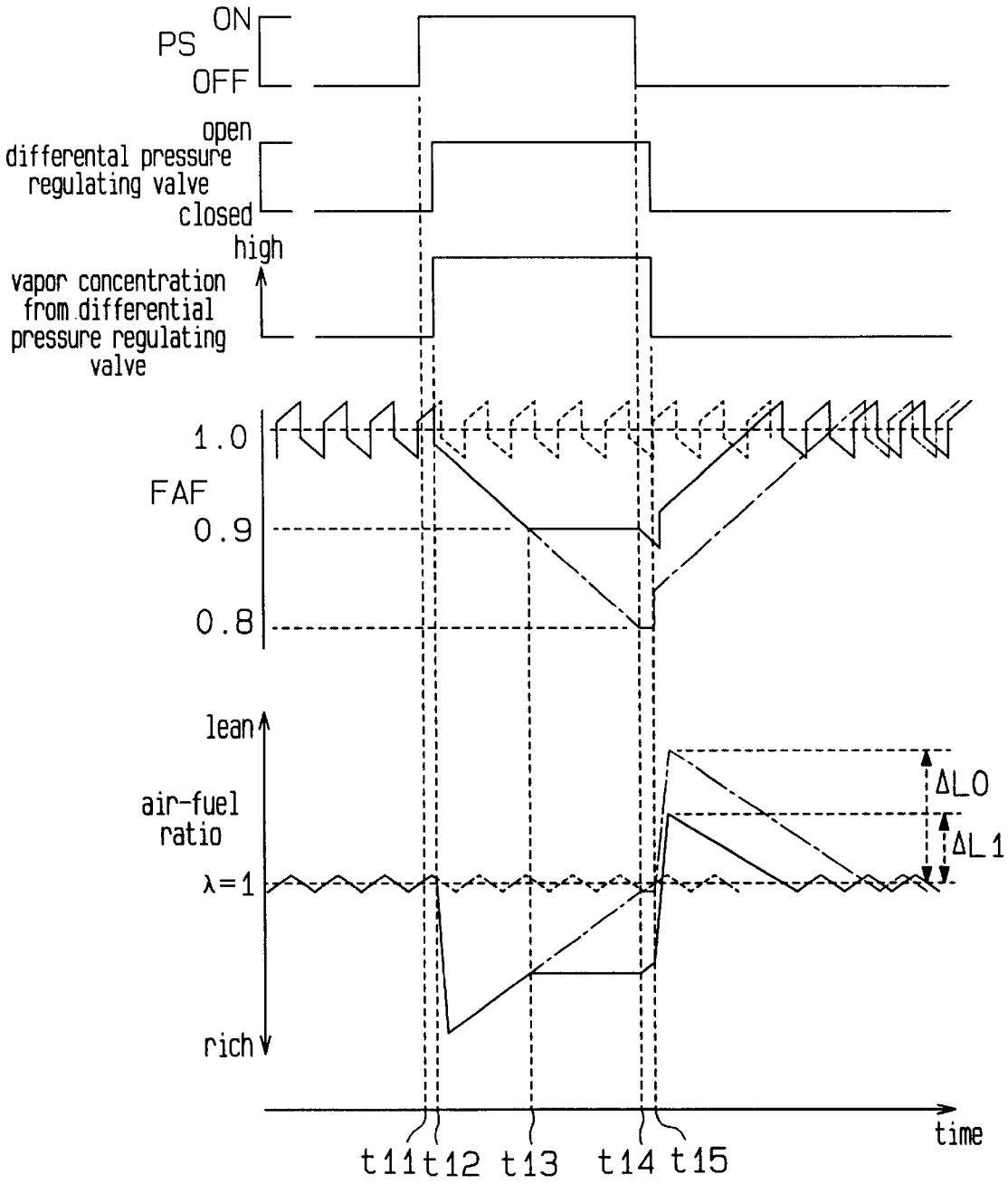
FIG. 21 is a timing chart showing the advantages of the second embodiment.

One example of the control that is implemented in the second embodiment with the above-described structure is illustrated in the timing chart in FIG. 21. FIG. 21 shows that the signal PS from the power steering switch 176 is ON at time t11 and it is OFF at time t14.

If the differential pressure regulating valve 105 is not actually opened at this time, rich fuel vapor would not be purged to the air-intake passage 109 from the purge passage 108 even if the purge control valve 111 is opened in step S1930. Accordingly, the air-fuel ratio feedback compensation coefficient FAF and the actual air-fuel ratio show a sawtooth-like transition as indicated by broken lines so that an irregular variation in air-fuel ratio does not occur. Even if the differential pressure regulating valve 105 is opened, the same is true of the case where fuel vapor to be purged has a low concentration, so that no irregular variation likewise occurs in the air-fuel ratio.

Let us now consider a case where the signal PS of the power steering switch 176 is switched to ON according to the steering made by the driver as indicated by the solid line. This steering action causes the turning acceleration to act on the fuel tank 101, causing a large fluctuation of the surface of fuel in the fuel tank 101. When the differential pressure regulating valve 105 is opened after time t12 according to this large fluctuation of the fuel surface to thereby cause rich fuel vapor to be purged to the air-intake passage 109, the air-fuel ratio is shifted significantly to the rich side. As a result, the air-fuel ratio detected by the air-fuel ratio sensor 166 shows the rich state so that the air-fuel ratio feedback compensation coefficient FAF is gradually reduced.

In accordance with the reduction in air-fuel ratio feedback compensation coefficient FAF, the fuel-injection-valve open time TAU, which is computed by the aforementioned equation 11, decreases so that the air-fuel ratio gradually becomes toward the more lean. However, according to the second embodiment, when PS=ON (NO in S1135), the lower limit of the air-fuel ratio feedback compensation coefficient FAF is restricted to 0.9 (S1150, S1155). Unlike where the lower limit remains at 0.8 as indicated by the uniformly dashed broken line, however, the air-fuel ratio is inhibited from being rapidly returned to the theoretical air-fuel ratio ($\lambda$=1) and the air-fuel ratio changes in a certain degree of rich state (time t13–t14).

At time t14, the signal PS of the power steering switch 176 is switched to OFF and after time t15, the differential pressure regulating valve 105 is closed, disabling the purging of rich fuel vapor. At this time, the air-fuel ratio feedback compensation coefficient FAF is increased once by the rich skip amount SKR (S1220) and is thereafter increased by the rich integration value RSR (S1230), so that the air-fuel ratio is temporarily shifted significantly toward the lean side (immediately after time t15). In the state immediately before purging of rich fuel vapor is disabled, however, the air-fuel ratio is rich, not the theoretical air-fuel ratio, so that it does not significantly become lean beyond the theoretical air-fuel ratio, as indicated by $\Delta$L1.

If the lower limit remains at 0.8 when PS=ON as indicated by the one-dot chain line, the air-fuel ratio should have rapidly returned to the theoretical air-fuel ratio ($\lambda$=1) by timing t14. When purging of rich fuel vapor is disabled, therefore, the air-fuel ratio significantly changes the theoretical air-fuel ratio to be more lean, as indicated by $\Delta$L0.

In the above-described structure, step S1135 is equivalent to the process of the determination means that determines the open state of the differential pressure regulating valve 105 based on the presence or absence of the auxiliary steering force detected as data representing the turning state. Further, steps S1150 and S1155 are equivalent to the process of the suppression means that restricts feedback compensation for reducing the fuel concentration under air-fuel ratio feedback control.

The above-described second embodiment has the following advantages.

(1) As the power steering switch 176 is switched ON, the generation of the auxiliary steering force by the power steering system is detected, and turning of the vehicle on which the engine 100 is mounted is detected upon detection of the auxiliary steering force. Because the disturbance of the fuel surface that occurs in the fuel tank 101 is caused by the turning action of the vehicle, such disturbance of the fuel surface can be detected from the detection of the turning action. As this disturbance of the fuel surface causes the differential pressure regulating valve 105 to open, it is easily determined that the valve 105 is opened by detecting if the power steering switch 176 is switched ON.

A vehicle on which the engine 100 is mounted is provided with the power steering switch 176 as the power steering system is used. It is therefore possible to easily determine that the vehicle is turning from the signal PS from the power steering switch 176 and to thus detect the fluctuation of the fuel surface based on the result of the determination without providing a special sensor.

(2) When it is determined that the differential pressure regulating valve 105 is opened because of the power steering switch 176 being switched ON (NO in S1135), feedback compensation for reducing the fuel concentration is restricted (S1150, S1155). This can suppress a large shift of the air-fuel ratio toward the lean side immediately after the closure of the differential pressure regulating valve 105 as has been explained earlier with reference to FIG. 21. In the air intake system, the stable combustion of the engine 100 is apt to be impaired more when the fuel concentration in the air-fuel ratio becomes lean than when it becomes rich. Even if the air-fuel ratio feedback control is restricted to the air-fuel ratio variation suppressing routine for suppressing the shift of the fuel concentration to the lean side when the state of the differential pressure regulating valve 105 is changed to the closed state from the open state as in the second embodiment, therefore, it is possible to stabilize the combustion of the engine 100.

Restricting the feedback compensation to reduce the fuel concentration suppresses an excess change in air-fuel ratio toward the lean side after closure of the differential pressure regulating valve 105. Even if the differential pressure regulating valve 105 is not actually opened when the power steering switch 176 is switched ON or purging of EVE 20 rich fuel vapor is not conducted even when the valve 105 is opened, therefore, stable air-fuel ratio feedback control is performed as indicated by the sawtooth pattern of the broken line in FIG. 21.

Third Embodiment

Figure 22:
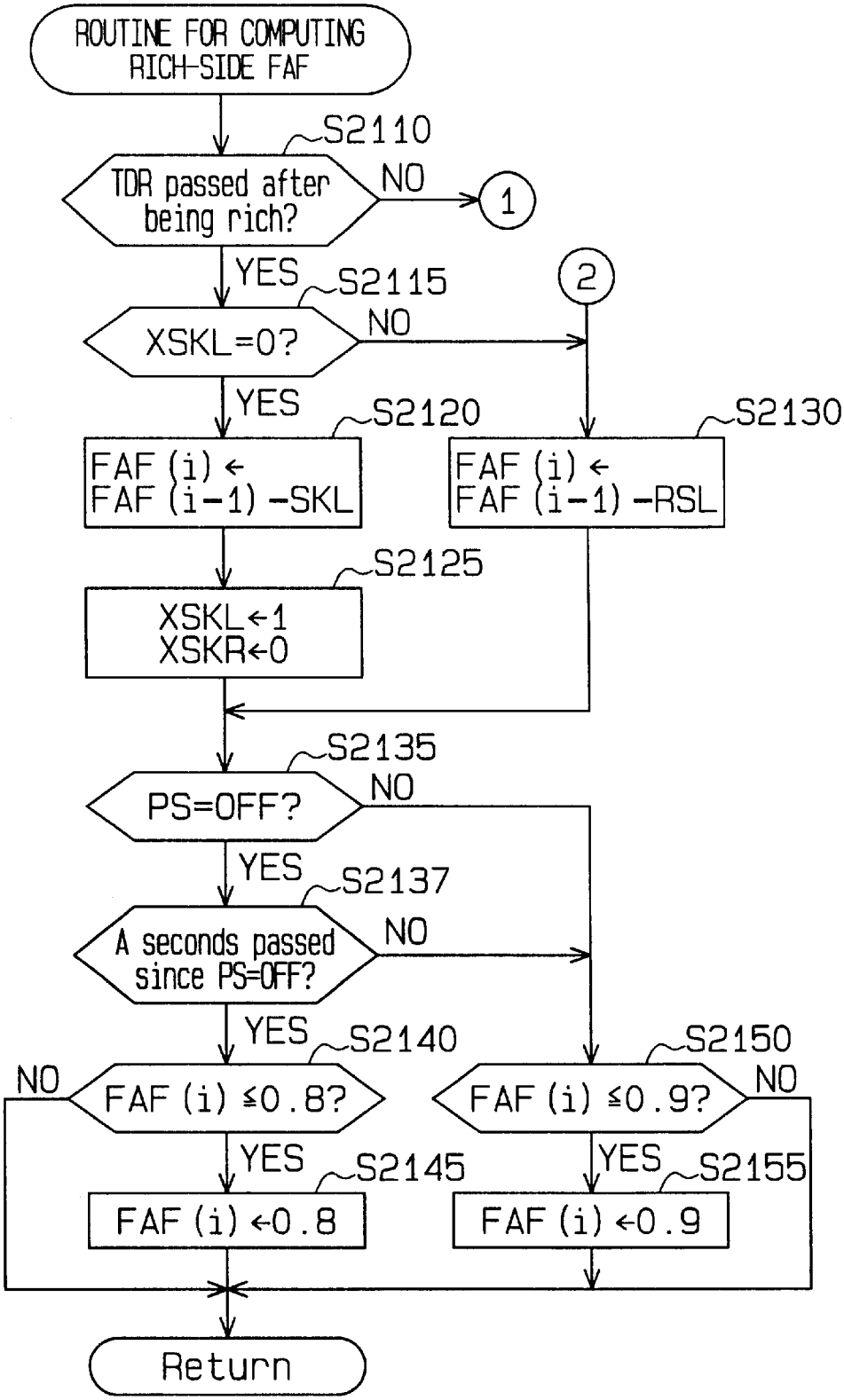
FIG. 22 is a flowchart of a routine for computing the rich-side air-fuel ratio feedback compensation coefficient FAF in a third embodiment.

The third embodiment differs from the second embodiment in that a routine shown in FIG. 22 is implemented instead of the routine for computing the rich-side air-fuel ratio feedback compensation coefficient FAF (S1100) shown in FIG. 9 in the second embodiment. Otherwise, the structure is the same as that of the second embodiment.

In the routine for computing the rich-side air-fuel ratio feedback compensation coefficient FAF shown in FIG. 22, processes in steps S2110–S2155 excluding step S2137 are the same as those in steps S1110–S1155 in FIG. 9. It is to be noted that the processes in FIG. 22 in the third embodiment that are the same as those of the second embodiment are given reference symbols obtained by adding one thousand to the associated step numbers of the second embodiment, unless otherwise specifically mentioned.

Step S2137 in FIG. 22 is a process which is executed when the signal PS from the power steering switch 176 is OFF (YES in S2135). In this step S2137, it is determined whether or not the delay time of A seconds has elapsed since switching of the signal PS from the power steering switch 176 from ON to OFF.

Figure 23:
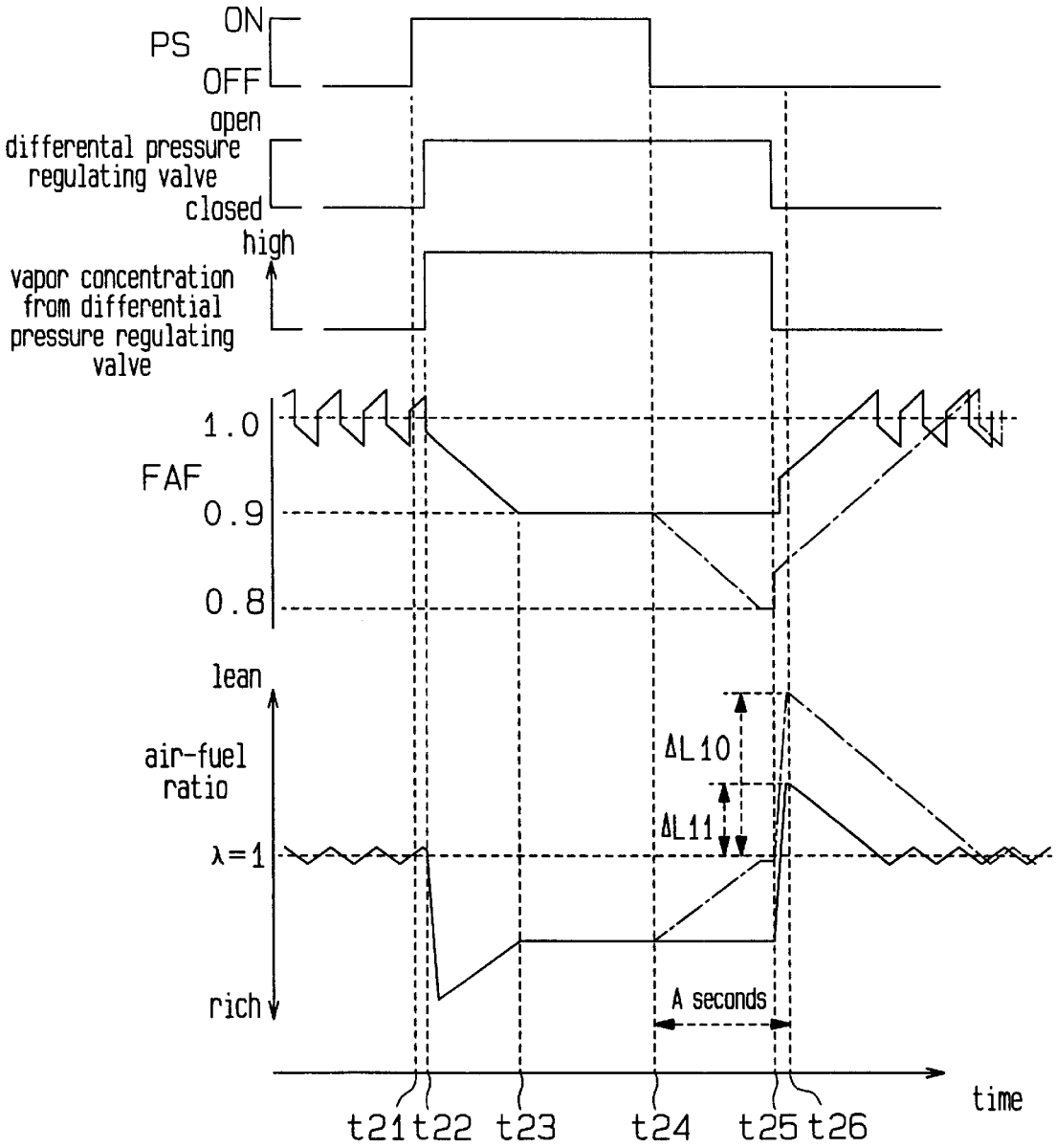
FIG. 23 is a timing chart showing the advantages of the third embodiment.

One example of the control that is implemented in the third embodiment with the above-described structure is illustrated in the timing chart in FIG. 23. FIG. 23 shows that the signal PS from the power steering switch 176 is ON at timing t21 and it is OFF at timing t24.

When the signal PS from the power steering switch 176 is switched ON as indicated by the solid line, the differential pressure regulating valve 105 is opened after timing t22 by the above-described mechanism. The opening of this valve 105 causes rich fuel vapor to be purged to the air-intake passage 109. As a result, the air-fuel ratio is shifted significantly to the rich side. As the air-fuel ratio detected by the air-fuel ratio sensor 166 shows the rich state, the air-fuel ratio feedback compensation coefficient FAF is gradually decreased. In accordance with the reduction in air-fuel ratio feedback compensation coefficient FAF, the fuel-injection-valve open time TAU, which is computed using the equation 11 mentioned in the foregoing description of the second embodiment, decreases so that the air-fuel ratio gradually becomes more lean.

In the third embodiment, as in the second embodiment, when PS=ON (NO in S2135), the lower limit of the air-fuel ratio feedback compensation coefficient FAF is restricted to 0.9 (S2150, S2155). Unlike in the case where the lower limit remains at 0.8 as indicated by the one-dot chain line, however, the air-fuel ratio is inhibited from being rapidly returned to the theoretical air-fuel ratio (λ=1) and the air-fuel ratio changes in a certain degree of rich state (timings t23–t24).

At timing t24, the signal PS of the power steering switch 176 is switched to OFF. Because of continuation of the fluctuation of the fuel surface in the fuel tank 101 for a while or a similar reason, however, closing of the differential pressure regulating valve 105 may be delayed significantly from the point of PS=OFF. If such a situation occurs, the lower limit of the air-fuel ratio feedback compensation coefficient FAF returns to the normal value of 0.8 as indicated by the one-dot chain line in the second embodiment, so that the air-fuel ratio feedback compensation coefficient FAF(i) becomes rapidly smaller during the delay of the closure of the valve 105, thus causing the air-fuel ratio to return to the vicinity of the theoretical air-fuel ratio. When the differential pressure regulating valve 105 is closed at timing t25, therefore, because the air-fuel ratio should have returned to the theoretical air-fuel ratio (λ=1) by timing t25, so that when purging of rich fuel vapor is disabled, the air-fuel ratio significantly shifts over the theoretical air-fuel ratio toward the lean side, as indicated by ΔL10.

According to the third embodiment, however, the lower limit of the air-fuel ratio feedback compensation coefficient FAF is not returned to 0.8 from 0.9 immediately after PS becomes OFF but it is returned to 0.8 after the delay time of A seconds. Even if closure of the differential pressure regulating valve 105 is delayed, the air-fuel ratio is in a rich state, not the theoretical air-fuel ratio, in the state immediately before purging of rich fuel vapor is disabled, so that the air-fuel ratio does not greatly change over the theoretical air-fuel ratio toward the lean side as indicated by ΔL11.

In the above-described structure, step S2135 is equivalent to the process of the determination means that determines the open state of the differential pressure regulating valve 105 based on the presence or absence of the auxiliary steering force detected as the turning state. Further, steps S2137, S2150 and S2155 are equivalent to the process of the suppression means that restricts feedback compensation for reducing the fuel concentration and disables this restriction after the delay time when disabling of such restriction is needed.

The above-described third embodiment has the following advantages.

(1) Advantages (1) and (2) of the second embodiment.

(2) The lower limit of the air-fuel ratio feedback compensation coefficient FAF is not returned to 0.8 from 0.9 after the delay time. Even if closure of the differential pressure regulating valve 105 is delayed from the point of PS=OFF, therefore, it is possible to suppress a significant change in air-fuel ratio toward the lean side which makes the combustion of the engine 100 unstable.

Fourth Embodiment

Figure 24:
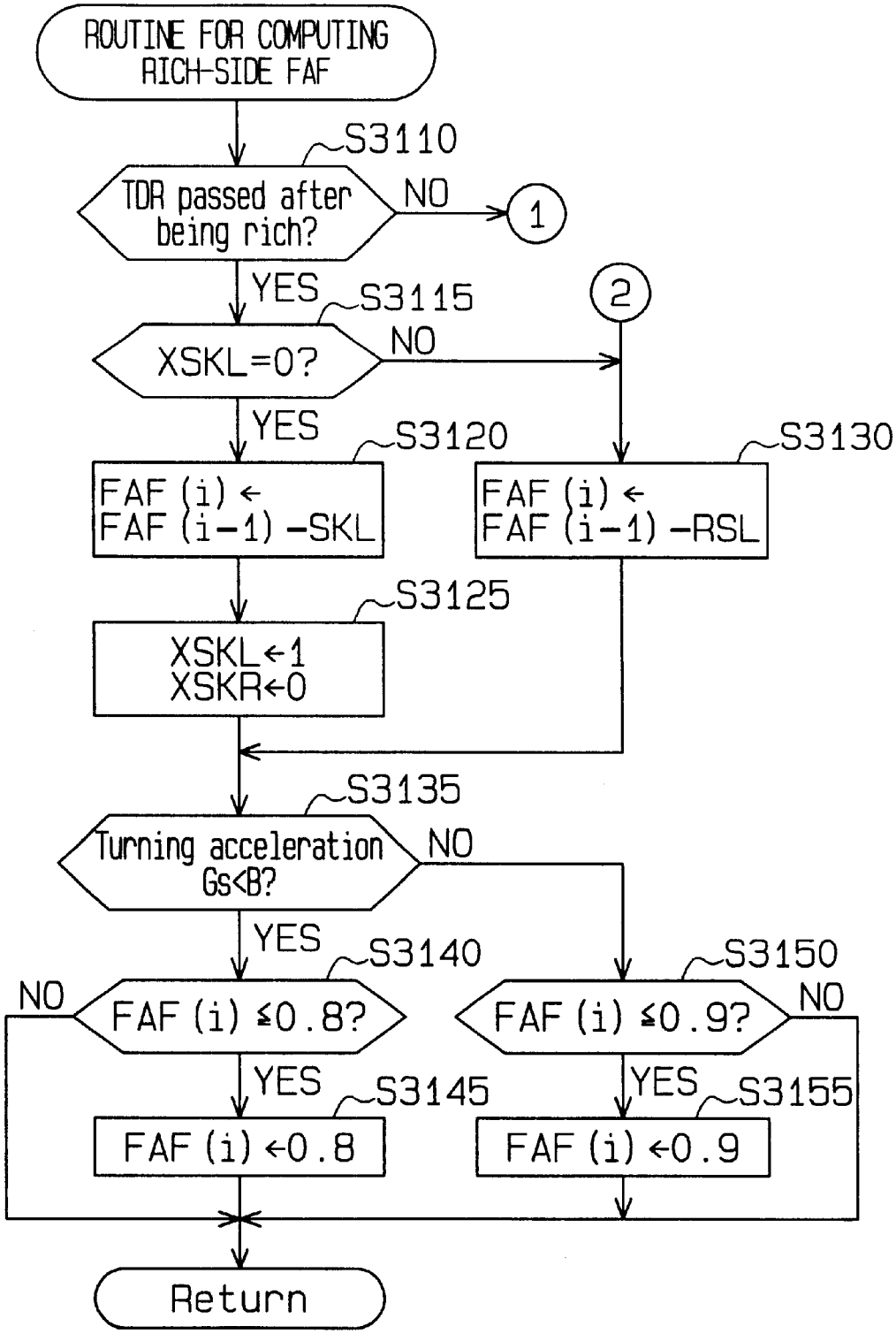
FIG. 24 is a flowchart of a routine for computing the rich-side air-fuel ratio feedback compensation coefficient FAF in a fourth embodiment.

The fourth embodiment differs from the second embodiment in that a routine shown in FIG. 24 is carried out instead of the routine for computing the rich-side air-fuel ratio feedback compensation coefficient FAF (S1100) shown in FIG. 9 in the second embodiment. Otherwise, the structure is the same as that of the second embodiment.

In the routine for computing the rich-side air-fuel ratio feedback compensation coefficient FAF shown in FIG. 24, processes in steps S3110–S3155 excluding step S3135 are the same as those in steps S1110–S1155 in FIG. 9. The processes in FIG. 24 in the fourth embodiment that are the same as those of the second embodiment are given reference symbols obtained by adding two thousand to the associated step numbers in the second embodiment, unless otherwise specifically mentioned.

Figure 25:
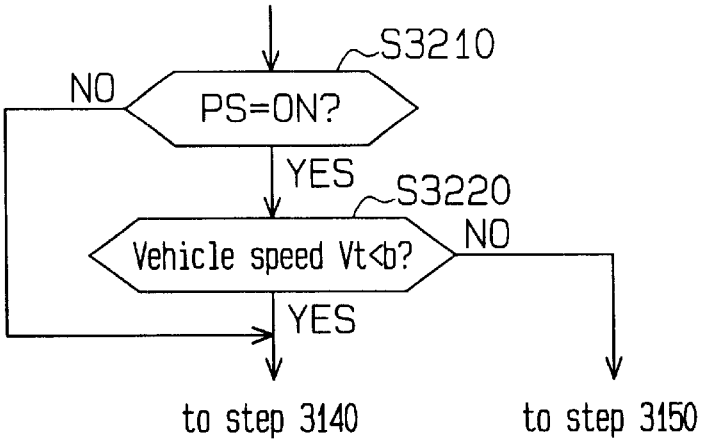
FIG. 25 is a flowchart of a routine for determining a turning acceleration Gs in the fourth embodiment.
Figure 26:
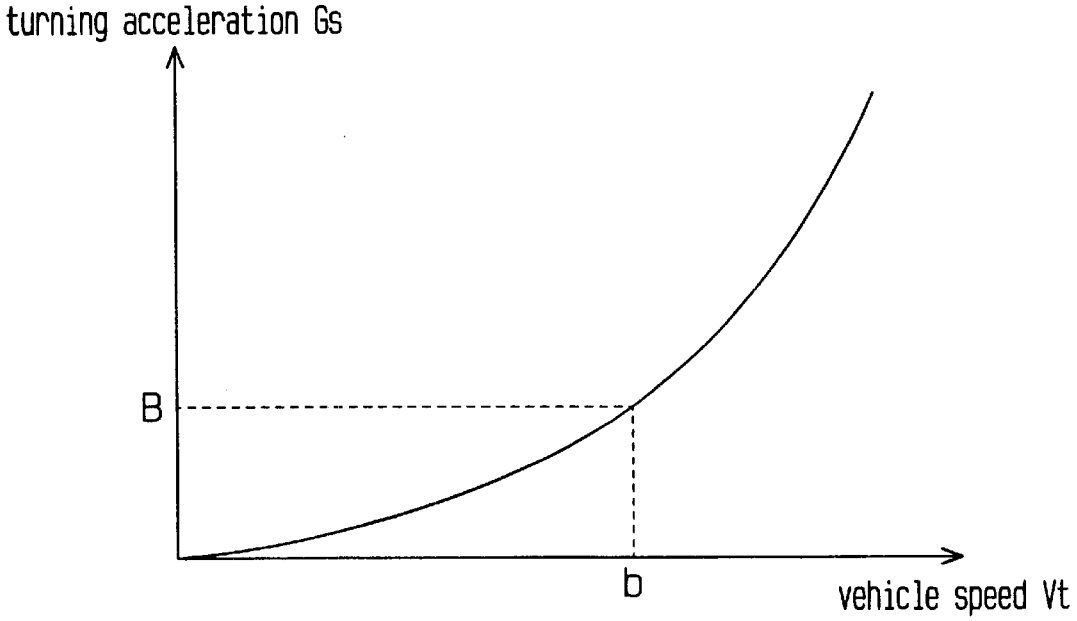
FIG. 26 is an explanatory diagram of a map structure for acquiring the turning acceleration Gs from a vehicle speed Vt in the fourth embodiment.

In step S3135 in FIG. 24, it is determined if the turning acceleration Gs of the vehicle is smaller than a reference turning acceleration value B. The determination of the turning acceleration Gs is made by a routine illustrated in FIG. 25. First, it is determined if the signal PS from the power steering switch 176 is ON (S3210). When PS=ON (YES in S3210), it is determined if the vehicle speed Vt detected by the vehicle speed sensor 177 is smaller than a vehicle-speed decision value b (S3220). When Vt<b (YES in S3220), it is possible to assume that Gs<B in the normal turning state as shown in FIG. 26. Accordingly, the flow proceeds to step S3140 to set the lower limit of the air-fuel ratio feedback compensation coefficient FAF(i) to 0.8. When it is determined in step S3210 that PS=OFF (NO in S3210), there is no turning action so that it is likewise assumed that Gs<B and the flow proceeds to step S3140.

When Vt≧b in step S3220 (NO in S3220), on the other hand, it is possible to assume that Gs>B in the normal turning state as shown in FIG. 26. Accordingly, the flow proceeds to step S3150 to set the lower limit of the air-fuel ratio feedback compensation coefficient FAF(i) to 0.9 to restrict the reduction of FAF(i).

Figure 27:
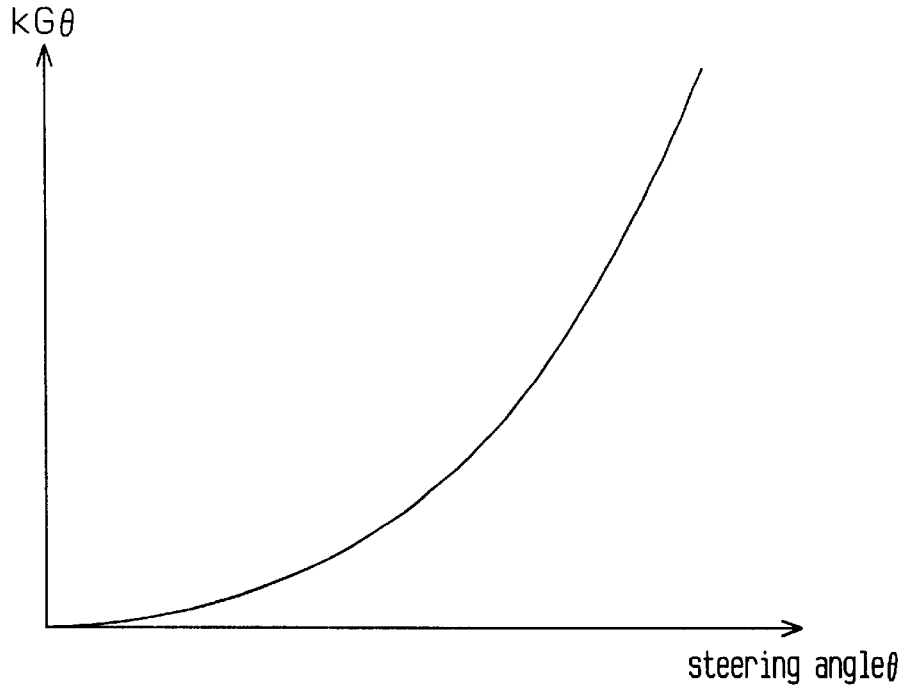
FIG. 27 is an explanatory diagram of a map structure for acquiring a steering-angle/turning-acceleration coefficient kGθ from a steering angle θ in the fourth embodiment.
Figure 28:
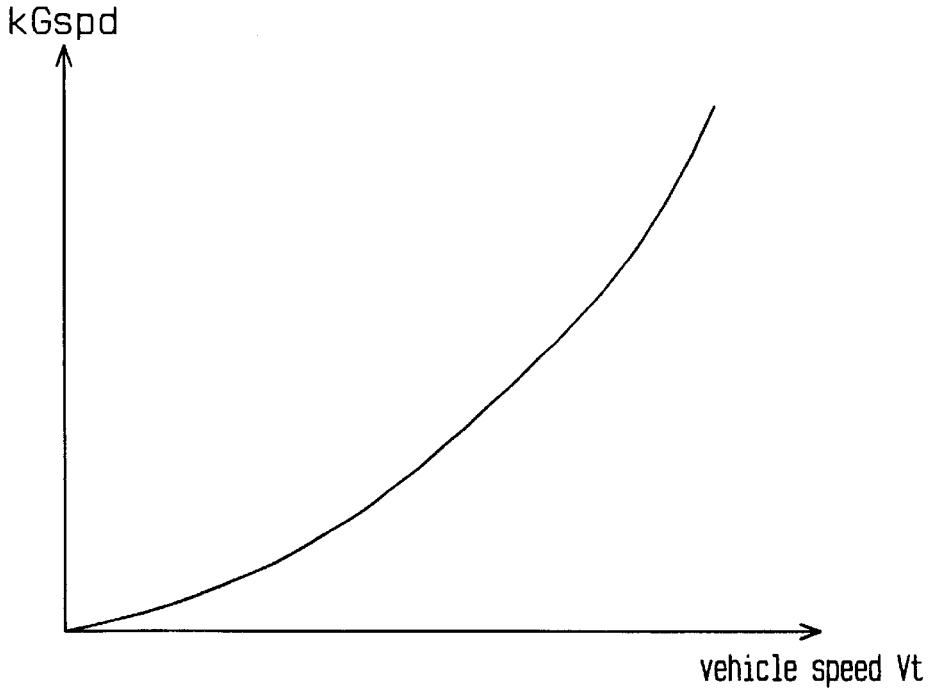
FIG. 28 is an explanatory diagram of a map structure for acquiring a vehicle-speed/turning-acceleration coefficient kGspd from the vehicle speed Vt in the fourth embodiment.

Instead of the power steering switch 176, a steering angle sensor may be provided to detect the steering angle θ so that the turning acceleration Gs is computed from this steering angle θ together with the vehicle speed Vt obtained from the vehicle speed sensor 177 and is used in the decision in step S3135. Specifically, a steering-angle/turning-acceleration coefficient kGθ for calculating the turning acceleration Gs is acquired from a map as shown in FIG. 27 based on the steering angle θ obtained from the steering angle sensor. Further, a vehicle-speed/turning-acceleration coefficient kGspd for calculating the turning acceleration Gs is acquired from a map as shown in FIG. 28 based on the vehicle speed Vt obtained from the vehicle speed sensor 177. Then, the turning acceleration Gs is acquired from the product of the steering-angle/turning-acceleration coefficient kGθ and the vehicle-speed/turning-acceleration coefficient kGspd as given by the following equation 12.

$$Gs \leftarrow kGspd \cdot kg\theta \tag{12}$$

With above-described structure, the fourth embodiment performs control similar to that of the second embodiment shown in FIG. 21.

In the above-described structure, step S3135 (S3210, S3220) is equivalent to the process of the determination means that determines the open state of the differential pressure regulating valve 105 based on the turning state. Further, steps S3150 and S3155 are equivalent to the process of the suppression means that restricts feedback compensation for reducing the fuel concentration under air-fuel ratio feedback control.

The above-described fourth embodiment has the following advantages.

(1) Advantages (1) and (2) of the second embodiment.

(2) As the degree of the turning acceleration Gs is acquired using the vehicle speed Vt as well as the signal PS from the power steering switch 176, the fluctuation of the fuel surface in the fuel tank 101 can be detected more accurately, thus ensuring more adequate suppression of a large change in air-fuel ratio toward the lean side. If the turning acceleration Gs is obtained using the steering angle θ and the vehicle speed Vt, it is possible to detect the fluctuation of the fuel surface in the fuel tank 101 more precisely so that a large change in air-fuel ratio toward the lean side can be suppressed more adequately.

Fifth Embodiment

Figure 29:
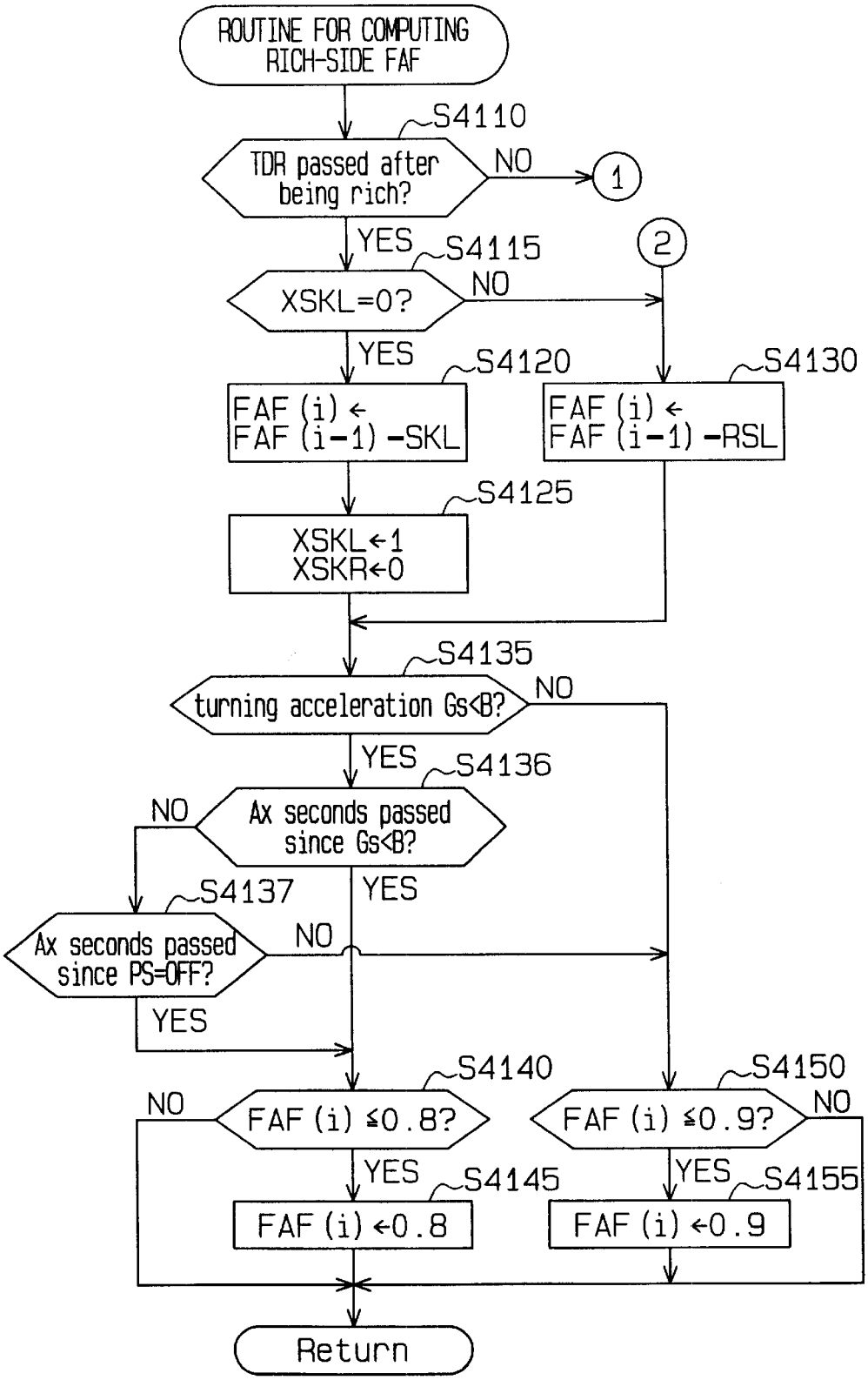
FIG. 29 is a flowchart of a routine for computing the rich-side air-fuel ratio feedback compensation coefficient FAF in a fifth embodiment.

The fifth embodiment differs from the fourth embodiment in that a routine shown in FIG. 29 is implemented instead of the routine for computing the rich-side air-fuel ratio feedback compensation coefficient FAF shown in FIG. 24 in the fourth embodiment. Otherwise, the structure is the same as that of the fourth embodiment.

In the routine for computing the rich-side air-fuel ratio feedback compensation coefficient FAF shown in FIG. 29, processes in steps S4110–S4155 excluding steps S4136 and S4137 are the same as those in steps S3110–S3155 in FIG. 24. The processes in FIG. 29 in the fifth embodiment that are the same as those of the fourth embodiment are given reference symbols obtained by adding one thousand to the associated step numbers of the fourth embodiment, unless otherwise specifically mentioned.

Step S4136 in FIG. 29 is the process that is executed when the turning acceleration Gs<B (YES in S4135) and it is determined there whether or not the time of Ax seconds has elapsed since the change from Gs≧B to Gs<B. When Ax seconds have passed since the change to Gs<B (YES in S4136), the flow moves to step S4140 to set the lower limit of the air-fuel ratio feedback compensation coefficient FAF (i) to the normal value of 0.8.

When Ax seconds have not passed yet since the change to Gs<B (NO in S4136), it is determined whether or not Ax seconds have elapsed since the point when the signal PS from the power steering switch 176 became OFF (S4137). When Ax seconds have passed since the state of PS=OFF (YES in S4137), the flow moves to step S4140 to set the lower limit of the air-fuel ratio feedback compensation coefficient FAF(i) to the normal value of 0.8.

In the case of PS=ON or if Ax seconds have not passed even in the case of PS=OFF (NO in S4137), it is considered that the turning acceleration Gs may be great to cause a large fluctuation in the fuel surface in the fuel tank 101, and the flow proceeds to step S4150 to set the lower limit of the air-fuel ratio feedback compensation coefficient FAF(i) to 0.9 to restrict the reduction of FAF(i).

Figure 30:
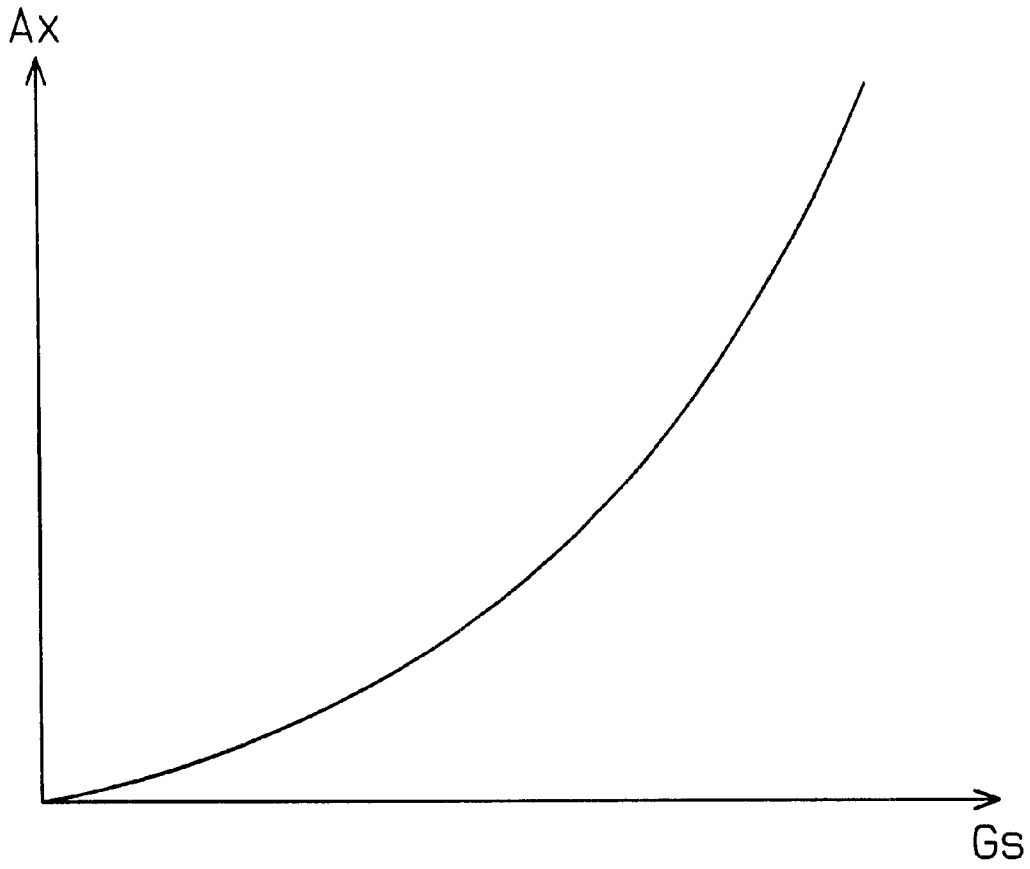
FIG. 30 is an explanatory diagram of a map structure for obtaining a delay time Ax from the turning acceleration Gs in the fifth embodiment.

While the delay time of Ax seconds may be constant, it may be set as shown in FIG. 30 in accordance with the turning acceleration Gs.

By executing this routine, the fifth embodiment performs control similar to that of the third embodiment shown in FIG. 23.

In the above-described structure, step S4135 is equivalent to the process of the determination means that determines the open state of the differential pressure regulating valve 105 based on the turning state. Further, steps S4136, S4137, S4150 and S4155 are equivalent to the process of the suppression means that restricts feedback compensation for reducing the fuel concentration and disables this restriction after the delay time when disabling of such restriction is needed.

The above-described fifth embodiment has the following advantages.

(1) Advantages (1) and (2) of the third embodiment.

(2) Advantage (2) of the fourth embodiment.

(3) In the case where the turning acceleration Gs is acquired from both the steering angle θ and the vehicle speed Vt, the processing delay time is determined based on not only the time elapsed after the signal PS from the power steering switch 176 became OFF but also the time elapsed after the turning acceleration Gs became smaller than B. It is possible to detect the convergence of the fluctuation of the fuel surface in the fuel tank 101 more accurately and thus to suppress a change in air-fuel ratio more adequately.

Sixth Embodiment

Figure 31:
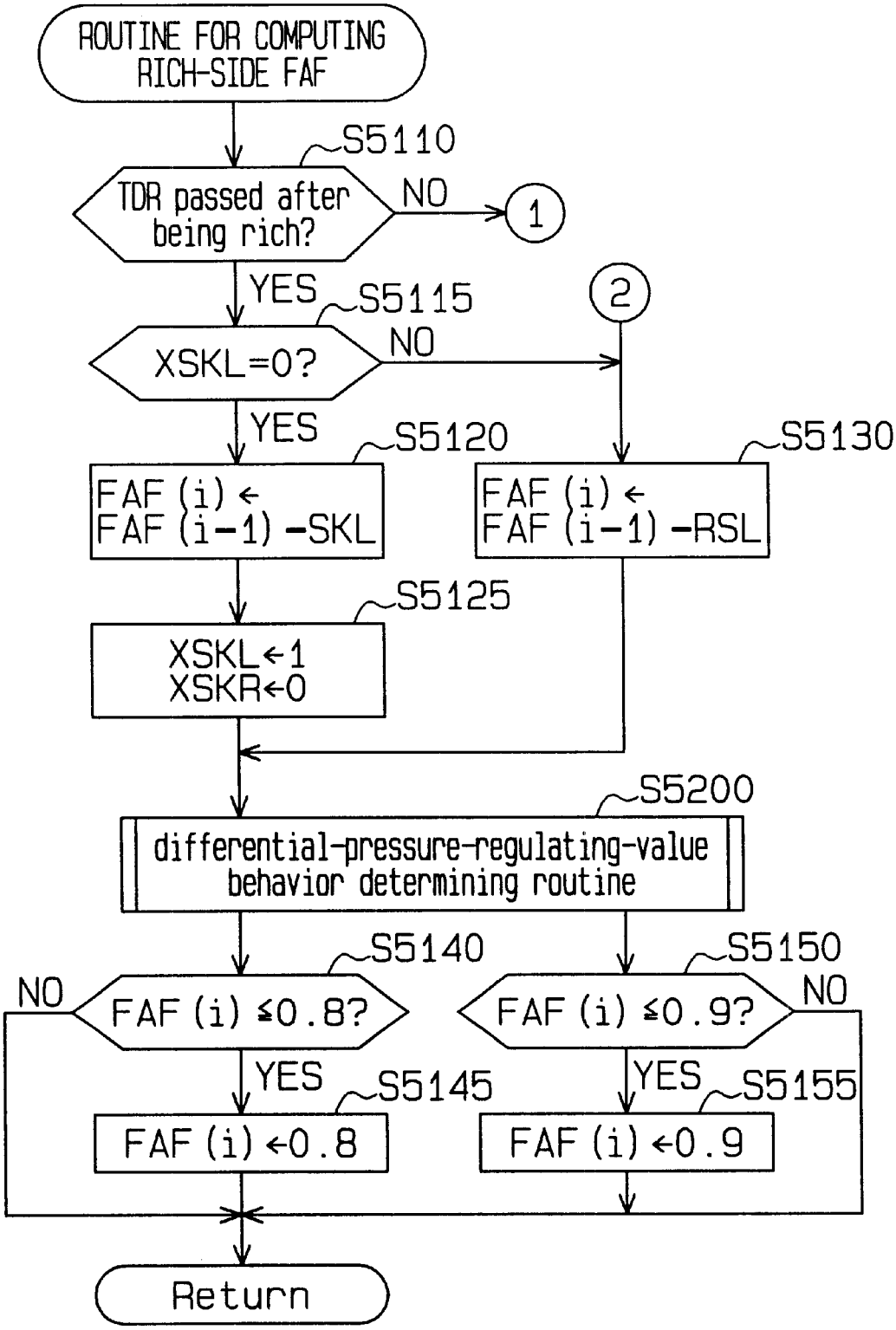
FIG. 31 is a flowchart of a routine for computing the rich-side air-fuel ratio feedback compensation coefficient FAF in a sixth embodiment.

The sixth embodiment differs from the second embodiment in that a routine shown in FIG. 31 is carried out instead of the routine for computing the rich-side air-fuel ratio feedback compensation coefficient FAF (S1100) illustrated in FIG. 9 in the second embodiment. Otherwise, the structure is the same as that of the second embodiment.

In the routine for computing the rich-side air-fuel ratio feedback compensation coefficient FAF shown in FIG. 31, processes in steps S5110–S5155 excluding step S5200 are the same as those in steps S1110–S1155 in FIG. 9. The processes in FIG. 31 in the sixth embodiment that are the same as those of the second embodiment are given reference symbols obtained by adding four thousand to the associated step numbers of the second embodiment, unless otherwise specifically mentioned.

Figure 32:
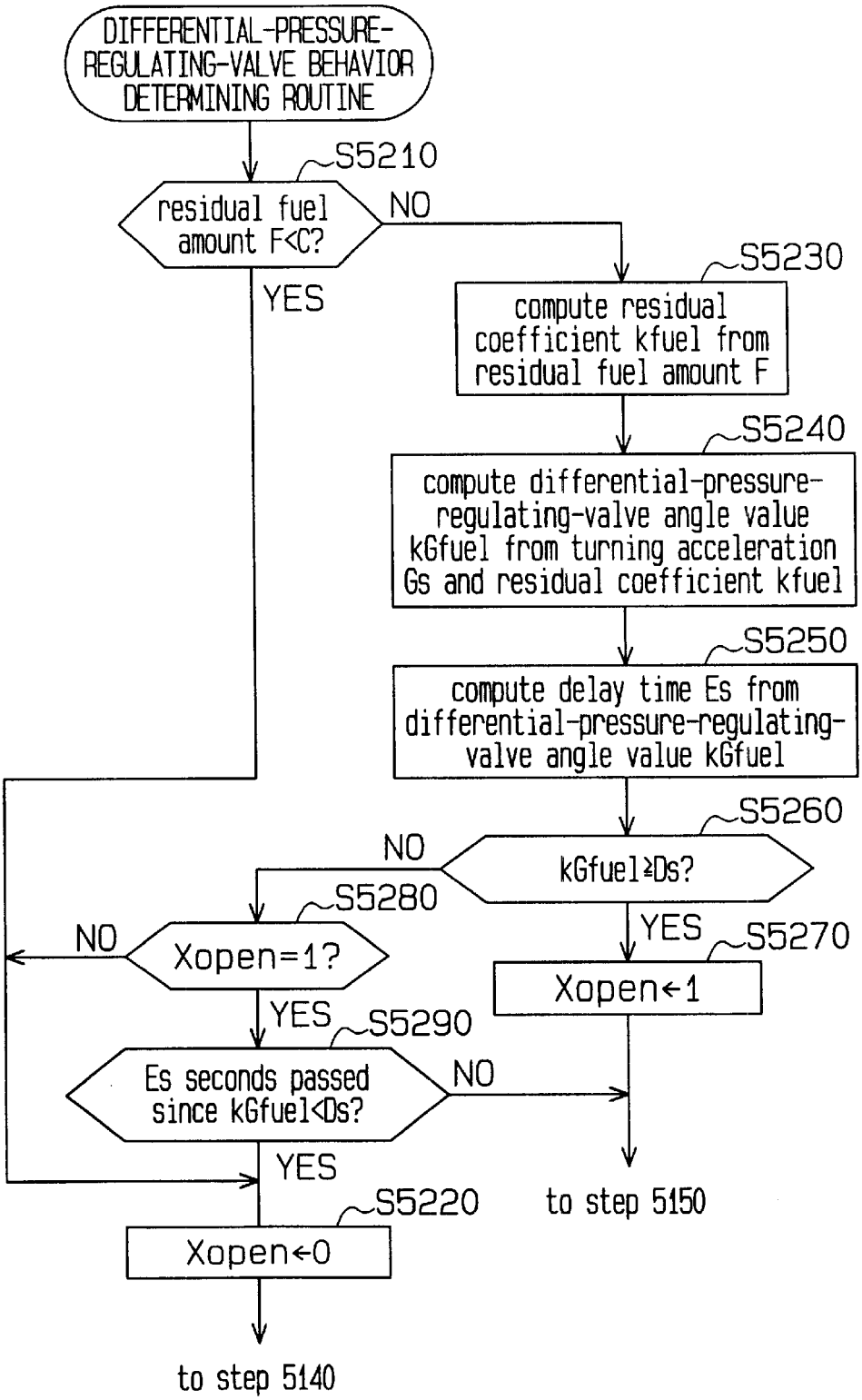
FIG. 32 is a flowchart of a differential-pressure-regulating-valve behavior determining routine in a sixth embodiment.

Step S5200 in FIG. 31 is the process that is executed following step S5125 or step S5130 and determines the behavior of the differential pressure regulating valve 105. This process is illustrated in FIG. 32. In this differential-pressure-regulating-valve behavior determining routine, first, it is determined if the residual fuel amount F detected by the fuel meter 101*b* is smaller than a residual-amount decision value C (S5210). When F<C (YES in S5210), a valve-open Xopen is set to zero (S5220) after which the flow moves to step S5140 to set the lower limit of the air-fuel ratio feedback compensation coefficient FAF(i) to the normal value of 0.8.

Figure 33:
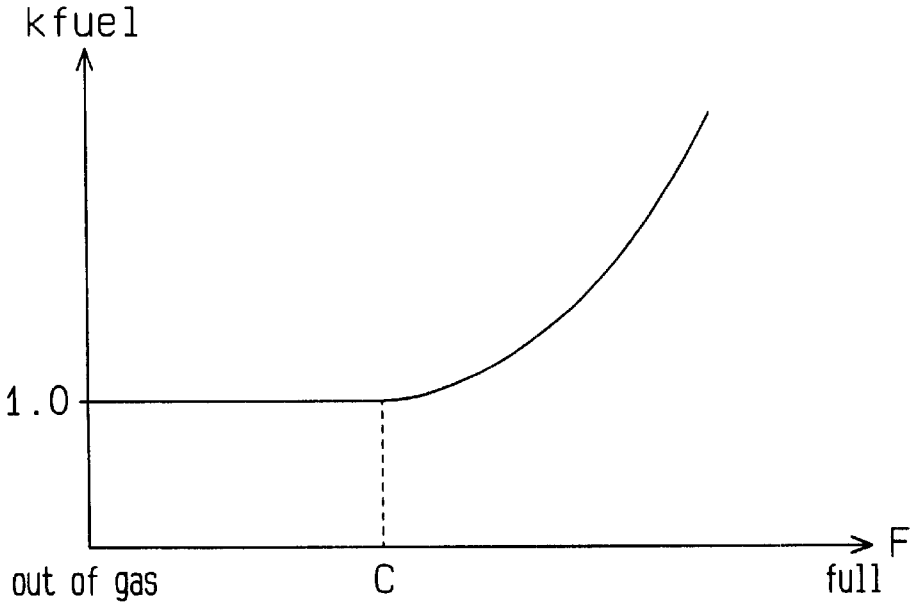
FIG. 33 is an explanatory diagram of a map structure for acquiring a residual coefficient kfuel from a residual fuel amount F in the sixth embodiment.

When F≧C (NO in S5210), a residual coefficient kfuel is computed from the residual fuel amount F based on a map shown in FIG. 33 (S5230). This residual coefficient kfuel indicates the easiness of fuel filling in the circulation line pipe 141 or the fuel feeding pipe 136 and thus represents the degree of how easily the differential pressure regulating valve 105 is opened due to the residual fuel amount F.

Then, a differential-pressure-regulating-valve angle value kGfuel is calculated using the following equation from the product of the turning acceleration Gs, which is obtained in a manner similar to that of the fourth embodiment and the residual coefficient kfuel obtained in step S5230 (S5240). This value kGfuel has a correlation to the pressure of the first pressure chamber 105*b*.

$$kGfuel \leftarrow Gs \cdot kfuel \tag{13}$$

This differential-pressure-regulating-valve angle value kgfuel represents the degree of how easily the differential pressure regulating valve 105 is opened actually, from the easiness of the falling of the fuel in the circulation line pipe 141 or the like affected by the turning acceleration Gs and the residual coefficient kfuel.

Figure 34:
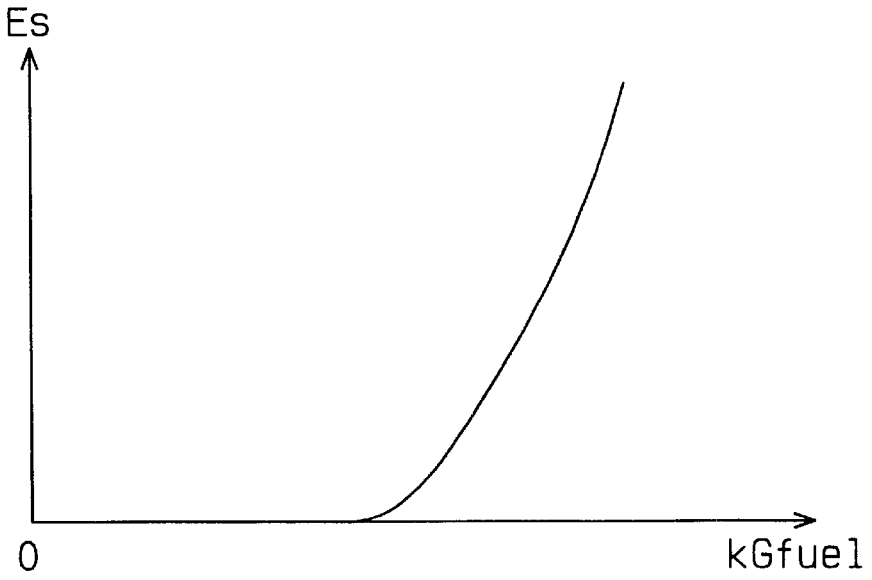
FIG. 34 is an explanatory diagram of a map structure for obtaining a delay time Es from a differential-pressure-regulating-valve angle value kGfuel in the sixth embodiment.

Then, a delay time Es is calculated from the differential-pressure-regulating-valve angle value kGfuel computed in step S5240 based on a map shown in FIG. 34 (S5250). This delay time Es is used for the same purpose as the delay time in the third embodiment or the fifth embodiment is used.

It is then determined if differential-pressure-regulating-valve angle value kgfuel calculated in step S5240 is equal to or greater than a differential-pressure-regulating-valve opening decision value Ds (S5260). If kGfuel<Ds (NO in S5260), it is then determined whether or not the valve-open Xopen is one (S5280). When Xopen=0 (NO in S5280), it is considered that the differential pressure regulating valve 105 is not opened, so that Xopen is set to zero (S5220) after which the flow moves to step S5140 to set the lower limit of the air-fuel ratio feedback compensation coefficient FAF(i) to the normal value of 0.8.

If kGfuel≧Ds (YES in S5260), it is considered that the differential pressure regulating valve 105 is opened, so that Xopen is set to one (S5270) after which the flow proceeds to step S5150 to set the lower limit of the air-fuel ratio feedback compensation coefficient FAF(i) to 0.9 to restrict the reduction of FAF(i).

When kGfuel<Ds is met by the reduction of the turning acceleration Gs or the reduction of the residual coefficient kfuel while the routine of computing the air-fuel ratio feedback compensation coefficient FAF(i) is being performed with the lower limit being 0.9 (NO in S5260), it is determined whether or not if the valve-open flag Xopen is one (S5280). Since the routine of computing the air-fuel ratio feedback compensation coefficient FAF(i) with the lower limit being 0.9 has been carried out so far, Xopen=1 (YES in S5280), so that it is determined if Es seconds have passed since the point of kgfuel<Ds (S5290). While Es seconds have not elapsed (NO in S5290), the flow proceeds to step S5150 so that the lower limit of FAF(i) is kept at 0.9.

When Es seconds have elapsed (YES in S5290), it is considered that the differential pressure regulating valve 105 is closed, so that Xopen is set to zero (S5220) after which the flow proceeds to step S5140 to set the lower limit of the air-fuel ratio feedback compensation coefficient FAF(i) to the normal value of 0.8.

By executing this routine, the sixth embodiment performs control similar to that of the third embodiment shown in FIG. 23.

In the above-described structure, steps S5210, S5230, S5240 and S5260 are equivalent to the process of the determination means that determines the open state of the differential pressure regulating valve 105 based on the turning acceleration Gs and the residual fuel amount F. Steps S5250, S5290, S5150 and S5155 are equivalent to the process of the suppression means that restricts feedback compensation for reducing the fuel concentration and disables this restriction after the delay time Es.

The above-described sixth embodiment has the following advantages.

(1) Advantages (1) and (2) of the third embodiment.

(2) As the opening/closing of the differential pressure regulating valve 105 is determined based on the residual fuel amount F and the turning acceleration Gs, it is possible to determine the possibility of purging of rich fuel vapor more accurately and thus to suppress a change in air-fuel ratio more adequately.

(3) As the delay time Ex is acquired from the residual fuel amount F and the turning acceleration Gs, it is possible to detect the convergence of the fluctuation of the fuel surface in the fuel tank 101 more accurately and thus to suppress a change in air-fuel ratio more adequately.

Seventh Embodiment

Figure 35:
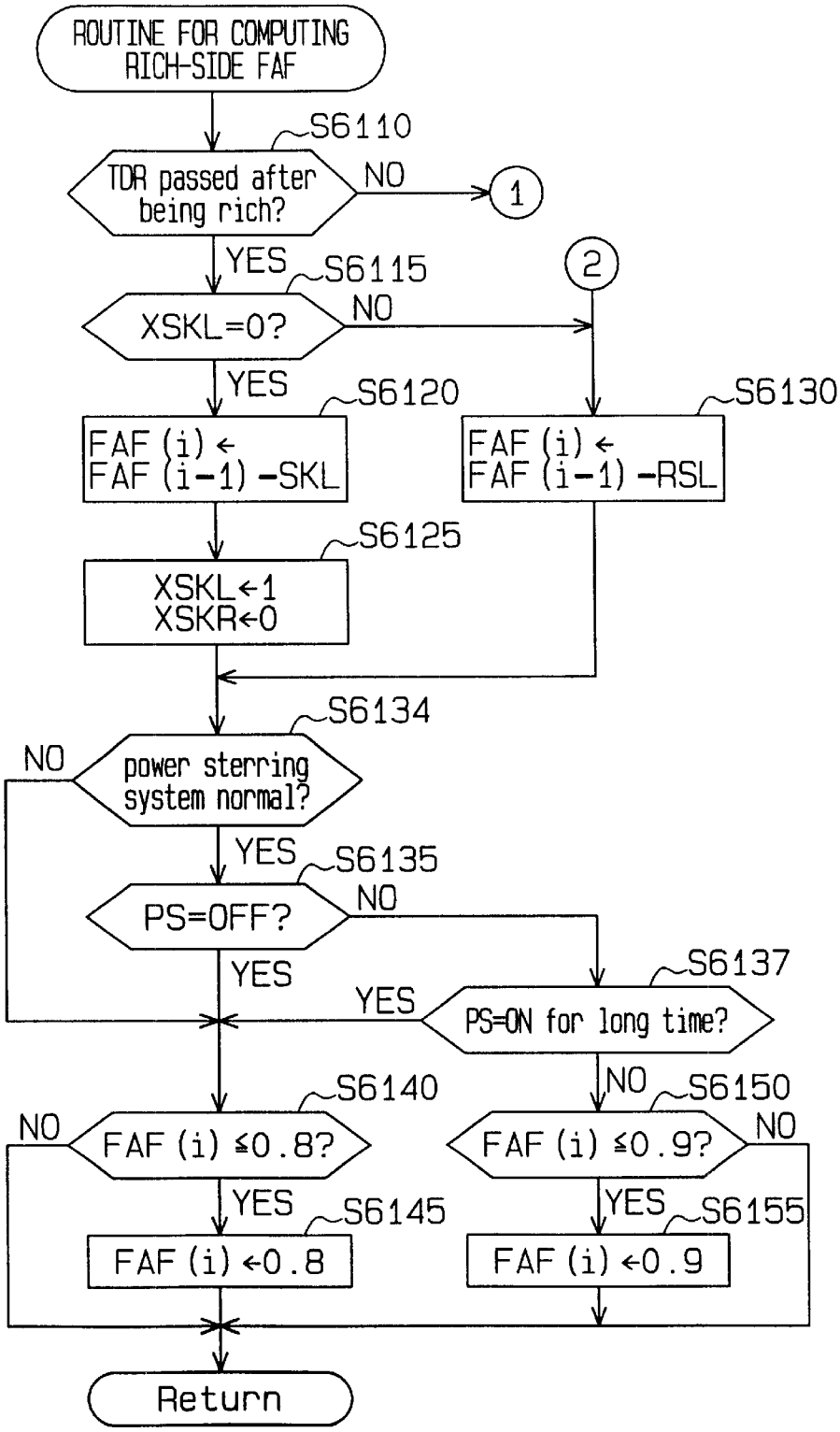
FIG. 35 is a flowchart of a routine for computing the rich-side air-fuel ratio feedback compensation coefficient FAF in a seventh embodiment.

The seventh embodiment differs from the second embodiment in that a routine shown in FIG. 35 is carried out instead of the routine for computing the rich-side air-fuel ratio feedback compensation coefficient FAF (S1100) shown in FIG. 9 in the second embodiment. Otherwise, the structure is the same as that of the second embodiment.

In the routine for computing the rich-side air-fuel ratio feedback compensation coefficient FAF shown in FIG. 35, processes in steps S6110–S6155 excluding steps S6134 and S6137 are the same as those in steps S1110–S1155 in FIG. 9. The processes in FIG. 35 in the seventh embodiment that are the same as those of the second embodiment are given reference symbols obtained by adding five thousand to the associated step numbers of the second embodiment, unless otherwise specifically mentioned.

Step S6134 in FIG. 35 is the process that is executed following step S6125 or step S6130 and determines whether or not the power steering system including the power steering switch 176 is normal. This decision is made, for example, by using the result of diagnosis which is separately executed by the ECU 110.

If the power steering system is not normal (NO in S6134), the routine of restricting the reduction of the air-fuel ratio feedback compensation coefficient FAF based on the signal PS from the power steering switch 176 becomes inaccurate. In this respect, the flow proceeds to step S6140 to set the lower limit of the air-fuel ratio feedback compensation coefficient FAF to the normal value of 0.8.

If the power steering system is normal (YES in S6134), it is determined if the signal PS from the power steering switch 176 is OFF (S6135). When PS=OFF (YES in S6135), the flow moves to step S6140 to set the lower limit of the air-fuel ratio feedback compensation coefficient FAF to the normal value of 0.8.

When PS=ON (NO in S6135), on the other hand, it is determined if the state of PS=ON has continued for a long period of time (S6137). As a reference time for making this decision, a time equal to or greater than the time needed for the vehicle to turn in one direction, for example, when the vehicle is running on a loop bridge, is used. When the time of the continuation of the state of PS=ON is longer than this reference time, it is determined that this continuation time is long. The power steering system may not be normal even when the state of PS=ON continues for a long period of time (YES in S6137), the flow goes to step S6140 to set the lower limit of the air-fuel ratio feedback compensation coefficient FAF to the normal value of 0.8.

Even in the case where it is determined that the state of PS=ON continues for a long period of time while running on a loop bridge or the like when the power steering system is normal, if turning continues for a long period of time, the differential pressure regulating valve 105 that has been open is gradually closed. In view of this phenomenon, if PS=ON (YES in S6137), the flow goes to step S6140 to set the lower limit of the air-fuel ratio feedback compensation coefficient FAF to the normal value of 0.8.

When PS=ON (NO in S6135) and this state is short (NO in S6137), the differential pressure regulating valve 105 is open so that the flow proceeds to step S6150 to set the lower limit of the air-fuel ratio feedback compensation coefficient FAF to 0.9 to restrict the reduction of FAF.

In the above-described structure, steps S6135 and S6137 are equivalent to the process of the determination means that determines the open state of the differential pressure regulating valve 105 based on the presence or absence of the auxiliary steering force as the turning state and determines that this valve 105 is closed when the turning state continues for a time equal to or longer than the reference time. Further, steps S6150 and S6155 are equivalent to the process of the suppression means that restricts feedback compensation for reducing the fuel concentration during air-fuel ratio feedback control.

The above-described seventh embodiment has the following advantages.

(1) Advantages as the advantages (1) and (2) of the second embodiment.

(2) When the power steering system is normal, the lower limit of the air-fuel ratio feedback compensation coefficient FAF is set to 0.9. This prevents inadequate restriction of the air-fuel ratio feedback compensation coefficient FAF under air-fuel ratio feedback control, thereby allowing the engine 100 to maintain stable combustion.

(3) Even with PS=ON (NO in S6135), if turning continues for a long time, the disturbance of the fuel surface in the fuel tank 101 gradually becomes smaller, causing the differential pressure regulating valve 105 that has been opened to be slowly closed. In view of this phenomenon, when the turning state of the vehicle continues for a time equal to or greater than the reference time (YES in S6137), it is determined that the differential pressure regulating valve 105 has been closed, so that the lower limit of the air-fuel ratio feedback compensation coefficient FAF is set back to the normal value of 0.8. This process permits the routine of suppressing a change in air-fuel ratio to be executed adequately.

Eighth Embodiment

Figure 36:
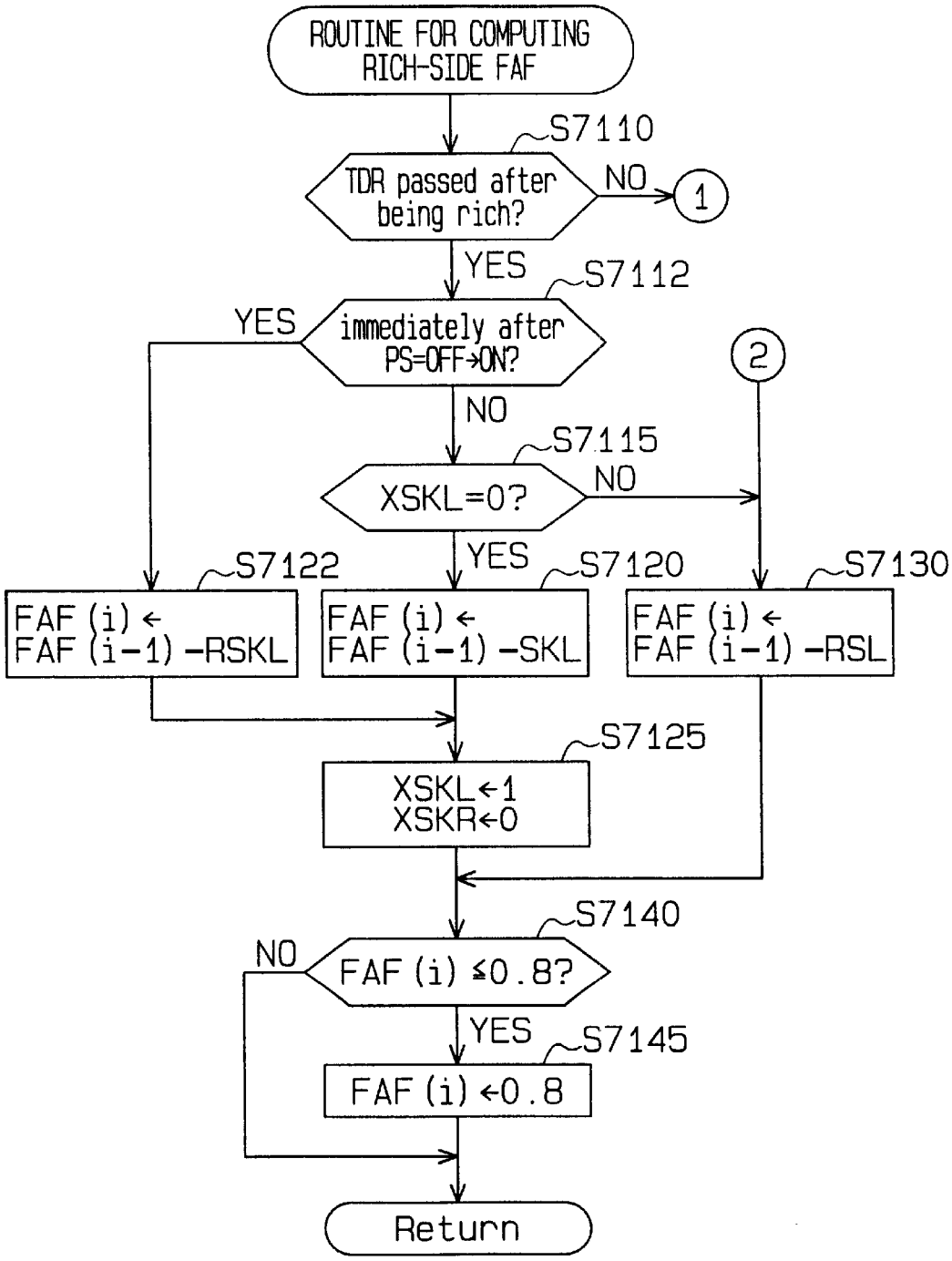
FIG. 36 is a flowchart of a routine for computing the rich-side air-fuel ratio feedback compensation coefficient FAF in an eighth embodiment.
Figure 37:
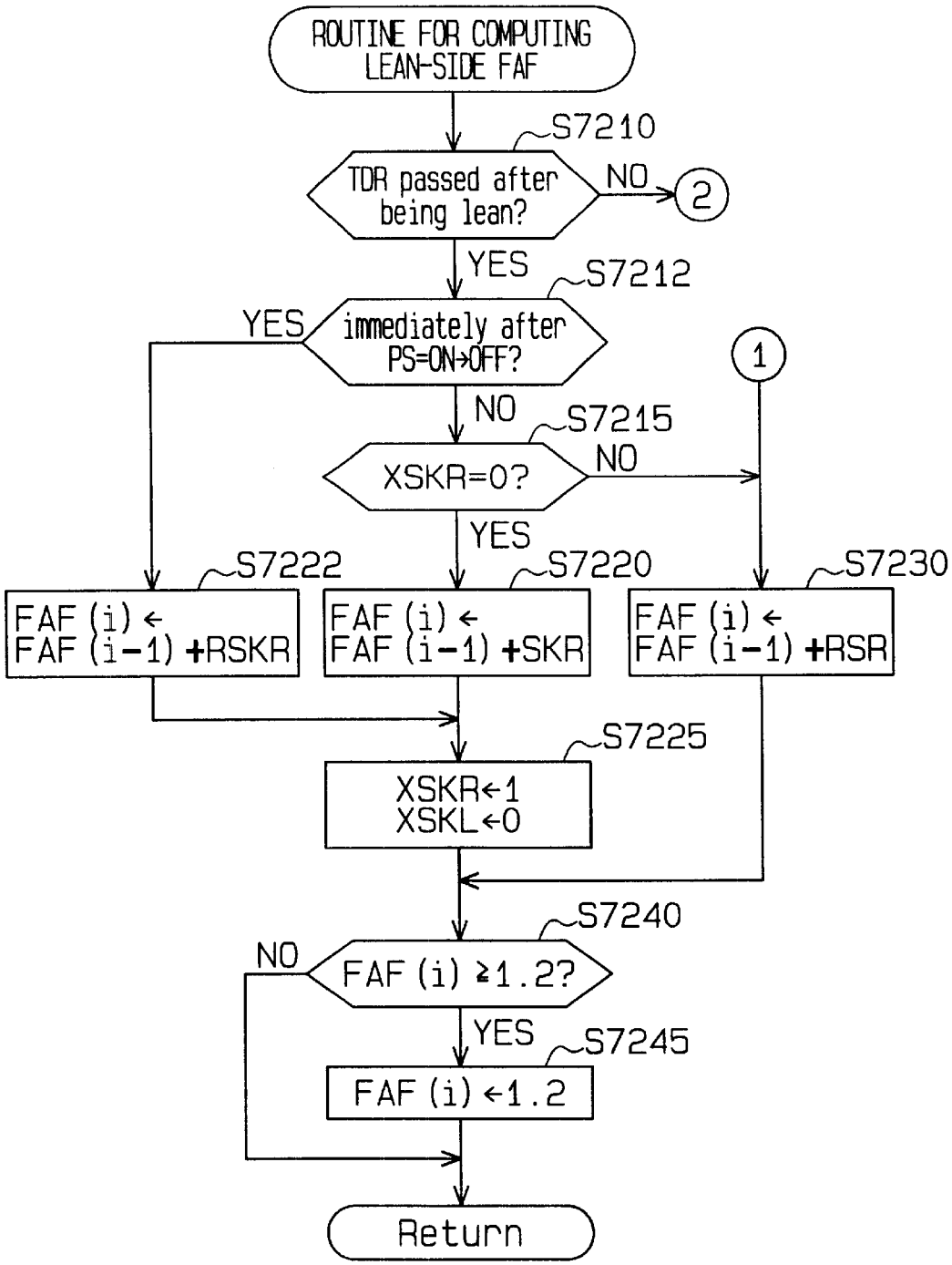
FIG. 37 is a flowchart of a routine for computing the lean-side air-fuel ratio feedback compensation coefficient FAF in the eighth embodiment.

The eighth embodiment differs from the second embodiment in that a routine shown in FIG. 36 is carried out instead of the routine for computing the rich-side air-fuel ratio feedback compensation coefficient FAF (S1100) in FIG. 9 in the second embodiment, and a routine shown in FIG. 37 is carried out instead of the routine for computing the lean-side air-fuel ratio feedback compensation coefficient FAF (S1200) shown in FIG. 10 in the second embodiment. Otherwise, the structure is the same as that of the second embodiment.

The routine for computing the rich-side air-fuel ratio feedback compensation coefficient FAF shown in FIG. 36 will now be discussed. The process in step S7110 is the same as that in step S1110 in the second embodiment.

When the decision in step S7110 is YES, it is then determined if the signal PS from the power steering switch 176 has just been switched to ON from OFF (S7112). At the time a vehicle turns, it is likely that the surface of the fuel in the fuel tank 101 fluctuates, particularly immediately after the turning action takes place, causing the differential pressure regulating valve 105 to open. Therefore, when it is determined that the state of PS has just been switched to ON from OFF, it is possible to determine that it is the beginning of the opening of the differential pressure regulating valve 105.

If it is immediately after the switching of PS to ON from OFF (YES in S7112), the current air-fuel ratio feedback compensation coefficient FAF(i) is acquired by subtracting the lean skip amount RSKL for the differential pressure regulating valve open from the previous air-fuel ratio feedback compensation coefficient FAF(i−1) (S7122) based on the following equation 14.

$$FAF(i) \leftarrow FAF(i-1) - RSKL \tag{14}$$

The lean skip amount RSKL for the differential pressure regulating valve open in the equation 14 has a relation of RSKL>SKL with respect to the lean skip amount SKL in the equation 4 mentioned in the foregoing description of the second embodiment, e.g., RSKL=2·SKL. In other words, if it is immediately after the switching of PS to ON from OFF (YES in S7112), a larger lean skip than normal is performed to make the speed of reducing the fuel concentration in the air-fuel ratio faster than normal.

If it is not immediately after the switching of PS to ON from OFF (NO in S7112), it is determined if the lean skip flag XSKL is zero (S7115). When XSKL=0 (YES in S7115), the current air-fuel ratio feedback compensation coefficient FAF(i) is acquired by subtracting the lean skip amount SKL from the previous air-fuel ratio feedback compensation coefficient FAF(i−1) based on the aforementioned equation 4 (S7120).

After the process in step S7120 or step S7122, the lean skip flag XSKL is set to one and the rich skip flag XSKR to zero (S7125).

When XSKL=1 (NO in S7115), the current air-fuel ratio feedback compensation coefficient FAF(i) is acquired by subtracting the lean integration value RSL from the previous air-fuel ratio feedback compensation coefficient FAF(i−1) based on the equation 5 mentioned in the foregoing description of the second embodiment (S7130).

After the process in step S7125 or step S7130, it is determined if the currently computed air-fuel ratio feedback compensation coefficient FAF(i) is equal to or smaller than the normal lower limit of 0.8 (S7140). When FAF(i)≦0.8 (YES in S7140), therefore, 0.8 is set to FAF(i) (S7145) after which the ECU 110 leaves this routine. When FAF(i)>0.8 (NO in S7140), on the other hand, the ECU 110 leaves this routine with FAF(i) unchanged.

The routine for computing the lean-side air-fuel ratio feedback compensation coefficient FAF shown in FIG. 37 will now be discussed. The process in step S7210 is the same as that in step S1210 in the second embodiment.

When the decision in step S7210 is YES, it is then determined if the signal PS from the power steering switch 176 has just been switched to OFF from ON (S7212). This decision is made to determine the timing of closing the differential pressure regulating valve 105.

If it is immediately after the switching of PS to OFF from ON (YES in S7212), the current air-fuel ratio feedback compensation coefficient FAF(i) is acquired by adding the rich skip amount RSKR for the differential pressure regulating valve closed to the previous air-fuel ratio feedback compensation coefficient FAF(i−1) (S7222) based on the following equation 15.

$$FAF(i) \leftarrow FAF(i-1) - RSKR \quad (15)$$

The rich skip amount RSKR for the differential pressure regulating valve closed in the equation 15 has a relation of RSKR>SKR with respect to the rich skip amount SKR in the equation 6 mentioned in the foregoing description of the second embodiment, e.g., RSKR=2·ESKR. In other words, if it is immediately after the switching of PS to OFF from ON (YES in S7212), a larger rich skip than that in the normal case is performed to make the speed of increasing the fuel concentration in the air-fuel ratio faster than the normal speed.

If it is not immediately after the switching of PS to OFF from ON (NO in S7212), it is determined if the rich skip flag XSKR is zero (S7215). When XSKR=zero (YES in S7215), the current air-fuel ratio feedback compensation coefficient FAF(i) is acquired by adding the rich skip amount SKR to the previous air-fuel ratio feedback compensation coefficient FAF(i−1) based on the aforementioned equation 6 (S7220).

After the process in step S7220 or step S7222, the rich skip flag XSKR is set to one and the lean skip flag XSKL to zero (S7225).

When XSKR=1 (NO in S7215), the current air-fuel ratio feedback compensation coefficient FAF(i) is acquired by adding the rich integration value RSR to the previous air-fuel ratio feedback compensation coefficient FAF(i−1) based on the equation 7 mentioned in the foregoing description of the second embodiment (S7230).

After the process in step S7225 or step S7230, it is determined if the currently computed air-fuel ratio feedback compensation coefficient FAF(i) is equal to or greater than the normal upper limit of 1.2 (S7240). When FAF(i)≧1.2 (YES in S7240), therefore, 1.2 is set to FAF(i) (S7245) after which the ECU 110 leaves this routine. When FAF(i)<1.2 (NO in S7240), on the other hand, the ECU 110 leaves this routine with FAF(i) unchanged.

Figure 38:
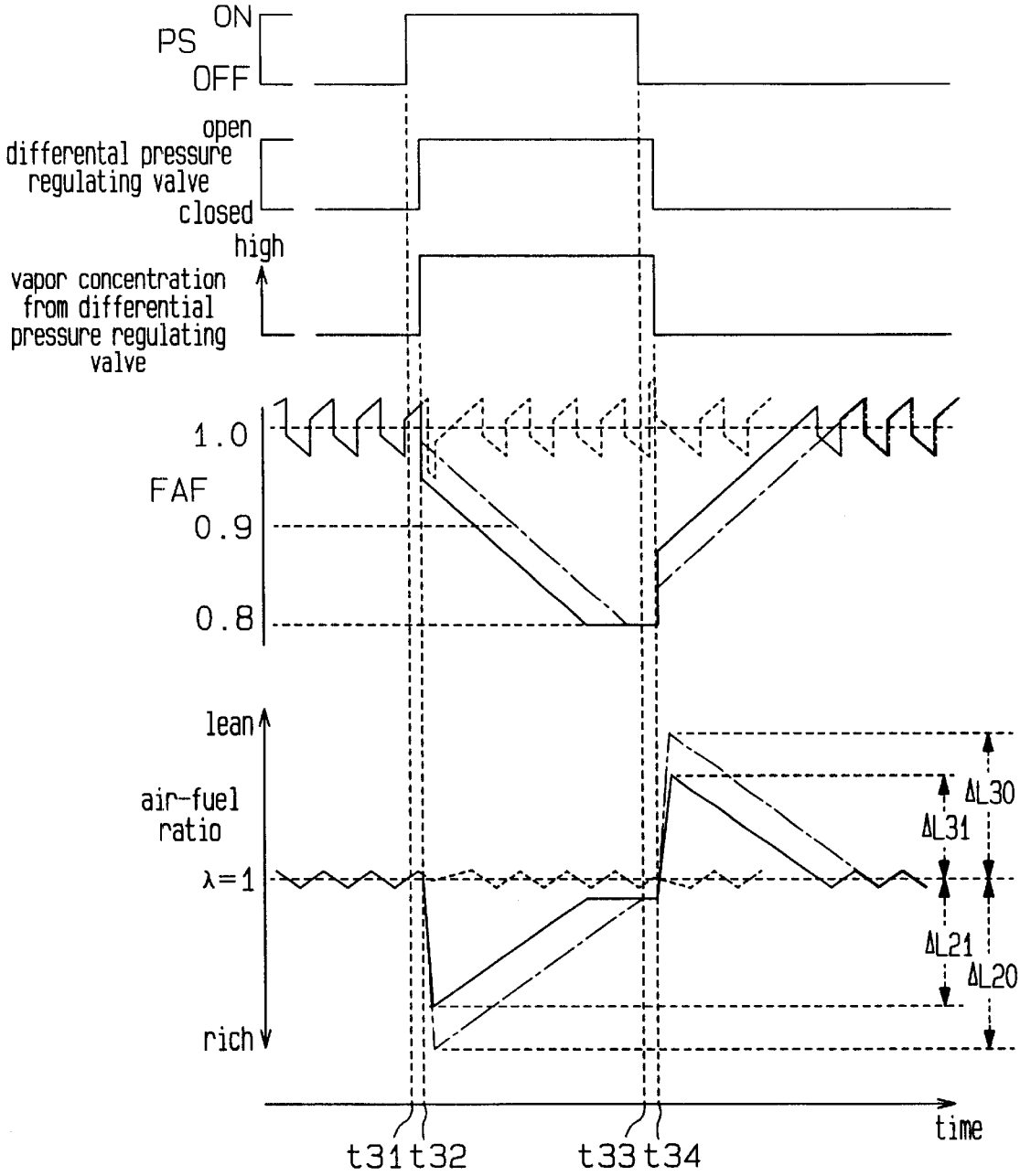
FIG. 38 is a timing chart showing the advantages of the eighth embodiment.

One example of the control that is implemented in the eighth embodiment with the above-described structure is illustrated in the timing chart in FIG. 38. FIG. 38 shows that the signal PS from the power steering switch 176 is ON at time t31 and it is OFF at time t34.

At this time, when the differential pressure regulating valve 105 is opened after time t32 as a result of the switching of the signal PS from the power steering switch 176 to the ON state from the OFF state at timing t31 as indicated by the solid line, causing rich fuel vapor to be purged to the air-intake passage 109, the air-fuel ratio is shifted significantly toward the rich side. At this time, the air-fuel ratio feedback compensation coefficient FAF is made smaller by using the lean skip amount RSKL for the differential pressure regulating valve open which is larger than the lean skip amount SKL that is used normally. As a result, the air-fuel ratio feedback compensation coefficient FAF drops more rapidly than that where the air-fuel ratio feedback compensation coefficient FAF is reduced by using the lean skip amount SKL indicated by the single dashed chain line. A change ΔL21 in the air-fuel ratio toward the rich side can therefore be smaller than a change ΔL20 in the case where the lean skip amount SKL is used.

When the differential pressure regulating valve 105 is closed after timing t34 as a result of the switching of the signal PS from the power steering switch 176 to the OFF state from ON state at timing t33 as indicated by the solid line, disabling the purging of rich fuel vapor, the air-fuel ratio is shifted significantly toward the lean side. At this time, the air-fuel ratio feedback compensation coefficient FAF is increased by using the rich skip amount RSKR for the differential pressure regulating valve closed which is larger than the rich skip amount SKR that is used normally. As a result, the air-fuel ratio feedback compensation coefficient FAF increases more rapidly than that in the case where the air-fuel ratio feedback compensation coefficient FAF is increased by using the rich skip amount SKR indicated by the single dashed chain line. A change ΔL31 in the air-fuel ratio toward the lean side can therefore be smaller than a change ΔL30 in the case where the rich skip amount SKR is used.

In the above-described structure, steps S7112 and S7212 are equivalent to the process of the determination means that determines the transition of the state of the differential pressure regulating valve 105 from the open state to the closed state or vice versa. Steps S7122 and S7222 are equivalent to the process of the suppression means that temporarily quickens feedback compensation for reducing and increasing the fuel concentration.

The above-described eighth embodiment has the following advantages.

(1) The same advantage as the advantage (1) of the second embodiment.

(2) If immediately after the differential pressure regulating valve 105 has just opened, the lean skip amount RSKL for the differential pressure regulating valve is used to reduce the fuel concentration, thereby temporarily quickening the reducing compensation under air-fuel ratio feedback control. This can promptly deal with the rich state of the fuel concentration. If the differential pressure regulating valve 105 has just closed, the rich skip amount RSKR for the closed differential pressure regulating valve is used to increase the fuel concentration, thereby temporarily quickening the increasing compensation under air-fuel ratio feedback control. This can promptly deal with the lean state of the fuel concentration. Changes in the air-fuel ratio are limited in this manner.

Ninth Embodiment

Figure 39:
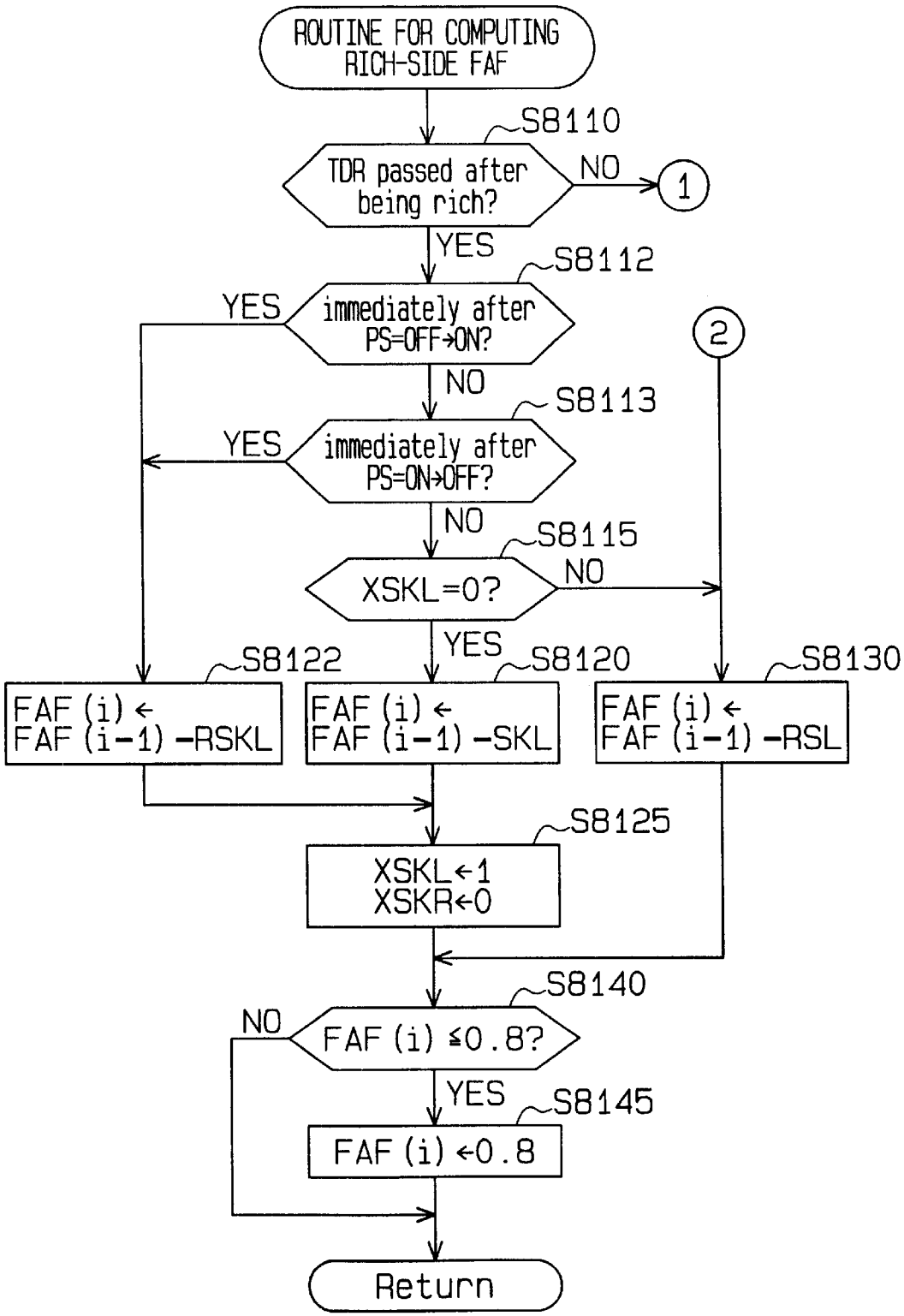
FIG. 39 is a flowchart of a routine for computing the rich-side air-fuel ratio feedback compensation coefficient FAF in a ninth embodiment.

The ninth embodiment differs from the eighth embodiment in that a routine shown in FIG. 39 is carried out instead of the routine for computing the rich-side air-fuel ratio feedback compensation coefficient FAF in FIG. 36 in the eighth embodiment. Otherwise, the structure is the same as that of the eighth embodiment.

The routine for computing the rich-side air-fuel ratio feedback compensation coefficient FAF shown in FIG. 39 will now be discussed. The process in step S8110 is the same as that in step S1110 in the second embodiment.

When the decision in step S8110 is YES, it is then determined if the signal PS from the power steering switch 176 has just been switched to ON from OFF (S8112). If it is immediately after the switching of PS to ON from OFF (YES in S8112), the current air-fuel ratio feedback compensation coefficient FAF(i) is acquired by subtracting the lean skip amount RSKL for the differential pressure regulating valve open from the previous air-fuel ratio feedback compensation coefficient FAF(i−1) (S8122) based on the equation 14 mentioned in the previous section of the eighth embodiment.

If it is not immediately after the switching of PS to ON from OFF (NO in S8112), it is then determined whether or not it is immediately after the switching of the signal PS from the power steering switch 176 from ON to OFF (S8113).

When turning continues for a long period of time as discussed in the section of the seventh embodiment, the differential pressure regulating valve 105 is closed. Even when the vehicle returns to normal straight driving from turning, the fuel surface, which has been stable in the long turning state, is disturbed again as the turning motion stops. There is therefore a possibility that the differential pressure regulating valve 105 will open when the turning motion stops, however short it is. Step S8113 is provided to detect and deal with the opening of the differential pressure regulating valve 105 in such a case.

If it is immediately after the switching of PS to OFF from ON (YES in S8113), the current air-fuel ratio feedback compensation coefficient FAF(i) is acquired by subtracting the lean skip amount RSKL for the differential pressure regulating valve open from the previous air-fuel ratio feedback compensation coefficient FAF(i−1) based on the equation 14 (S8122).

If it is not immediately after the switching of PS to OFF from ON (NO in S8113), it is determined if the lean skip flag XSKL is zero (S8115). When XSKL=0 (YES in S8115), the current air-fuel ratio feedback compensation coefficient FAF (i) is acquired by subtracting the lean skip amount SKL from the previous air-fuel ratio feedback compensation coefficient FAF(i−1) based on the aforementioned equation 4 (S8120).

After the process in step S8120 or step S8122, the lean skip flag XSKL is set to one and the rich skip flag XSKR to zero (S8125).

When XSKL=1 (NO in S8115), the current air-fuel ratio feedback compensation coefficient FAF(i) is acquired by subtracting the lean integration value RSL from the previous air-fuel ratio feedback compensation coefficient FAF(i−1) based on the equation 5 mentioned in the section of the second embodiment (S8130).

After the process in step S8125 or step S8130, the ECU 110 guards the current air-fuel ratio feedback compensation coefficient FAF(i) with the lower limit of 0.8 in steps S8140 and S8145 as discussed in the descriptions on steps S7140 and S7145 of the eighth embodiment before leaving this routine.

In the above-described structure, steps S8112 and S8113 are equivalent to the process of the determination means that determines the state immediately after the state of the differential pressure regulating valve 105 has been changed to the open state from the closed one. Step S8122 is equivalent to the process of the suppression means that temporarily expedites feedback compensation for reducing the fuel concentration.

The above-described ninth embodiment has the following advantages.

(1) Advantages (1) and (2) of the eighth embodiment.

(2) Even in the routine for computing the rich-side air-fuel ratio feedback compensation coefficient FAF, when the state immediately after the switching of PS to OFF from ON is detected, feedback compensation for reducing the fuel concentration is temporarily expedited, thus ensuring suppression of a change in air-fuel ratio over a wider range.

Tenth Embodiment

Figure 40:
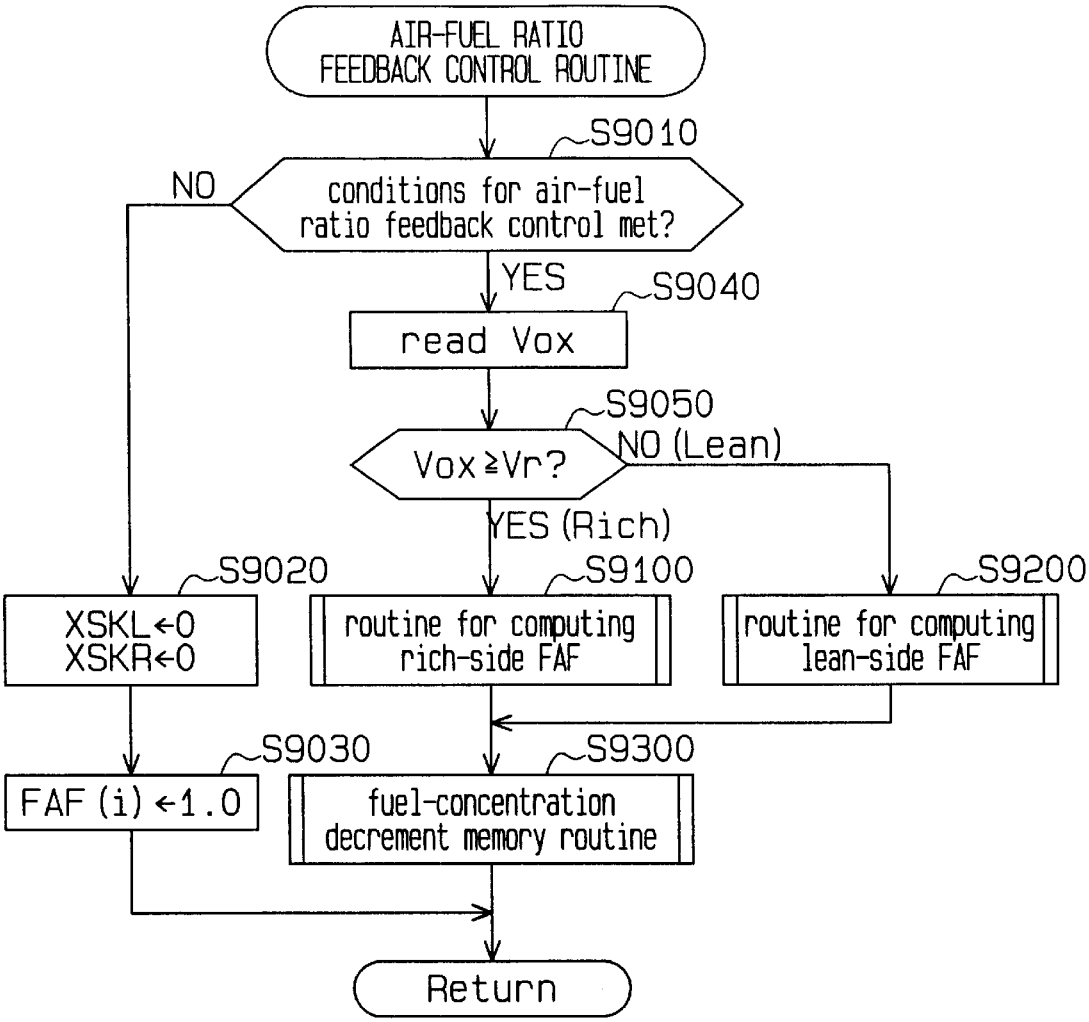
FIG. 40 is a flowchart of an air-fuel ratio feedback control routine in a tenth embodiment.

The tenth embodiment differs from the eighth embodiment in that a routine shown in FIG. 40 is executed instead of the air-fuel ratio feedback control routine in FIG. 8. Otherwise, the structure is the same as that of the eighth embodiment.

In the air-fuel ratio feedback control routine illustrated in FIG. 40, processes in steps S9010 to S9050 are the same as those in steps S1010–S1050 in FIG. 8 of the second embodiment. Step S9100 is the same as the routine illustrated in FIG. 36 of the eighth embodiment, and step S9200 is the same as the routine illustrated in FIG. 37.

The tenth embodiment also differs from the eighth embodiment in that a fuel-concentration decrement memory routine (S9300) is performed after the routine for computing the rich-side air-fuel ratio feedback compensation coefficient FAF (S9100) or the routine for computing the lean-side air-fuel ratio feedback compensation coefficient FAF (S9200).

Figure 41:
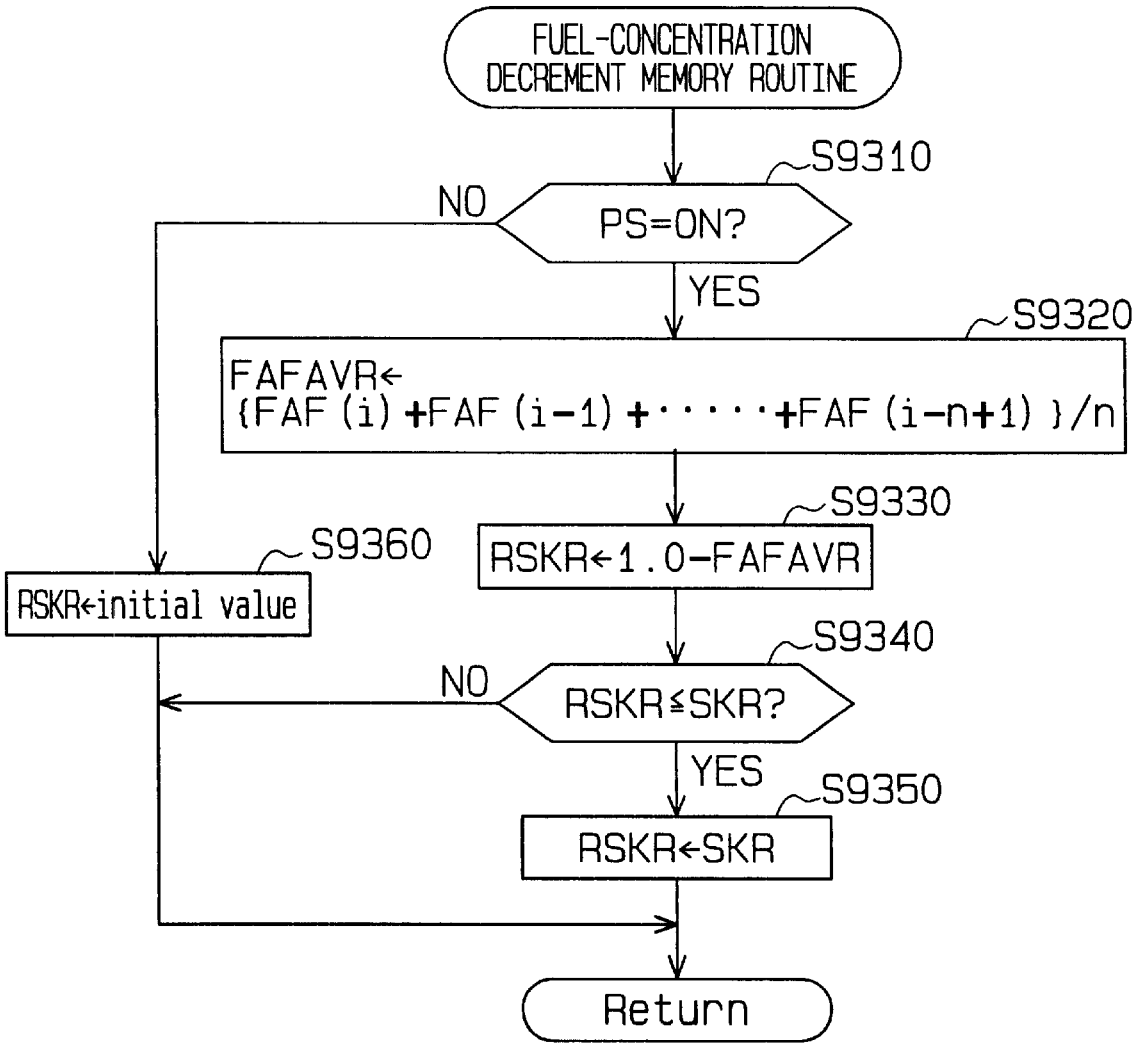
FIG. 41 is a flowchart of a fuel-concentration decrement memory routine in the tenth embodiment.

This fuel-concentration decrement memory routine (S9300) is illustrated in the flowchart of FIG. 41. In this routine, first, it is determined if the power steering switch 176 is ON (S9310). When PS=OFF (NO in S9310), the initial value is set to the rich skip amount RSKR for the differential pressure regulating valve closed (S9360) and then the flow leaves this routine. The initial value of this rich skip amount RSKR has a relation of RSKR>SKR with respect to the rich skip amount SKR, e.g., RSKR=2·SKR.

When PS=ON (YES in S9310), on the other hand, a fuel-concentration decrement memory value FAFAVR is computed by the following equation (S9320).

$$FAFAVR \leftarrow \{FAF(i)+FAF(i-1)+\ldots+FAF(i-n+1)\}/n \quad (16)$$

where FAF(i−n+1) is equivalent to the air-fuel ratio feedback compensation coefficient FAF that has been obtained in the n−1 control cycles earlier. That is, the average value of n air-fuel ratio feedback compensation coefficients FAF that have been consecutively acquired in the time sequence, including the current air-fuel ratio feedback compensation coefficient FAF(i), is obtained as the fuel-concentration decrement memory value FAFAVR. This allows the latest average value of n air-fuel ratio feedback compensation coefficients FAF to be obtained when the state of PS=ON continues. When the number of computations of the air-fuel ratio feedback compensation coefficients FAF since the state of PS=ON has started does not reach n, the average value of the air-fuel ratio feedback compensation coefficients FAF that have been acquired so far is set to the fuel-concentration decrement memory value FAFAVR.

The rich skip amount RSKR for the differential pressure regulating valve closed is computed based on the fuel-concentration decrement memory value FAFAVR as given by the following equation 17 (S9330).

$$RSKR \leftarrow 1.0 - FAFAVR \quad (17)$$

Then, it is determined if the rich skip amount RSKR for the differential pressure regulating valve closed, obtained in this manner, is equal to or smaller than the rich skip amount SKR (S9340). When RSKR>SKR (NO in S9340), the flow just leaves this routine.

When RSKR≦SKR (YES in S9340), on the other hand, the value of the rich skip amount SKR is set to the rich skip amount RSKR for the differential pressure regulating valve closed (S9350) so that the rich skip amount RSKR does not become smaller than the rich skip amount SKR. After this guarding process, the flow leaves this routine.

Figure 42:
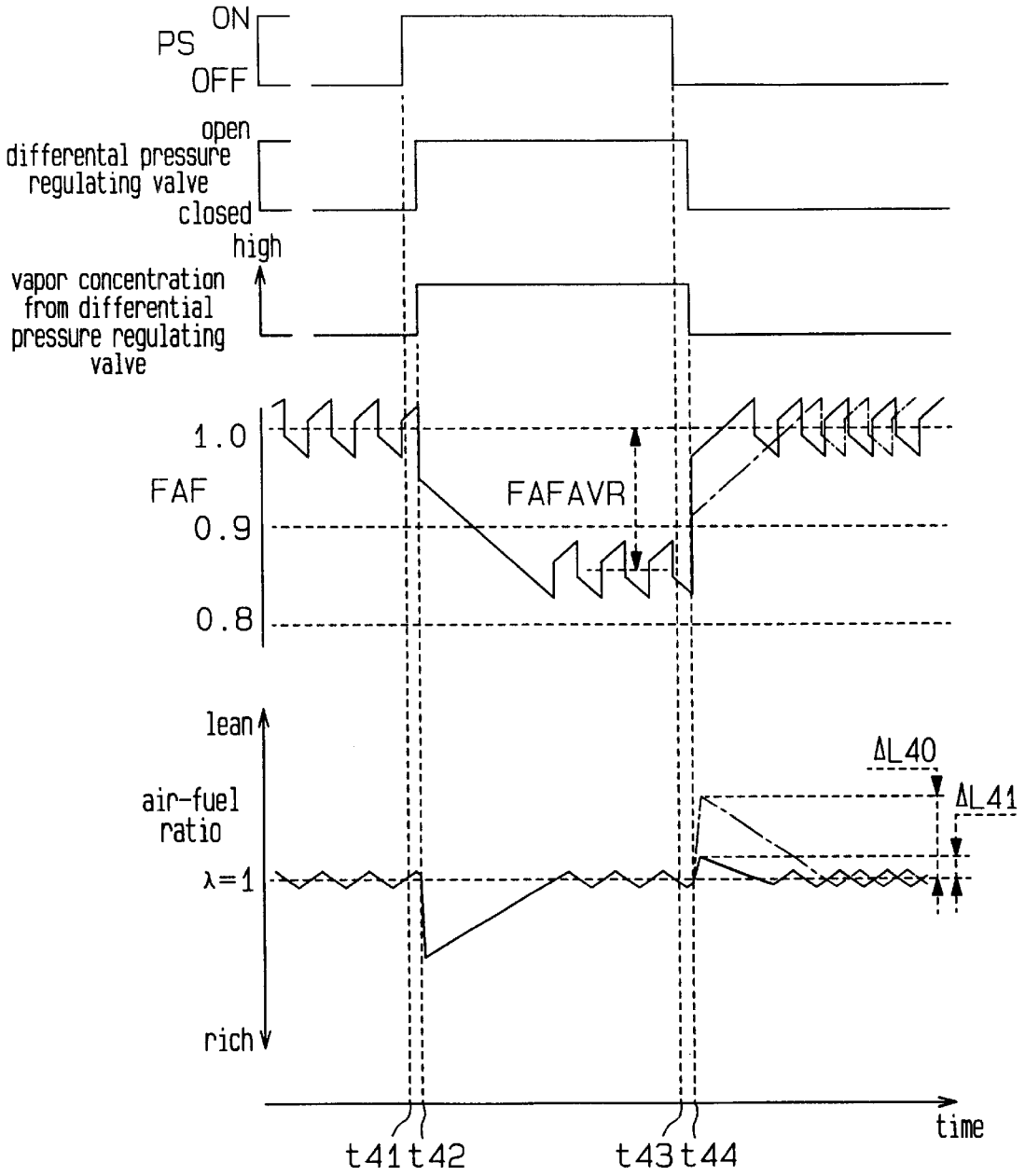
FIG. 42 is a timing chart showing the advantages of the tenth embodiment.

One example of the control that is implemented in the tenth embodiment with the above-described structure is illustrated in the timing chart in FIG. 42. FIG. 42 shows that the signal PS from the power steering switch 176 is ON at timing t41 and it is OFF at timing t43.

At this time, when the differential pressure regulating valve 105 is opened after timing t42 as a result of the switching of the signal PS from the power steering switch 176 to ON from OFF at timing t41 as indicated by the solid line, causing rich fuel vapor to be purged to the air-intake passage 109, the air-fuel ratio is shifted significantly toward the rich side. At this time, the air-fuel ratio feedback compensation coefficient FAF is decreased by using the lean skip amount RSKL for the differential pressure regulating valve open which is larger than the lean skip amount SKL that is used normally, as per the eighth embodiment. As a result, the air-fuel ratio feedback compensation coefficient FAF drops rapidly. A change in the air-fuel ratio toward the rich side can therefore be smaller.

When the differential pressure regulating valve 105 is closed after timing t44 as a result of the switching of the signal PS from the power steering switch 176 to OFF from ON at timing t43 as indicated by the solid line, disabling the purging of rich fuel vapor, the air-fuel ratio is shifted significantly toward the lean side. At this time, the air-fuel ratio feedback compensation coefficient FAF is increased by using the rich skip amount RSKR for the differential pressure regulating valve closed, not the rich skip amount SKR that is used normally. This rich skip amount RSKR reflects the fuel-concentration decrement memory value FAFAVR that indicates the degree of reduction of the air-fuel ratio feedback compensation coefficient FAF in the state immediately before PS=ON through the fuel-concentration decrement memory routine. Accordingly, the air-fuel ratio feedback compensation coefficient FAF can be increased so that the air-fuel ratio instantly becomes approximately equal to the theoretical air-fuel ratio as indicated by the solid line, as compared with the case where the air-fuel ratio feedback compensation coefficient FAF is increased by using the fixed rich skip amount RSKR for the closed differential pressure regulating valve as in the eighth embodiment, as indicated by the single dashed chain line. A change ΔL41 in the air-fuel ratio toward leanness can therefore be smaller than a change ΔL40 in the case of the eighth embodiment.

In the above-described structure, step S9310 is equivalent to the process of the determination means that determines whether the differential pressure regulating valve 105 is open, and steps S9320 and S9330 are equivalent to the process of the suppression means that temporarily executes feedback compensation for memorizing the degree of air-fuel ratio feedback compensation for reducing the fuel concentration under air-fuel ratio feedback control when it is determined that the valve 105 is open and increasing the fuel concentration in accordance with the memorized degree of air-fuel ratio feedback compensation stored when it is determined that the valve 105 has changed its state from the open state to the closed state.

The above-described tenth embodiment has the following advantages.

(1) Advantages (1) and (2) of the eighth embodiment.

(2) The degree of air-fuel ratio feedback compensation that has become necessary as a result of the switching of the state of the differential pressure regulating valve 105 to the open state from the closed one is stored as the fuel-concentration decrement memory value FAFAVR or the rich skip amount RSKR for the differential pressure regulating valve closed. It is therefore possible to accurately find out how insufficient the fuel concentration is from the fuel-concentration decrement memory value FAFAVR or the rich skip amount RSKR when the state of the differential pressure regulating valve 105 has changed to the closed state from the open one. It is therefore possible to completely prevent the fuel concentration from being shifted to the lean side, thus suppressing a change in air-fuel ratio toward the lean side.

Eleventh Embodiment

Figure 43:
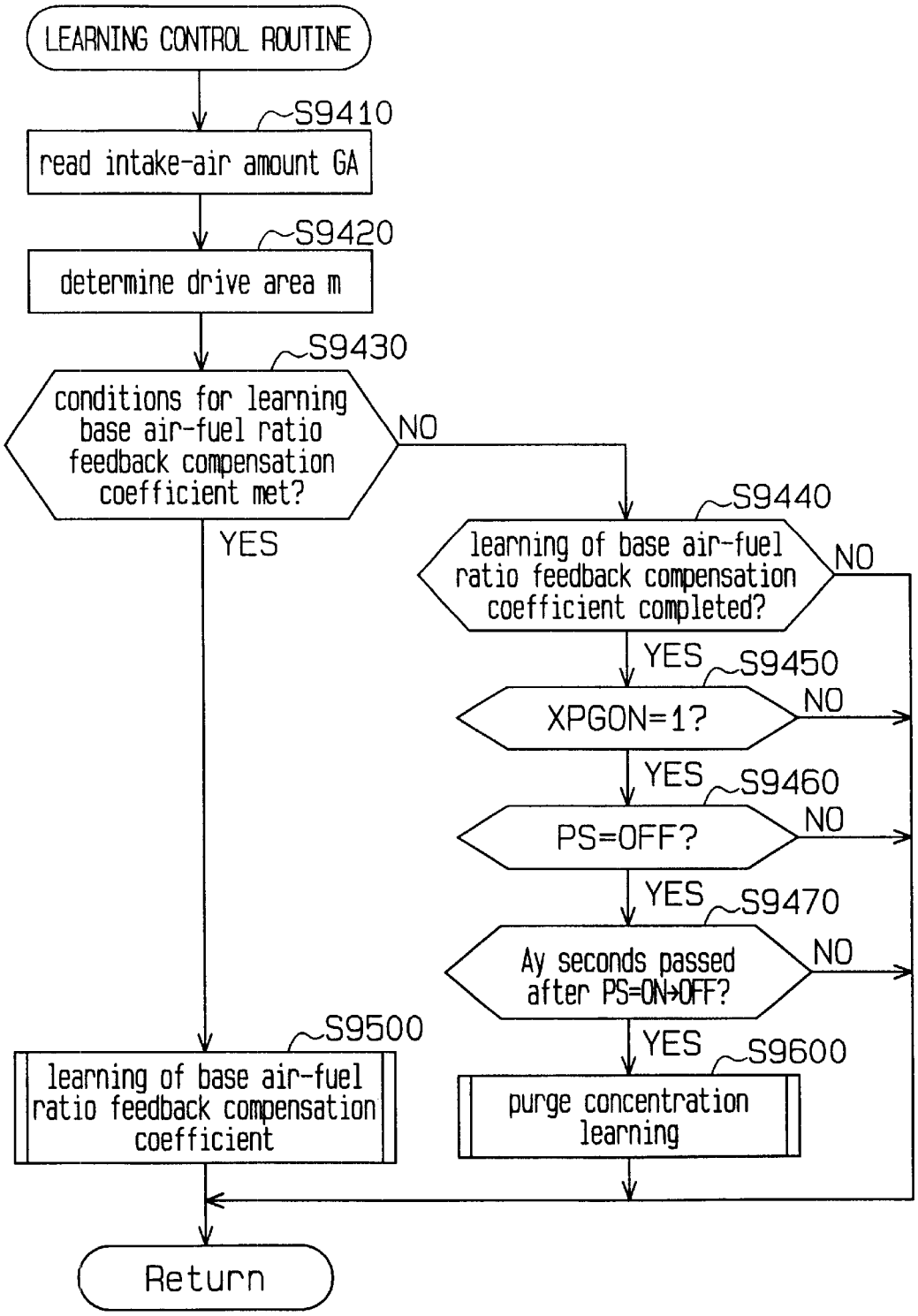
FIG. 43 is a flowchart of a learning control routine in an eleventh embodiment.

The eleventh embodiment differs from the eighth embodiment in that a routine shown in FIG. 43 is implemented instead of the learning control routine in FIG. 12. Otherwise, the structure is the same as that of the eighth embodiment.

The learning control routine in FIG. 43 will now be discussed. When this routine is initiated, first, the ECU 110 fetches the intake-air amount GA detected by the air flow meter 109*c* (S9410) and determines the index m indicative of the drive area of the engine 100 based on the value of that intake-air amount GA (S9420). The contents of this index are the same as those discussed with reference to steps S1410 and S1420 in FIG. 12.

Next, it is determined whether the conditions for learning the base air-fuel ratio feedback compensation coefficient are satisfied (S9430). The content of this determination are the same as the one that has been discussed in the section of step S1430 in FIG. 12. When the conditions for learning the base air-fuel ratio feedback compensation coefficient are met (YES in S9430), the base air-fuel ratio feedback compensation coefficient KG(m) for the current drive area m of the engine 100 is computed in a manner similar to the one that has been discussed with reference to FIG. 13 (S9500). When the conditions for learning the base air-fuel ratio feedback compensation coefficient are not met (NO in S9430), on the other hand, it is determined if learning of the base air-fuel ratio feedback compensation coefficient KG(m) in the current drive area m has been completed (S9440). If learning of KG(m) has not been completed yet (NO in S9440), this learning control routine is temporarily terminated here.

If learning of KG(m) has been completed (YES in S9440), it is determined if the purge execution flag XPGON is set to one as discussed in the section with reference to FIG. 15 (S9450). When XPGON=0 (NO in S9450), the learning control routine is temporarily terminated here. When XPGON=1 (YES in S9450), it is determined whether or not the signal PS from the power steering switch 176 is OFF (S9460). When PS=ON (NO in S9460), the learning control routine is temporarily terminated here.

When PS=OFF (YES in S9460), on the other hand, it is determined if the delay time of Ay seconds has elapsed since the switching of the signal PS from the power steering switch 176 to OFF from ON (S9470). If Ay seconds have not elapsed since the state transition to PS=OFF (NO in S9470), the learning control routine is temporarily terminated here. If Ay seconds have passed since the state transition to PS=OFF (YES in S9470), learning of the purge concentration is executed in the same manner as has been described in the description with reference to FIG. 14 (S9600).

According to the eleventh embodiment, as described above, the purge concentration learning (S9600) is not executed when the differential pressure regulating valve 105 is opened to permit purging of the fuel with a rich concentration (NO in S9460 or NO in S9470).

In the above-described structure, step S9600 is equivalent to the process of the learning means that learns the concentration of the fuel to be purged in the intake air based on the exhaust component. Steps S9460 and S9470 are equivalent to the process of the suppression means that inhibits learning of the purge concentration when it is determined that the differential pressure regulating valve 105 is open.

The above-described eleventh embodiment has the following advantages.

(1) Advantages (1) and (2) of the eighth embodiment.

(2) The concentration of the fuel to be purged in the intake air when the differential pressure regulating valve 105 is open may becomes significantly richer than that in the normal purging from the canister 102. In the purge concentration learning (S9600), therefore, a large error may occur in the learning of the fuel concentration so that the learned value becomes an abnormal value. Learning such an abnormal value brings about a variation in air-fuel ratio under air-fuel ratio feedback control at the later time the purge flow rate is changed. According to the eleventh embodiment, therefore, the purge concentration learning (S9600) is inhibited when it is determined that the differential pressure regulating valve 105 is open. This can suppress a variation in air-fuel ratio.

Other Embodiments

In step S160 of the first embodiment, besides the restriction of the purge rate PGR to the purge-rate restriction value SPGR, the purge control valve 11 may be closed fully for purge rate PGR=0%, thereby stopping purging completely.

Figure 44:
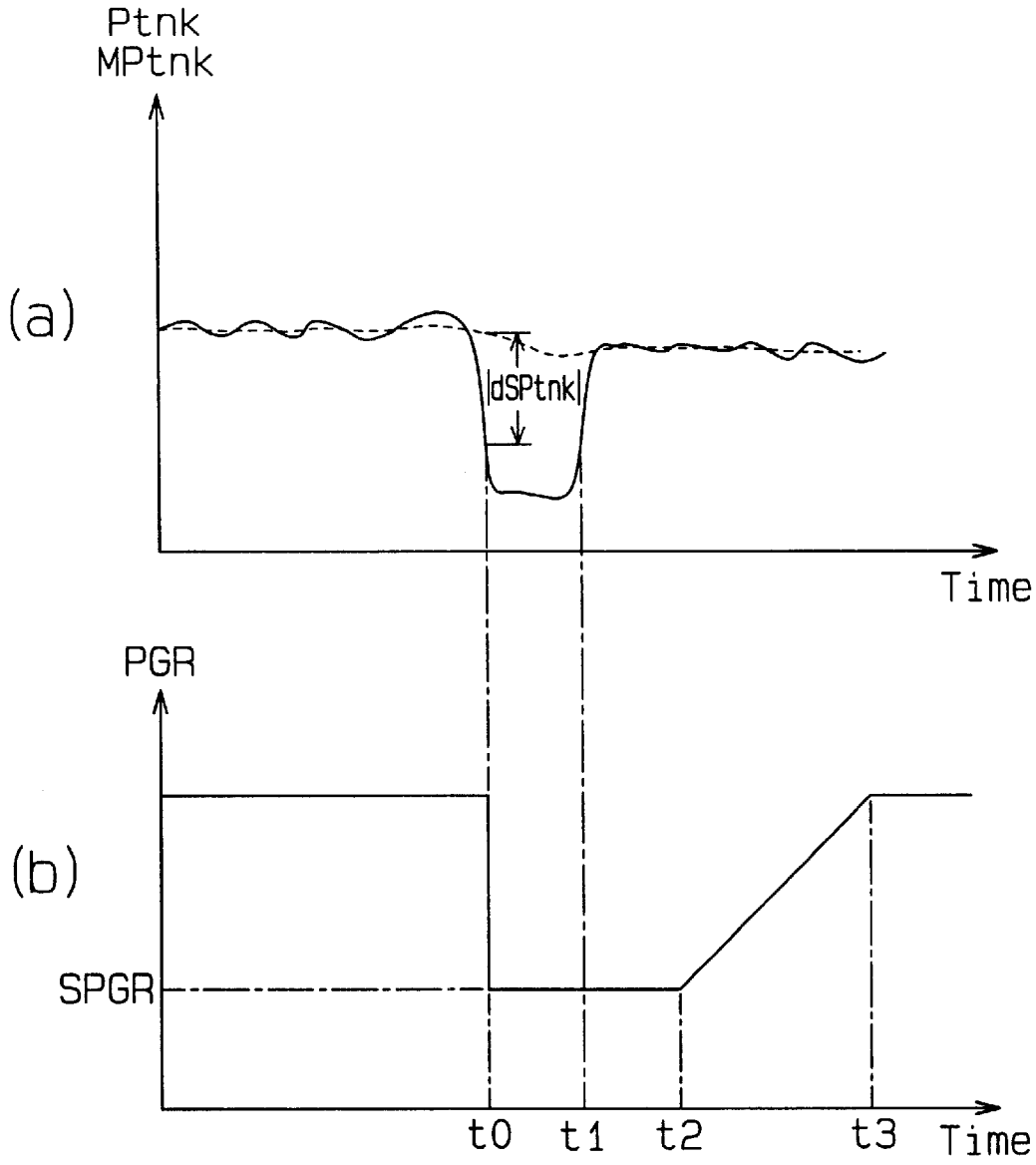
FIG. 44 is a timing chart showing another example of purge rate control.

Although the original purge rate control is resumed immediately after holding the purge restriction for the delay time is completed (NO in S150) in the first embodiment, the purge rate PGR or the angle of the purge control valve 11 may gradually be set back to the level or the angle for the restriction-free state (t2–t3) when the delay time elapses (t2) as shown in, for example, FIG. 44.

In a case of releasing purge restriction, if the original state is resumed immediately, the purge rate for the intake air may be increased rapidly. In this case, the air-fuel ratio feedback control may not cope with the event instantly, resulting in a variation in air-fuel ratio which temporarily adversely affect the emission or the like. In this respect, the angle of the purge control valve 11 is gradually returned to the angle for the restriction-free state after the purge restriction time passes, thereby giving the time for the air-fuel ratio control to cope with such a rapid change. This can suppress a change in air-fuel ratio at the time purge restriction is released. This process of gradually returning the angle of the purge control valve 11 to the original angle, when employed together with or instead of the delay time, can bring about the effect of the delay time.

Although the degree of the turning acceleration Gs is determined based on the turning state and the vehicle speed Vt in the fourth and fifth embodiments, an acceleration sensor which directly detects the turning acceleration Gs may be provided instead so that the value of the detected turning acceleration Gs is used directly.

Although the skip amount is temporarily increased in order to enhance the response to a change in air-fuel ratio in the eighth to eleventh embodiments, the response may be improved by temporarily increasing the integration amount instead.

Although purge restriction is executed on the basis of a change in the pressure in the fuel tank in the first embodiment, the purge restriction may be carried out based on the turning state as done in the second to eleventh embodiments.

Although air-fuel ratio feedback compensation is adjusted based on the turning state in the second to eleventh embodiments, the air-fuel ratio feedback compensation may be adjusted based on a change in the pressure in the fuel tank as per the first embodiment.

Because the fuel surface in the fuel tank is disturbed according to the acceleration in the moving direction of a vehicle, purge restriction or adjustment of air-fuel ratio feedback compensation may be carried out based on a change in the speed of the vehicle or application/non-application of braking (ON/OFF of the brake switch).

What is claimed is:

1. An air-fuel ratio variation limiting apparatus for an internal combustion engine, the apparatus being equipped with an evaporation fuel processing mechanism for supplying fuel vapor in a fuel tank to a canister via a vapor passage and for purging fuel in the canister to an air-intake passage of the internal combustion engine via a purge passage provided with a purge control valve when the internal combustion engine is operated, the apparatus supplying the fuel vapor in the fuel tank during refueling to the canister via a breather passage provided with a pressure sensitive valve that opens in response to a variation in pressure in the fuel tank during refueling, the apparatus comprising:

determination means for determining whether the pressure sensitive valve is open at times other than refueling; and limiting means for limiting variation in the air-fuel ratio when the determination means determines that the pressure sensitive valve is open.

2. The air-fuel ratio variation limiting apparatus according to claim 1, wherein when the determination means determines that the pressure sensitive valve is open, the limiting means controls the purge control valve to restrict purging of fuel to the air-intake passage of the internal combustion engine.

3. The air-fuel ratio variation limiting apparatus according to claim 1, further comprising first detection means for detecting an amount of intake air into the internal combustion engine, and when the determination means determines that the pressure sensitive valve is open and when it is determined that the amount of intake air detected by the first detection means is less than a reference intake-air amount, the limiting means restricts purging of fuel to the air-intake passage of the internal combustion engine by adjusting the position of the purge control valve.

4. The air-fuel ratio variation limiting apparatus according to claim 2, wherein the limiting means continues restricting purging during a delay time when restriction of purging is to be terminated and then the apparatus returns the purge control valve to an unrestricted position.

5. The air-fuel ratio variation limiting apparatus according to claim 2, wherein the limiting means gradually returns the purge control valve to an unrestricted position when restriction of purging is to be terminated.

6. The air-fuel ratio variation limiting apparatus according to claim 2, wherein the limiting means restricts purging of fuel by fully closing the purge control valve.

7. The air-fuel ratio variation limiting apparatus according to claim 2, wherein the limiting means controls the purge contral valve to restrict purging of fuel so that a purge-rate becomes equal to or smaller than a purge rate limit value.

8. The air-fuel ratio variation limiting apparatus according to claim 1, further comprising feedback control means for performing feedback control to set the air-fuel ratio to a target air-fuel ratio based on an exhaust component; and wherein the limiting means limits a variation in the air-fuel ratio by controlling feedback compensation of a ratio of fuel to air by the feedback control means in accordance with the state of the pressure sensitive valve determined by the determination means.

9. The air-fuel ratio variation limiting apparatus according to claim 8, wherein the limiting means limits reduction of the ratio of fuel to air when the pressure sensitive valve is closed by controlling feedback compensation of a ratio of fuel to air by the feedback control means in accordance with the state of the pressure sensitive valve determined by the determination means.

10. The air-fuel ratio variation limiting apparatus according to claim 8, wherein when the determination means determines that the pressure sensitive valve is open, the limiting means restricts feedback compensation to reduce the ratio of fuel to air by the feedback control means.

11. The air-fuel ratio variation limiting apparatus according to claim 8, wherein when the determination means determines that the pressure sensitive valve has been opened, the limiting means temporarily expedites feedback compensation to reduce the ratio of fuel to air by the feedback control means.

12. The air-fuel ratio variation limiting apparatus according to claim 8, wherein when the determination means determines that the pressure sensitive valve has been closed, the limiting means temporarily expedites feedback compensation to increase the ratio of fuel to air by the feedback control means.

13. The air-fuel ratio variation limiting apparatus according to claim 8, wherein the limiting means temporarily expedites feedback compensation to reduce the ratio of fuel to air by the feedback control means when the determination means determines that the pressure sensitive valve has been opened, and temporarily expedites feedback compensation to increase the ratio of fuel to air by the feedback control means when the determination means determines that the pressure sensitive valve has been closed.

14. The air-fuel ratio variation limiting apparatus according to claim 8, wherein the limiting means memorizes a degree of feedback compensation to reduce the ratio of fuel to air by the feedback control means when the determination means determines that the pressure sensitive valve is open, and the limiting means temporarily performs feedback compensation to increase the ratio of fuel to air in accordance with the memorized degree of feedback compensation when the determination means determines that the pressure sensitive valve has been closed.

15. The air-fuel ratio variation limiting apparatus according to claim 8, wherein the limiting means executes a process following closing of the pressure sensitive valve after a delay time.

16. The air-fuel ratio variation limiting apparatus according to claim 1, further comprising learning means for learning a concentration of fuel to be purged to intake air based on an exhaust component, wherein when the determination means determines that the pressure sensitive valve is open, the limiting means inhibits learning by the learning means.

17. The air-fuel ratio variation limiting apparatus according to claim 1, further comprising second detection means for detecting an amount of residual fuel in the fuel tank, wherein when the amount of residual fuel detected by the second detection means is equal to or smaller than a reference residual amount, the determination means suspends the determination of whether the pressure sensitive valve is open.

18. The air-fuel ratio variation limiting apparatus according to claim 1, further comprising detection means for detecting a pressure in the fuel tank, wherein the determination means determines whether the pressure sensitive valve is open based on the pressure in the fuel tank detected by the detection means.

19. The air-fuel ratio variation limiting apparatus according to claim 18, wherein when there has been a drop in the pressure in the fuel tank greater than a reference value for determining an abrupt pressure fall, the determination means determines that the pressure sensitive valve is open.

20. The air-fuel ratio variation limiting apparatus according to claim 1, wherein the determination means detects the state of the surface of the fuel in the fuel tank and determines the open state of the pressure sensitive valve accordingly.

21. The air-fuel ratio variation limiting apparatus according to claim 20, wherein when the state of the surface of fuel in the fuel tank is greater than a reference value, the determination means determines that the pressure sensitive valve is open.

22. The air-fuel ratio variation limiting apparatus according to claim 20, wherein the internal combustion engine is mounted on a vehicle, and the determination means detects a turning state of the vehicle to represent the state of the surface of fuel in the fuel tank and determines whether the pressure sensitive valve is open based on the turning state.

23. The air-fuel ratio variation limiting apparatus according to claim 22, wherein when the mobile body is turning, the determination means determines that the pressure sensitive valve is open.

24. The air-fuel ratio variation limiting apparatus according to claim 23, wherein when the vehicle turns for a reference time or longer, the determination means determines that the pressure sensitive valve has closed.

25. The air-fuel ratio variation limiting apparatus according to claim 22, wherein when the vehicle starts to turn, the determination means determines that the pressure sensitive valve has opened.

26. The air-fuel ratio variation limiting apparatus according to claim 22, wherein when the vehicle stops turning, the determination means determines that the pressure sensitive valve has opened.

27. The air-fuel ratio variation limiting apparatus according to claim 20, wherein the internal combustion engine is mounted in a vehicle, and the determination means detects a turning state of the vehicle and an amount of residual fuel to represent the state of the surface of fuel in the fuel tank and determines whether the pressure sensitive valve is open based on the turning state and the amount of residual fuel.

28. The air-fuel ratio variation limiting apparatus according to claim 22, wherein the determination means detects a turning acceleration as the turning state.

29. The air-fuel ratio variation limiting apparatus according to claim 28, wherein the determination means detects the speed and a steering angle of the vehicle and detects the turning acceleration based on the speed and steering angle of the vehicle.

30. The air-fuel ratio variation limiting apparatus according to claim 22, wherein the determination means detects a steering angle as the turning state.

31. The air-fuel ratio variation limiting apparatus according to claim 22, wherein the determination means detects whether or not steering motion is occurring as the turning state.

32. The air-fuel ratio variation limiting apparatus according to claim 22, wherein the determination means detects whether or not there is auxiliary steering force as the turning state.

33. The air-fuel ratio variation limiting apparatus according to claim 22, wherein the determination means detects the speed and steering motion of the vehicle as the turning state and determines that the pressure sensitive valve has opened when detecting that the vehicle has been steered and that the speed of the vehicle is equal to or greater than a reference speed.

34. The air-fuel ratio variation limiting apparatus according to claim 22, wherein the determination means detects the speed and the existence of an auxiliary steering force of the vehicle as the turning state and determines that the pressure sensitive valve has opened when detecting that there is an auxiliary steering force and that the speed of the vehicle is equal to or greater than a reference speed.

35. The air-fuel ratio variation limiting apparatus according to claim 20, wherein the internal combustion engine is mounted on a vehicle, and the determination means detects an acceleration state of the vehicle as the fluctuation state of the surface of fuel in the fuel tank and determines the open state of the pressure sensitive valve based on the acceleration state.

36. The air-fuel ratio variation limiting apparatus according to claim 35, wherein the determination means detects a change in the speed of the vehicle per unit time as the acceleration state of the vehicle and determines that the pressure sensitive valve has opened when the change in the speed change is equal to or greater than a reference speed change.

37. The air-fuel ratio variation limiting apparatus according to claim 35, wherein the determination means detects a braking state of the vehicle as the acceleration state of the vehicle and determines that the pressure sensitive valve has been opened when detecting that braking is being applied to the vehicle.

38. The air-fuel ratio variation limiting apparatus according to claim 4, wherein the delay time is set in accordance with the open state of the pressure sensitive valve when it is determined that the pressure sensitive valve is open.

39. The air-fuel ratio variation limiting apparatus according to claim 1, wherein when the determination means is abnormal, the limiting means does not restrict variation in the air-fuel ratio according to the state of the pressure sensitive valve.

40. The air-fuel ratio variation limiting apparatus according to claim 8, wherein the limiting means temporarily expedites feedback compensation to reduce the ratio of fuel to air by the feedback control means when the determination means determines that the pressure sensitive valve has opened or has closed, and temporarily expedites feedback compensation to increase the ratio of fuel to air by the feedback control means when the determination means determines that the pressure sensitive valve has been closed.

* * * * *